US011136771B2

(12) United States Patent
Petty et al.

(10) Patent No.: US 11,136,771 B2
(45) Date of Patent: Oct. 5, 2021

(54) MODULAR BOOTH

(71) Applicant: ZGF ARCHITECTS LLP, Portland, OR (US)

(72) Inventors: Robert Petty, Portland, OR (US); Robin Oglesbee-Venghaus, Portland, OR (US)

(73) Assignee: ZGF ARCHITECTS LLP, Portland, OR (US)

( * ) Notice: Subject to any disclaimer, the term of this patent is extended or adjusted under 35 U.S.C. 154(b) by 316 days.

(21) Appl. No.: 16/092,286

(22) PCT Filed: Apr. 14, 2017

(86) PCT No.: PCT/US2017/027793
§ 371 (c)(1),
(2) Date: Oct. 9, 2018

(87) PCT Pub. No.: WO2017/181133
PCT Pub. Date: Oct. 19, 2017

(65) Prior Publication Data

US 2020/0347626 A1 Nov. 5, 2020

Related U.S. Application Data

(60) Provisional application No. 62/322,316, filed on Apr. 14, 2016.

(51) Int. Cl.
*A47F 10/00* (2006.01)
*E04H 1/12* (2006.01)
*E04B 1/343* (2006.01)

(52) U.S. Cl.
CPC ..... *E04H 1/1272* (2013.01); *E04B 1/34357* (2013.01); *A47B 2200/0071* (2013.01); *E04B 1/34321* (2013.01); *E05Y 2900/132* (2013.01)

(58) Field of Classification Search
None
See application file for complete search history.

(56) References Cited

U.S. PATENT DOCUMENTS 1,027,816 A 5/1912 Cassity
1,308,702 A 7/1919 Fellheimer
(Continued)

FOREIGN PATENT DOCUMENTS

DE 29616703 U1 2/1997
EP 1142508 A1 10/2001
WO 9834515 A2 8/1998

OTHER PUBLICATIONS

ISA Korean Intellectual Property Office, International Search Report Issued in Application No. PCT/US2017/027793, dated Sep. 5, 2017, WIPO, 2 pages.
(Continued)

*Primary Examiner* — Basil S Katcheves
(74) *Attorney, Agent, or Firm* — McCoy Russell LLP

(57) ABSTRACT

Methods and systems are provided for a modular booth. In one example, a modular booth includes a first wall and a second wall coupled together by a ceiling, and further includes a plurality of modular elements coupled to the first wall and second wall. The modular elements may be moved to a retracted position to be stored within the walls or moved to an extended position to be utilized by a user of the booth, and the first wall, second wall, and ceiling may be decoupled from each other or folded against each other for transportation or compact storage of the booth.

19 Claims, 31 Drawing Sheets

(56) References Cited

U.S. PATENT DOCUMENTS 2,090,827 A * 8/1937 Andrew Bak ..... E04H 1/1222 52/32
3,733,759 A * 5/1973 Schulte ..... E04B 2/74 52/126.4
5,242,005 A 9/1993 Borgardt
5,426,900 A * 6/1995 Springer ..... A47K 4/00 4/460
5,622,198 A * 4/1997 Elsinger ..... E04H 15/48 135/128
5,678,905 A 10/1997 Kelley
5,775,034 A * 7/1998 Logue ..... A47B 5/06 108/37
5,778,607 A 7/1998 Edwards
6,732,660 B2 5/2004 Dame et al.
8,006,986 B1 * 8/2011 Pazhoor ..... E04H 1/1255 280/47.34
8,640,391 B2 * 2/2014 Newkirk ..... E04H 3/08 52/36.1
9,022,414 B2 * 5/2015 Bell ..... B65D 7/26 280/651
9,723,919 B1 * 8/2017 Randolph ..... A47B 3/00
2002/0194792 A1 * 12/2002 Feldpausch ..... F16M 11/425 52/36.1
2003/0196388 A1 * 10/2003 Edwards ..... A47B 96/00 52/36.1
2007/0204524 A1 * 9/2007 Kern ..... A47B 87/0284 52/36.1
2007/0289225 A1 * 12/2007 Kern ..... A47B 87/007 52/36.1
2008/0010923 A1 1/2008 MacGregor et al.
2008/0110104 A1 * 5/2008 Benzinger ..... E04H 5/02 52/36.1
2009/0102231 A1 * 4/2009 Atcravi ..... B60P 3/34 296/175
2009/0145050 A1 * 6/2009 Dugand ..... F16B 12/40 52/36.1
2011/0010847 A1 * 1/2011 Murphy ..... A47C 13/00 5/35
2011/0037360 A1 2/2011 Jakins et al.
2011/0219706 A1 * 9/2011 Bates ..... A47B 96/067 52/36.1
2011/0283632 A1 * 11/2011 Sutton ..... A47B 96/06 52/36.1
2014/0144088 A1 * 5/2014 Heger ..... E04B 1/34357 52/79.5
2014/0327350 A1 * 11/2014 Tassin ..... A47B 96/16 312/249.7
2016/0258108 A1 * 9/2016 Jindra ..... D06F 60/00

OTHER PUBLICATIONS

European Patent Office, Extended European Search Report Issued in Application No. 17783325.8, dated Apr. 15, 2020, Germany, 8 pages.

* cited by examiner

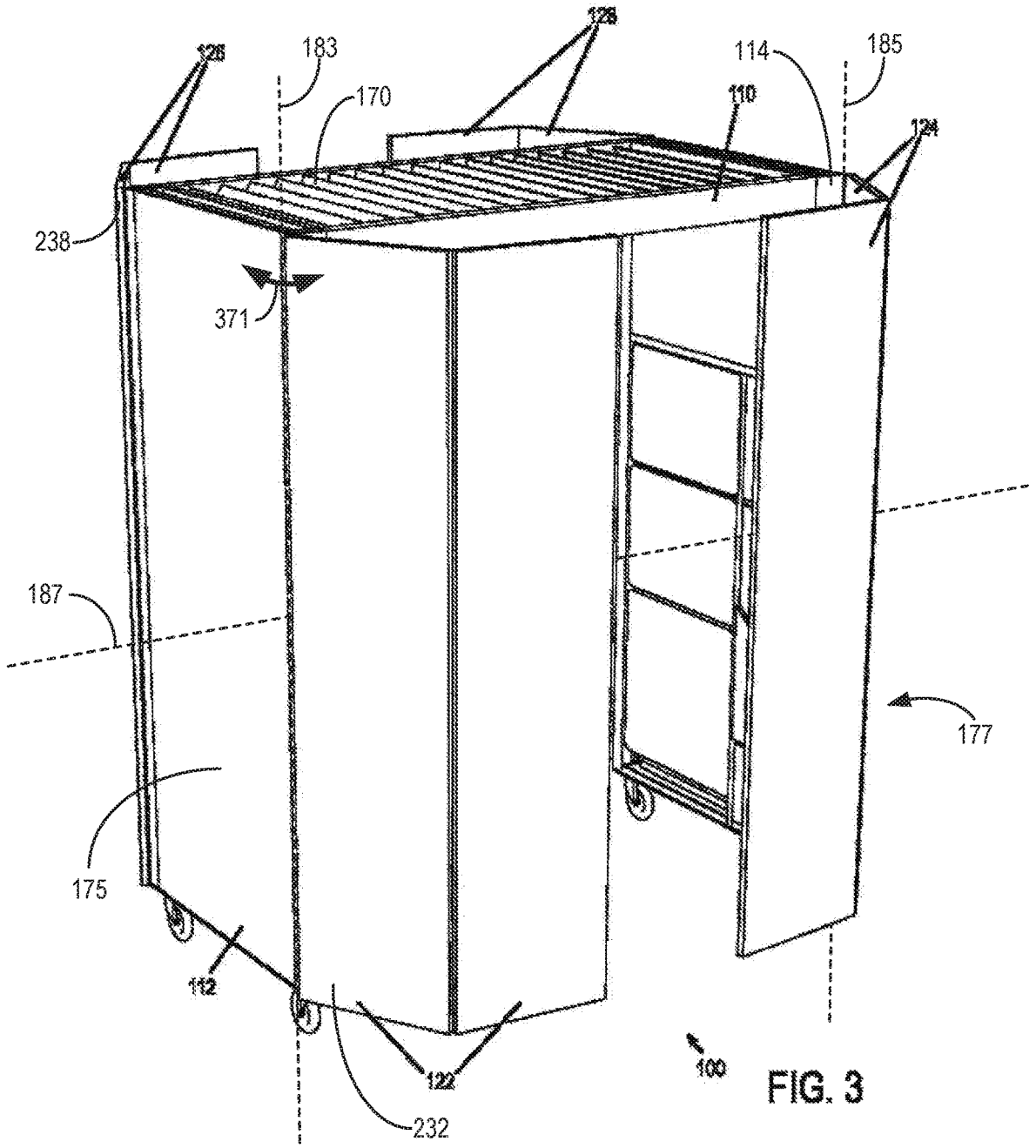
FIG. 3
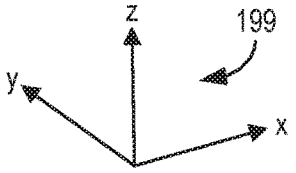

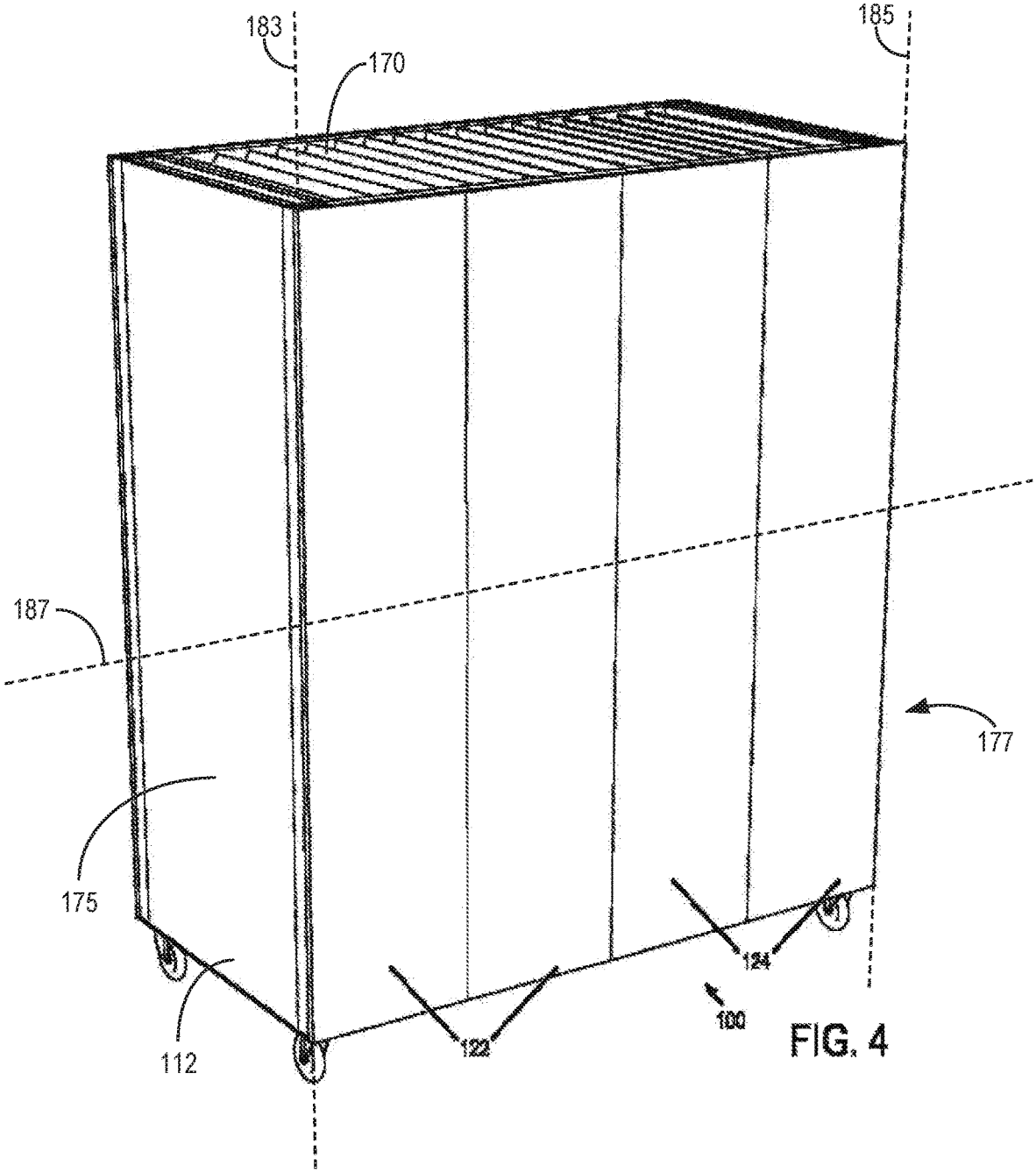
FIG. 4
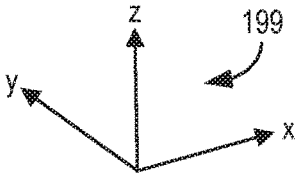

MODULAR BOOTH

CROSS REFERENCE TO RELATED APPLICATIONS

The present application is a U.S. National Phase of International Patent Application Serial No. PCT/US2017/027793, entitled "MODULAR BOOTH," filed on Apr. 14, 2017. International Patent Application Serial No. PCT/US2017/027793 claims priority to U.S. Provisional Patent Application No. 62/322,316, entitled "MODULAR WORKSTATION," filed on Apr. 14, 2016. The entire contents of each of the above-listed applications are hereby incorporated by reference for all purposes.

FIELD

The present description relates generally to methods and systems for a booth, and in particular, for a modular booth having an expandable workspace.

BACKGROUND/SUMMARY

Modular booths accommodate people in a variety of different settings, such as for workers in a business or commercial setting, for travelers in airports, train stations, or other travel centers, for trade shows or other large events, and for personal in-home use. Modular booths may also take a variety of different forms, and may accommodate an individual user or multiple users. Typically, these modular booths include a work surface such as a desk, storage, and some form of privacy screening from neighboring booths.

One example approach is shown by Logue in U.S. Pat. No. 5,775,034. Therein, a folding screen environment is disclosed including a plurality of screens that provide storage space for various elements, such as chairs, tables, lamps, etc. The screens interact by means of pin hinge assemblies and some of the elements may be free standing when removed from the screens for use. Another example approach is shown by Dame et al. in U.S. Pat. No. 6,732,660. Therein, a modular workstation is disclosed including a plurality of wheels and at least one column configured to support a work surface. In some configurations, the workstation may include a pair of columns and the work surface may be supported by support arms coupled to each column.

However, the inventors herein have recognized potential issues with such systems. As one example, a folding screen environment system such as that describe by the '034 patent includes a plurality of pivotable screens, but each of the screens is pivotable relative to each other screen and none of the screens are in a fixed position relative to each other. As a result, a workspace formed by the system may not be fully enclosed on each side and users of the workspace may be subjected to increased amounts of noise and/or disturbances from sources external to the workspace. Additionally, the screens may pivot and/or shift relative to each other during conditions in which the system is moved from an initial location to a different location. A configuration of the system (e.g., a relative position of the screens, elements, etc.) may therefore be lost when the system is moved, resulting in a decreased mobility of the system and an increased amount of time to re-configure the system. As another example, a modular workstation such as that described by the '660 patent also does not form a fully enclosed workspace. A configuration of the workstation (e.g., a relative position of one or more desktop attachments coupled to the workstation) is not retained during conditions in which the workstation is disassembled for storage, and the workstation does not include devices adapted to seat (e.g., support) a user of the workstation.

In one example, the issues described above may be addressed by a modular booth including a frame formed by two opposing walls and a ceiling, a first pair of doors coupled to a first side of the frame and a second pair of doors coupled to a second side of the frame, one or more modular elements coupled to the frame, the one or more modular elements movable between a stowed position and a fully extended position, and a set of casters coupled to a ground surface of the frame As one example, the modular elements includes desks and seating, and the doors may create privacy screening, all in a moveable form factor. The modular booth includes a frame that is formed by two opposing walls and a ceiling. The frame provides a reconfigurable span within which stowed desks and seats may be folded outward from the opposing walls to accommodate one or more users. A pair of doors is included on each side of the frame to provide reconfigurable privacy screening. The frame is supported upon a set of casters that enable the modular booth to be easily moved between locations. The modular booth may be disassembled into a form that is suitable for flat packing and shipment, and easily reassembled for use.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

FIG. 3 shows the modular booth with the seats and desks fully retracted, and with the door assemblies partially extended to form a partially enclosed workspace.

FIG. 4 shows the modular booth with the door assemblies fully extended to form a fully enclosed workspace.

FIGS. 1-9 and FIGS. 11-19 are shown to scale, although other relative dimensions may be used, if desired.

DETAILED DESCRIPTION

The following description relates to systems and methods for a modular booth that may include desks and seating configured to be stowed within opposing walls of the booth. The booth may be easily disassembled for storage and/or shipping and may include various components configured to increase a mobility and/or privacy of the booth. The booth may include various electronic components such as lights, speakers, graphical display devices, etc. and may additionally be configured to couple with one or more similar booths in order to form an expanded workspace.

Figure 1:
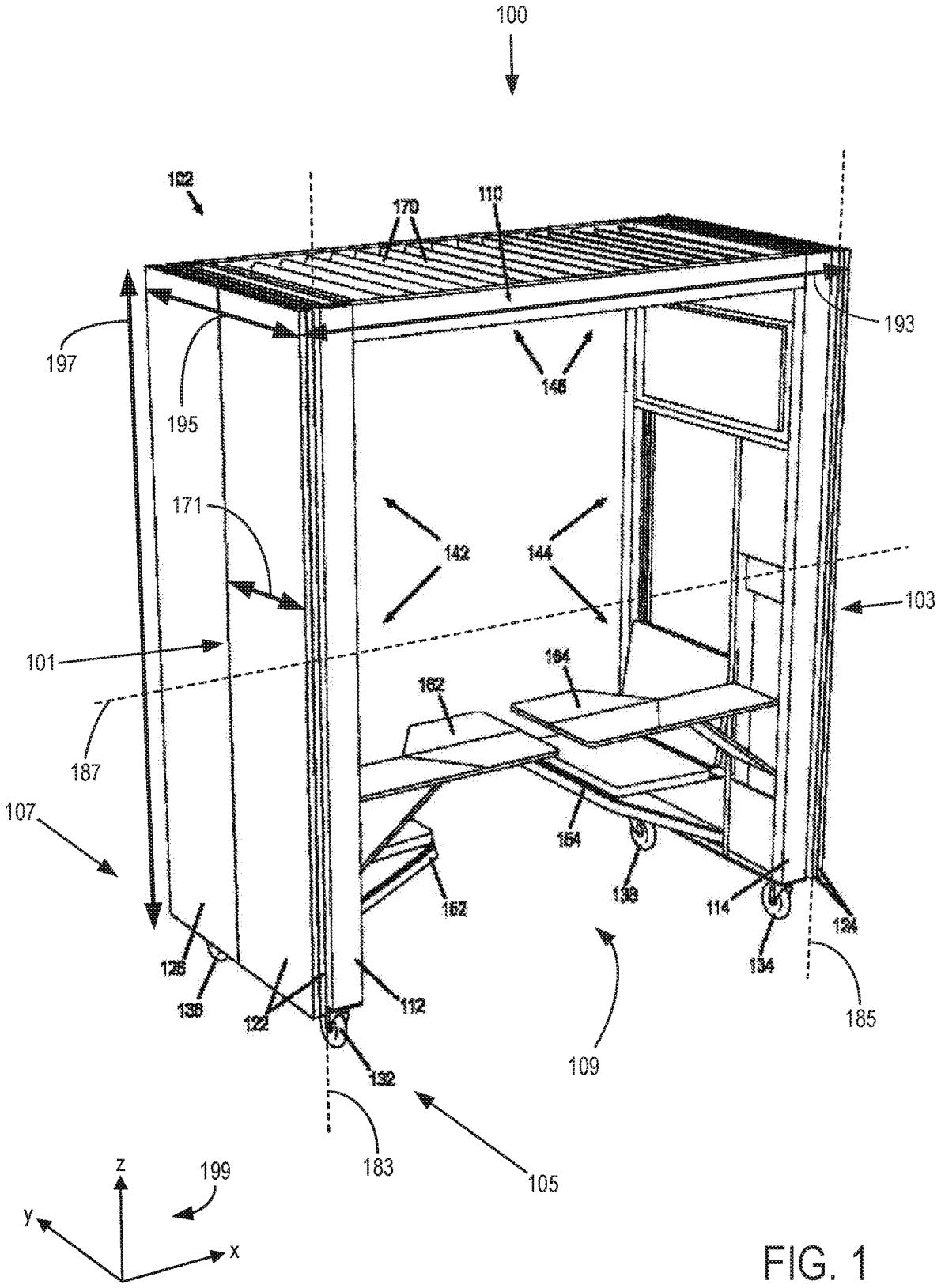
FIG. 1 shows a modular booth with door assemblies of the modular booth fully retracted, and with seats and desks of the booth fully extended.
Figure 5A:
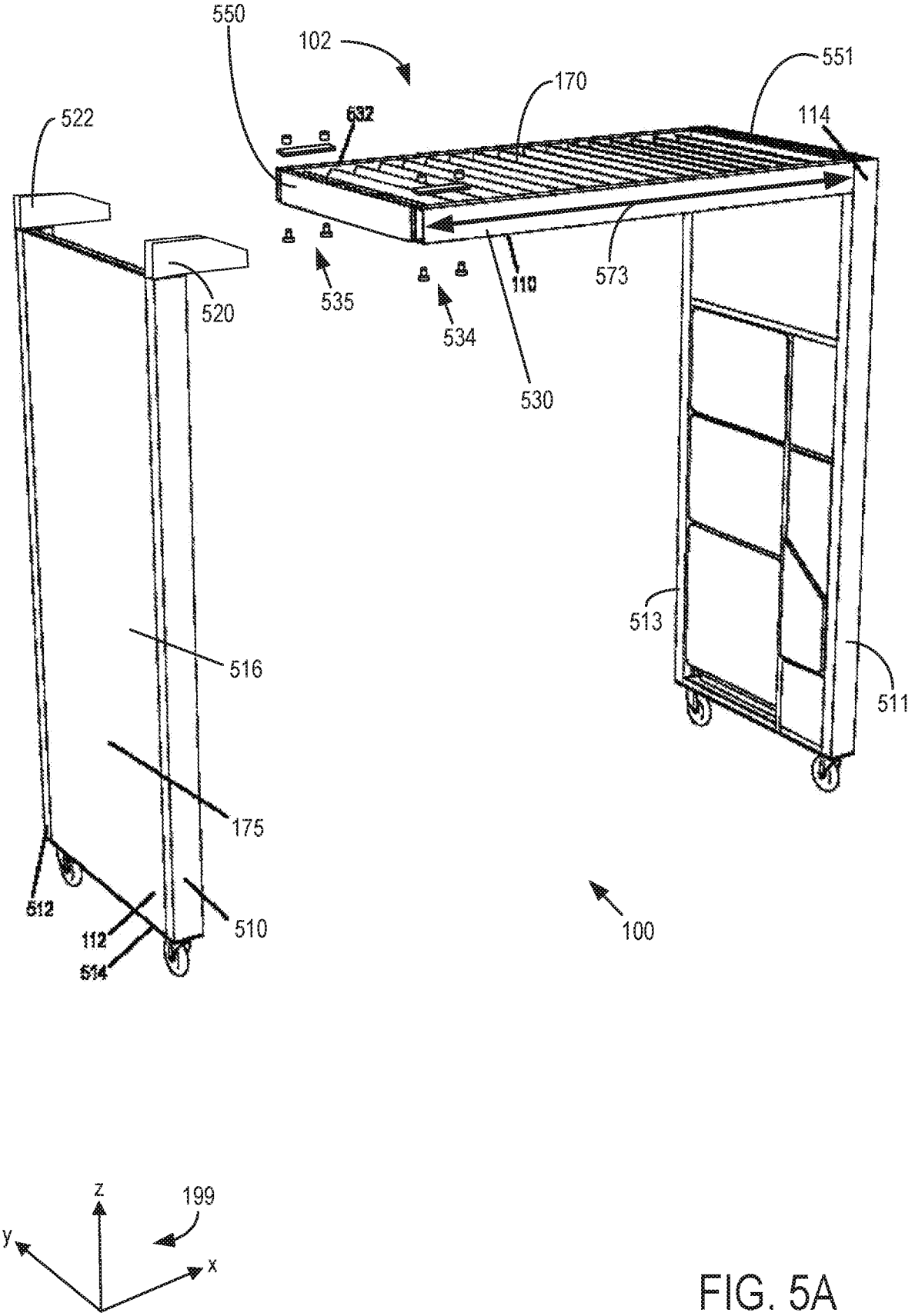
FIGS. 5A-5B each show the modular booth in partially disassembled arrangements.
Figure 5B:
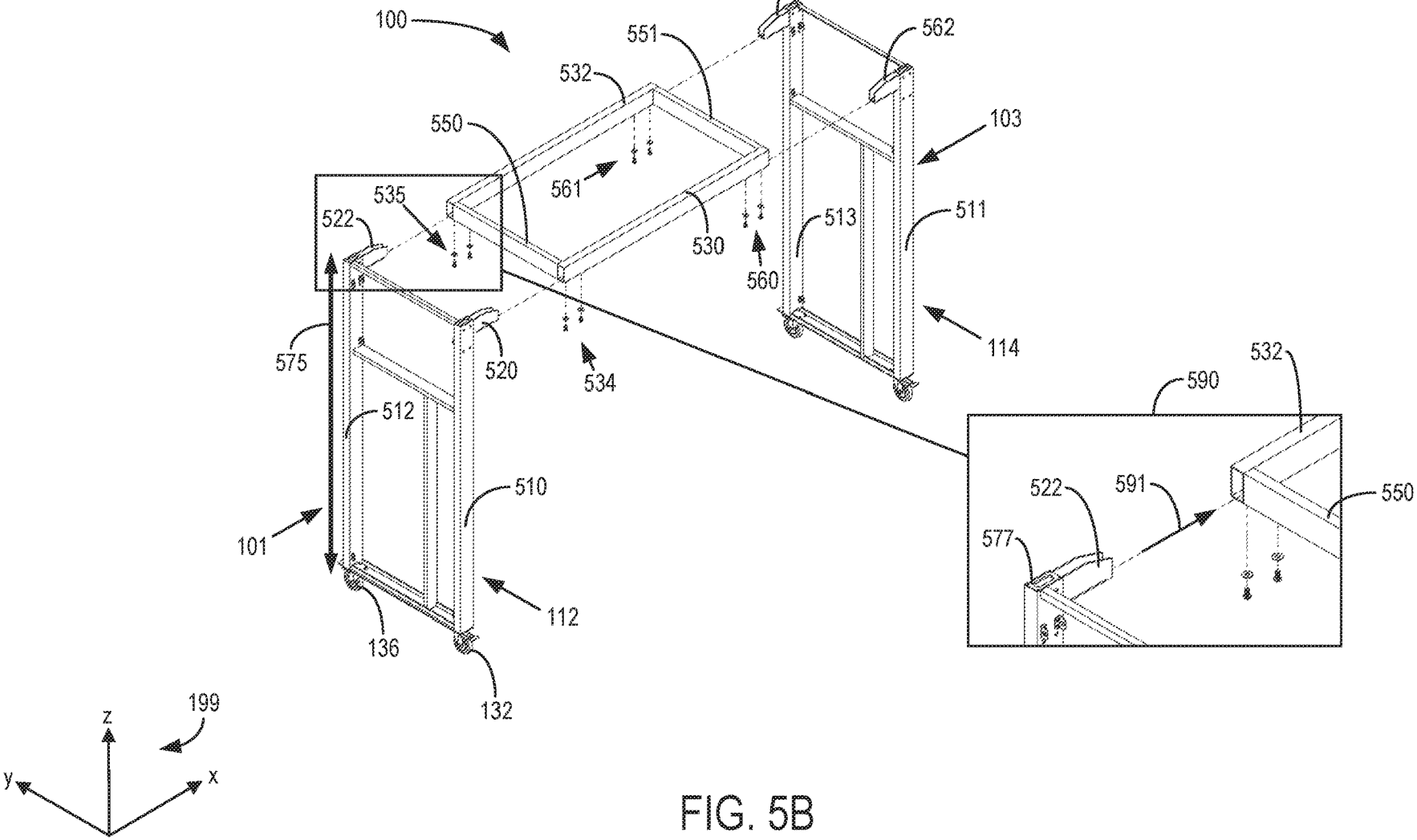
Figure 6:
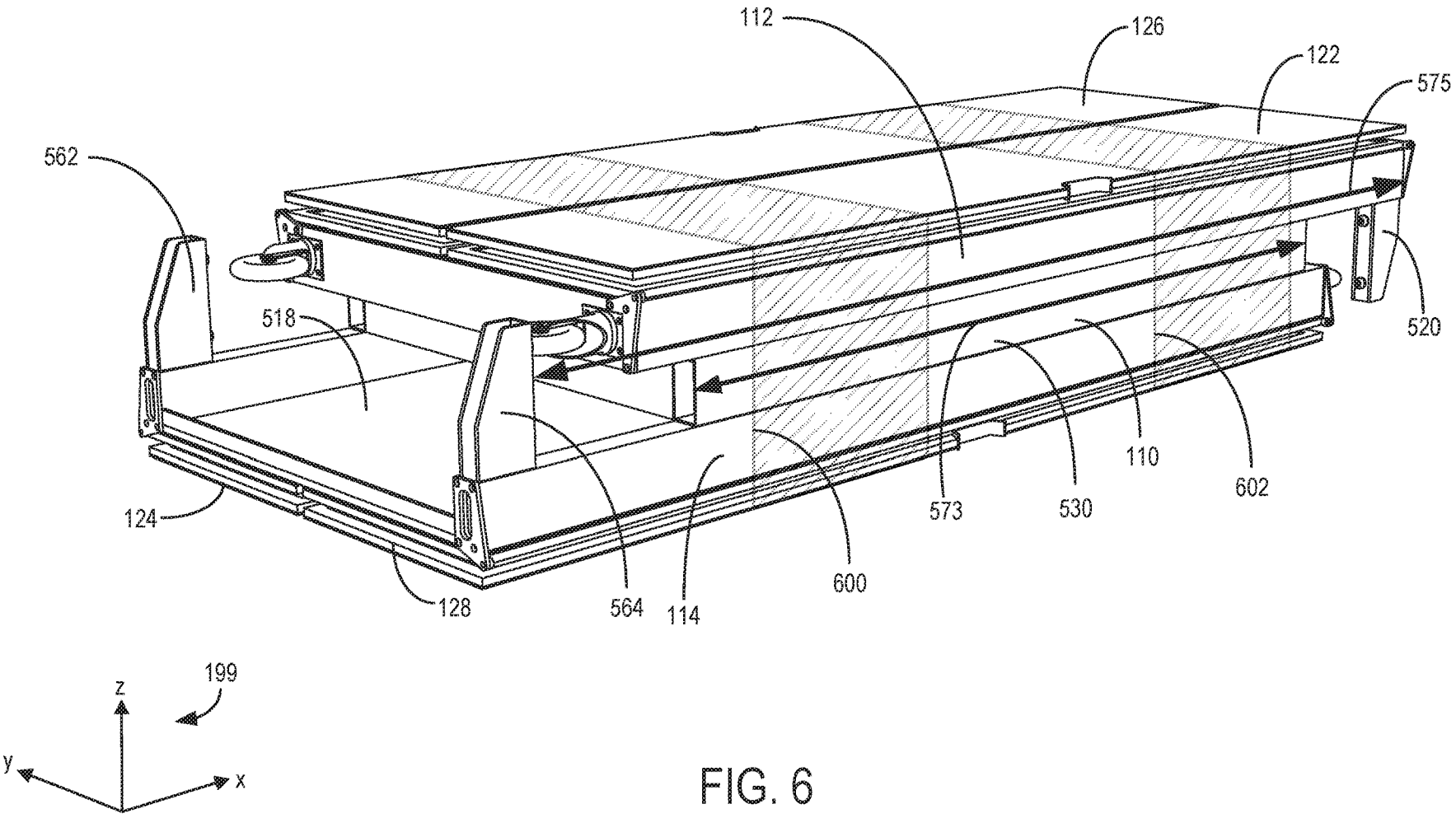
FIG. 6 shows the modular booth in a fully disassembled arrangement.
Figure 14:
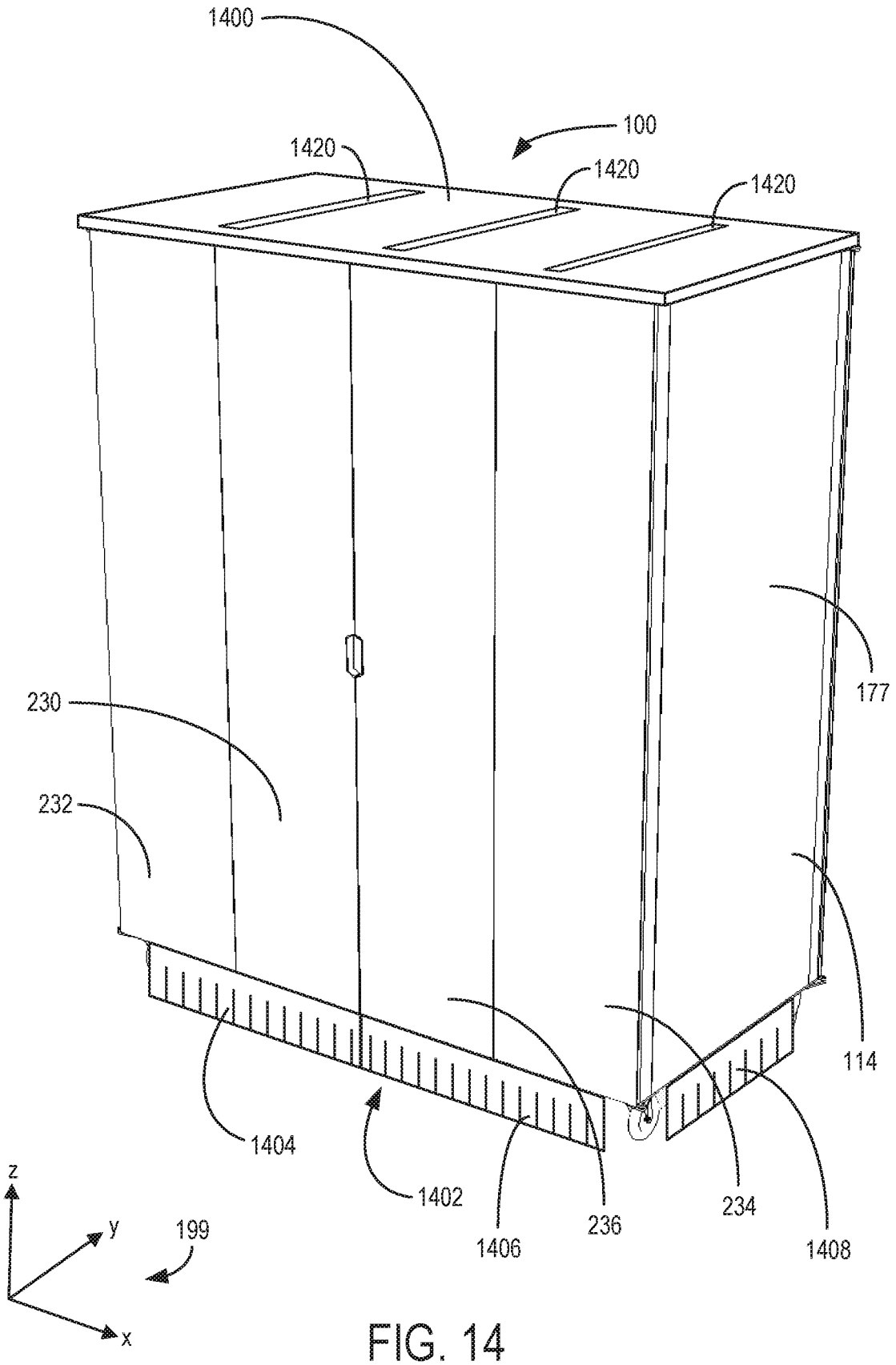
FIG. 14 shows a perspective view the modular booth with a sound damping skirt and sound damping top coupled to the modular booth.
Figure 15:
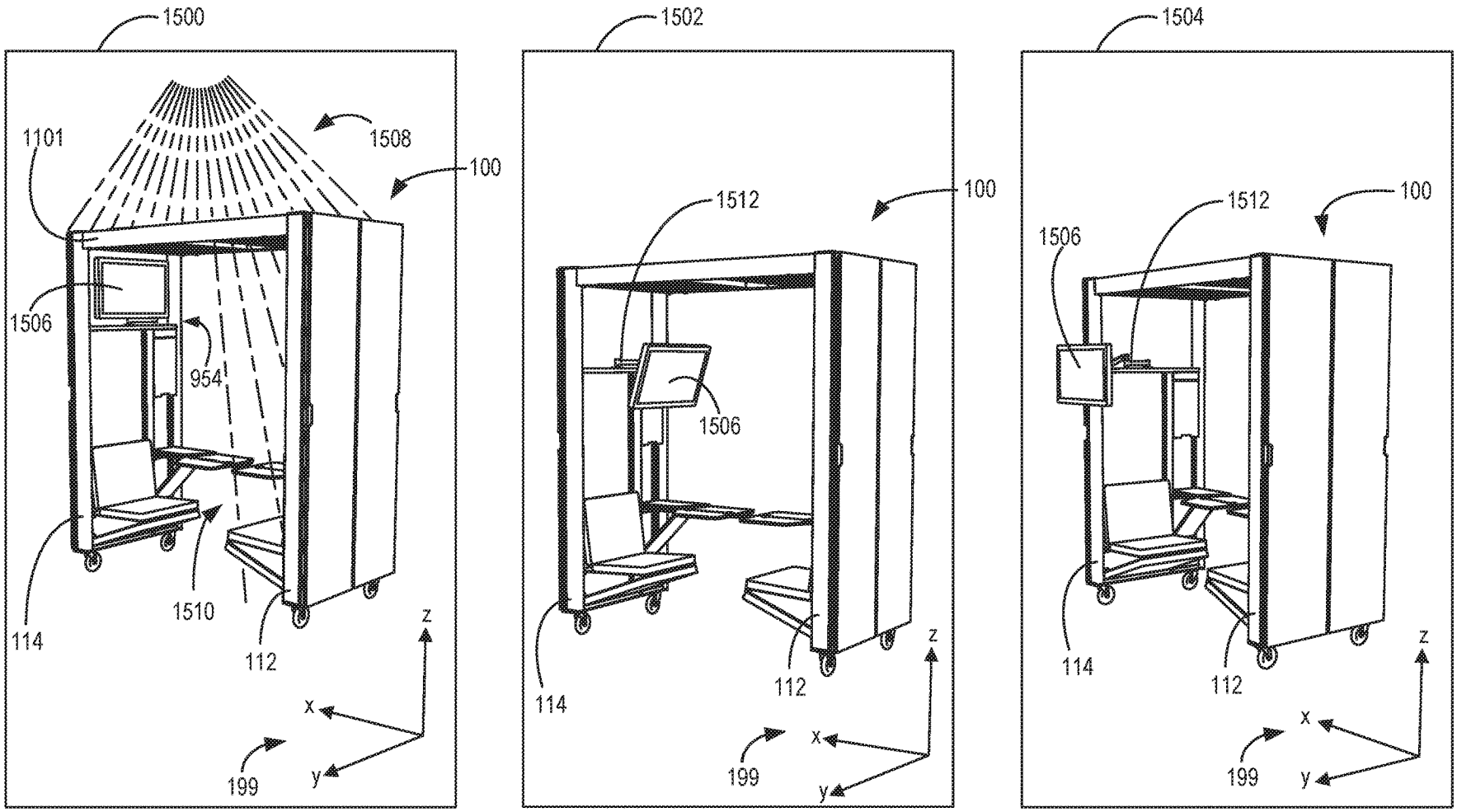
FIG. 15 shows three example positions of a graphical display device coupled to the modular booth.
Figure 16:
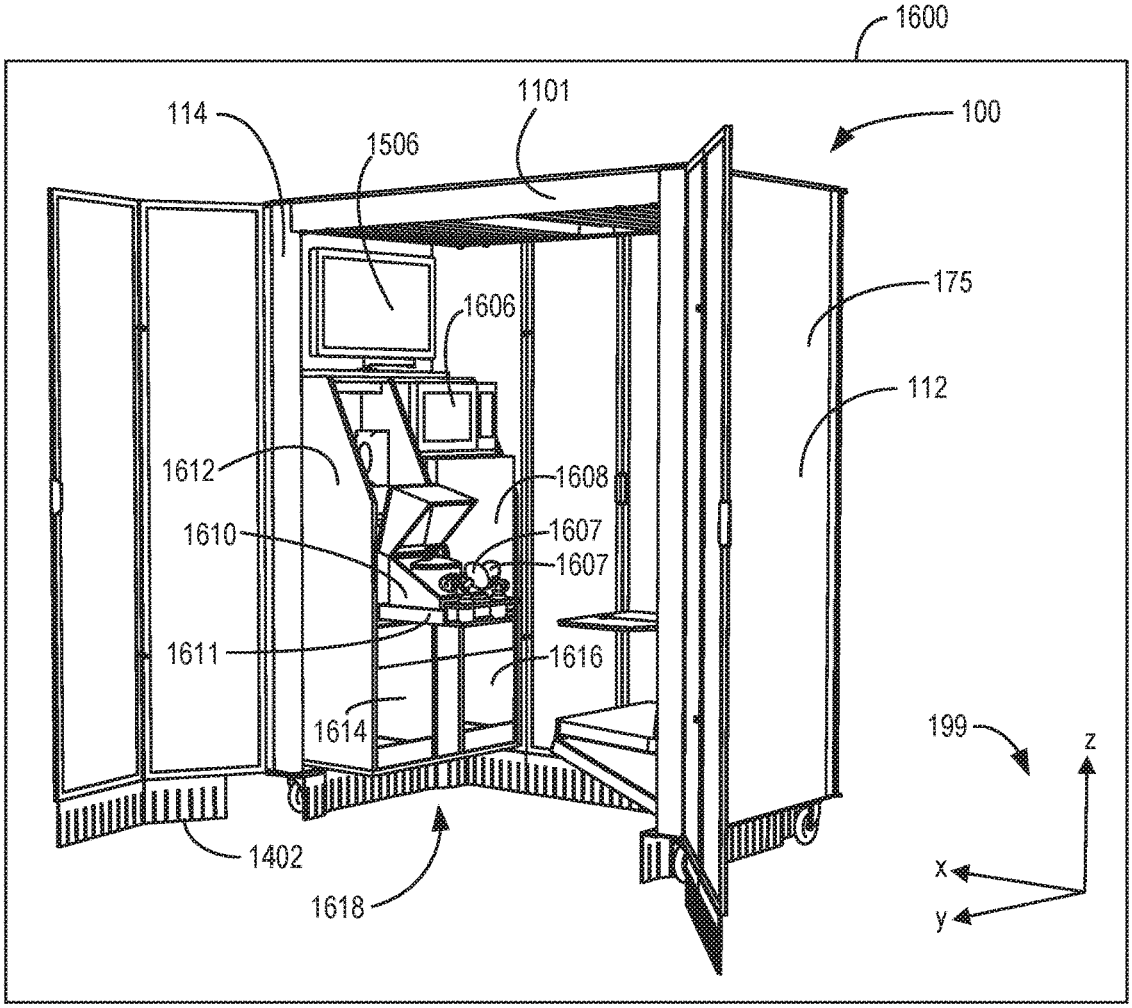
FIG. 16 shows an example modular element that may be included by the modular booth.
Figure 16:
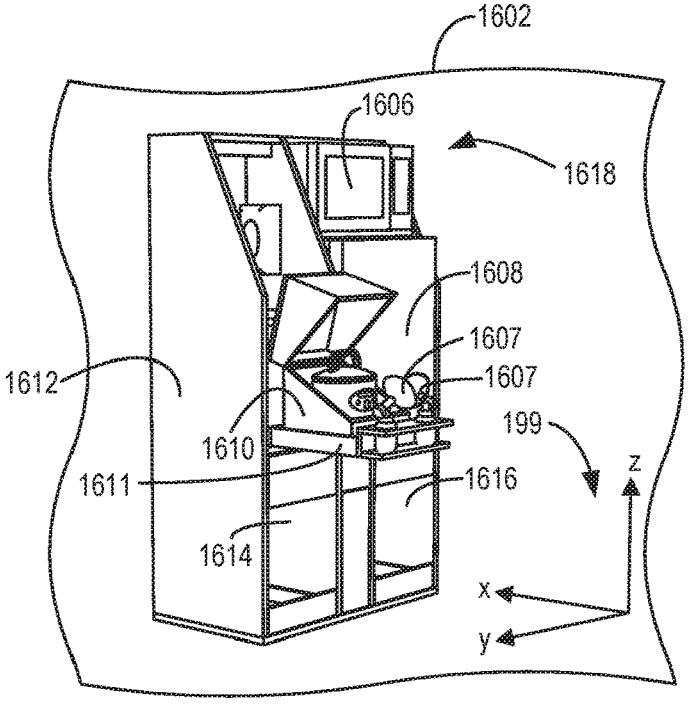

A modular booth, such as the modular booth shown by FIG. 1, includes a frame that is formed by two opposing walls and a ceiling. The frame forms a partially enclosed, on-demand workspace that may accommodate one or more users. Each of the opposing walls is coupled to hinged door assemblies that may be extended or retracted into a plurality of positions (shown by FIGS. 2-4) in order to adjust an amount of opening between the opposing walls and to provide privacy screening. Auxiliary panels may be coupled to door panels of the door assemblies at a plurality of locations (as shown by FIG. 9). The modular booth may additionally include a removable acoustical damping skirt and/or a ceiling cover (as shown by FIG. 14) in order to further increase the privacy of the workspace. The frame may be supported upon a set of casters that enable the modular booth to be easily moved between locations. The modular booth may be disassembled (as shown by FIGS. 5A-5B and FIG. 6) into a form that is suitable for flat packing and shipment, and may be easily reassembled for use. The booth includes a plurality of modular elements coupled to the walls. In some examples, the modular elements may include one or more adjustable desks (shown by FIGS. 7A-7E) and/or one or more adjustable seats (shown by FIGS. 8A-8E). In other examples (as shown by FIG. 16), the modular elements may include different devices such as a refrigerator, microwave oven, shelving, etc. In some examples, the modular elements may be configured to be stored within the walls and may be extended outward for utilization by a user of the booth. The booth may receive electrical power via an electrical bus (as shown schematically by FIG. 10) in order to power one or more electrical devices of the booth, such as lights (shown by FIGS. 11-13), graphical display devices (shown by FIG. 15), etc. In some examples (as shown by FIGS. 17-22), two or more modular booths may be coupled together via support mechanisms such as hooks, latches, etc.

FIG. 1 depicts an example modular booth 100. Modular booth 100 includes a frame 102 formed by a ceiling 110, a first wall 112, and a second wall 114. Frame 102 partially encloses modular booth 100 by opposing first wall 112 and second wall 114, and further by ceiling 110 to provide a reconfigurable span (e.g., space) within which one or more people (e.g., users) may work, meet, or otherwise reside.

During conditions in which the frame 102 is assembled, the first wall 112 and second wall 114 are coupled to the ceiling 110 and positioned parallel with each other, and the ceiling 110 extends between the first wall 112 and second wall 114 in a direction perpendicular to the first wall 112 and second wall 114. The first wall 112 is positioned at a first end 101 of the modular booth 100, and the second wall 114 is positioned at a second end 103 of the modular booth 100 opposite to the first end 101. An opening 109 is formed between the first end 101 and second end 103. The opening 109 extends from a first side 105 of the modular booth 100 to a second side 107 of the modular booth 100, with the second side 107 opposite to the first side 105. The opening 109 partially forms a workspace within the modular booth 100 (e.g., the space within which one or more users may work, meet, or otherwise reside). As one non-limiting example, a length 193 of the modular booth 100 (e.g., an overall length of the modular booth 100 in a direction from the first end 101 to the second end 103) may be approximately 72 inches, a width 195 of the modular booth 100 (e.g., an overall width of the modular booth 100 in a direction from the first side 105 to the second side 107) may be approximately 36 inches, and a height 197 of the booth (e.g., an overall height of the modular booth 100 in a direction from the ground on which the modular booth 100 sits to the ceiling 110) may be approximately 88 inches.

Figure 2:
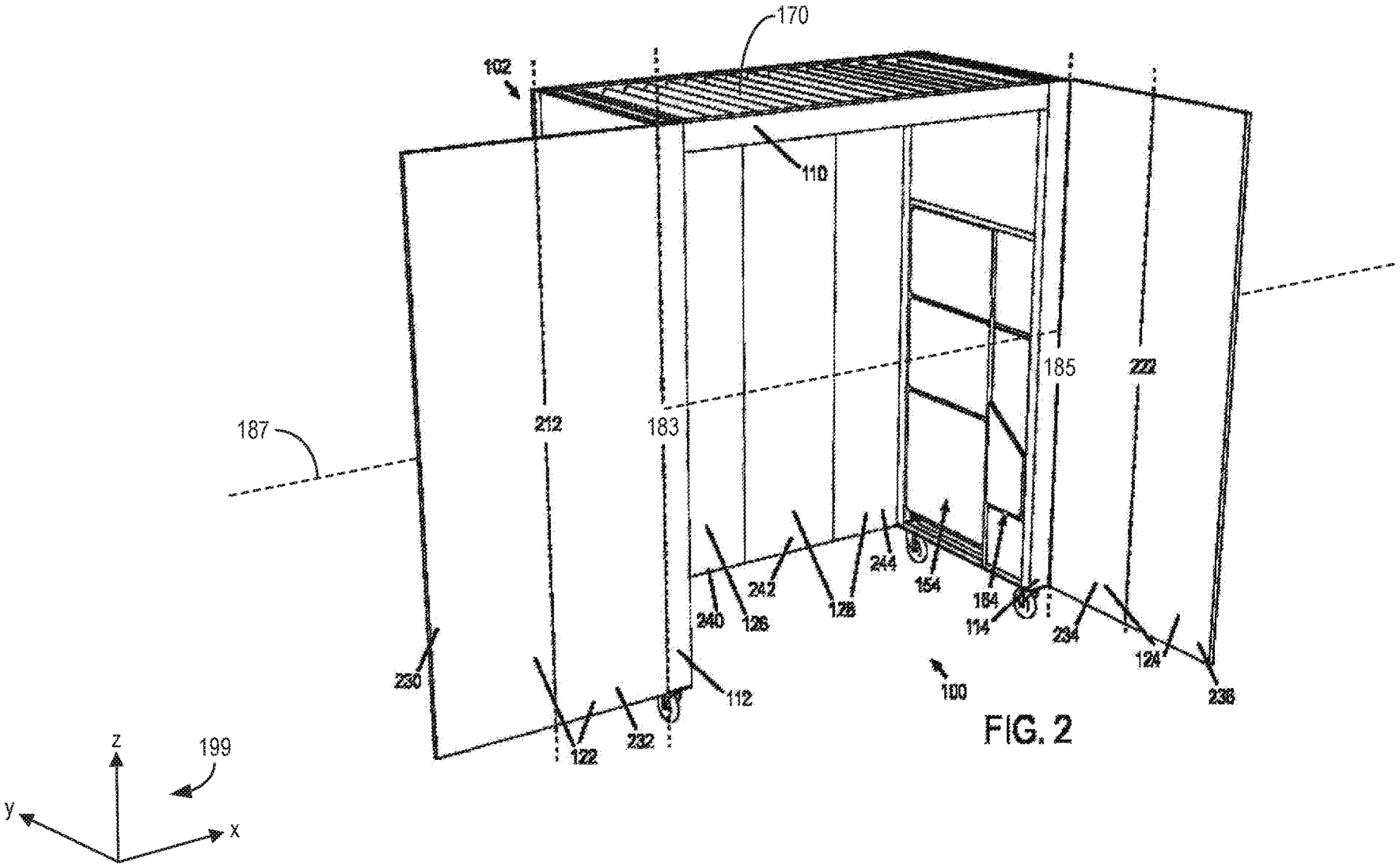
FIG. 2 shows the modular booth with the door assemblies shown in different extended positions, and with the seats and desks fully retracted.

A size of the workspace may be adjusted (e.g., increased) via a plurality of bi-fold doors that are mounted upon (e.g., coupled to) frame 102. Each of the bi-fold doors are coupled to the frame 102 by a respective hinge group. The bi-fold doors are shown in a retracted (e.g., stowed) position in FIG. 1. FIGS. 2, 3, and 4 each show the bi-fold doors in different positions relative to frame 102 (e.g., partially or fully extended, as described below).

A first door assembly 122 is coupled to an exterior surface 175 of the first wall 112 at the first side 105 of the modular booth 100 by a first hinge group, and a second door assembly 124 is coupled to an exterior surface 177 of the second wall 114 at the first side 105 of the modular booth 100 by a second hinge group. The first door assembly 122 may rotate (e.g., pivot) around a first rotational axis 183 positioned along the first hinge group, and the second door assembly 124 may rotate around a second rotational axis 185 positioned along the second hinge group. A horizontal axis 187 is illustrated by FIGS. 1-4 to be positioned perpendicular relative to the first rotational axis 183 and second rotational axis 185 and extending in a direction from the first wall 112 to the second wall 114 (e.g., in the direction of the x-axis of reference axes 199). The horizontal axis 187 is positioned to intersect both of the first rotational axis 183 and the second rotational axis 185. The horizontal axis 187 is included by FIGS. 1-4 as an additional reference axis such that the stowed position, fully extended position, and/or one or more partially extended positions of the various door assemblies (e.g., first door assembly 122, second door assembly 124, etc.) may be described relative to the position of the horizontal axis 187. First and second door assemblies 122 and 124 may each take the form of a bi-fold door assembly that includes two vertically hinged door panels described in further detail below with reference to FIG. 2. A third door assembly 126 is coupled to the exterior surface of the first wall 112 at the second side 107 of the modular booth 100 by a third hinge group, and a fourth door assembly 128 (not visible in FIG. 1) is coupled to the exterior surface of the second wall 114 at the second side 107 of the modular booth 100 by a fourth hinge group. The third door assembly 126 and fourth door assembly 128 may each rotate around corresponding rotational axes similar to those described above with reference to the first rotational axis 183 of first door assembly 122 and the second rotational axis 185 of the second door assembly 124 (e.g., with the rotational axis of the third door assembly 126 positioned along the third hinge group and the rotational axis of the fourth door assembly 128 positioned along the fourth hinge group). Third and fourth door assemblies 126 and 128 may be bi-fold door assemblies that each include two vertically hinged door panels depicted in further detail by FIG. 2. In other examples, each door assembly may include a single door panel or may include three or more door panels. In still other examples, each side of modular booth 100 (e.g., first side 105 and second side 107) may separately include only a single door assembly that spans from the first end 101 to the second end 103 (e.g., from first wall 112 to second wall 114).

In the example shown by FIG. 1, the first door assembly 122, second door assembly 124, third door assembly 126, and fourth door assembly 128 (which may each be referred to herein as doors) are each in a fully retracted (e.g., stowed) position relative to the walls of the modular booth 100 (e.g., first wall 112 and second wall 114). For example, the first door assembly 122 is stowed such that a width 171 of a first panel 232 of the first door assembly 122 (e.g., a panel coupled to the exterior surface 175 of the first wall 112 via the first hinge group) is positioned perpendicular to the horizontal axis 187 and extends along the exterior surface 175. The third door assembly 126 is similarly stowed against the first wall 112, and the second door assembly 124 and fourth door assembly 128 are similarly stowed against the second wall 114 (e.g., against the exterior surface 177 of the second wall 114, indicated in FIGS. 3-4).

Frame 102 may be supported upon a ground surface of the frame by a set of casters, such as casters 132, 134, 136, and 138. In this example, first wall 112 is coupled to casters 132 and 136 (e.g., with caster 132 positioned at the first side 105 and caster 136 positioned at the second side), and second wall 114 is coupled to casters 134 and 138 (e.g., with caster 134 positioned at the first side 105 and caster 138 positioned at the second side). A caster locking mechanism may be configured to restrict movement of one or more of the casters. For example, some or all of the casters may be lockable casters that may be selectively set (e.g., by a user) to a locked state or to a rolling state (e.g., via actuation of a lever coupled to the casters). In the rolling state, modular booth 100 may be moved by rolling the booth upon the casters. In the locked state, modular booth 100 may be prevented from rolling on the casters. Setting the casters to the locked state therefore retains a position of the modular booth 100 and may provide a more stable workspace for users of the modular booth 100. In other examples, casters may be omitted from the booth or other forms of wheeled or non-wheeled supports may be used in place of casters.

In some embodiments, the caster locking mechanism may include an automatic braking system configured to automatically (e.g., passively and without interaction from a user of the modular booth 100) lock a position of one or more of the casters (e.g., casters 132, 134, 136, and 138) during conditions in which the modular booth 100 is assembled (e.g., conditions in which the first wall 112 and second wall 114 are both coupled to the ceiling 110 in the configuration shown by FIG. 1) such that the locked casters do not rotate (e.g., roll) in response to a force applied to the booth (e.g., a pushing or pulling force against the frame 102 of the modular booth 100 from a user of the modular booth 100). In one example, the automatic braking system may include locking plates coupled to one or more of the casters. Each locking plate may be biased toward its respective caster by one or more biasing members (e.g., springs) and each locking plate may include a toothed surface shaped to engage with its respective caster (e.g., to increase an amount of friction between the locking plate and the caster) during conditions in which the automatic braking system is engaged. In some examples, the biasing members may be mechanical biasing members (e.g., springs). In other examples, the biasing members may be electromagnetic biasing members (e.g., solenoids).

The automatic braking system may normally be in an engaged condition such that the locking plates are pressed against their respective casters by the biasing members. A user of the modular booth 100 may temporarily disengage the automatic braking system via an actuator (e.g., a lever, switch, etc.) in order to move the modular booth 100 (e.g., rotate the booth, move the booth to a different location, etc.). In examples in which the biasing members are mechanical biasing members, the actuator may be a mechanical actuator configured to retract the biasing members in order to reduce an amount of force applied to the casters by the locking plates. In examples in which the biasing members are electromechanical biasing members, the actuator may be configured to reduce an amount of electrical energy provided to the biasing members in order to reduce the amount of force applied to the casters by the locking plates. Alternate embodiments may include various combinations of the actuators and biasing members as described above.

Modular booth 100 includes modular elements coupled to (or integrated with) first wall 112 and second wall 114. Modular elements coupled to first wall 112 are shown generally by indicator 142. In the example shown by FIG. 1, the modular elements of the first wall 112 include a first seat 152 and a first desk 162 that may be selectively stowed in a vertical configuration (e.g., in a retracted position) within first wall 112 or folded outward into an operational configuration (e.g., in an extended position, as shown by FIG. 1). Modular elements coupled to second wall 114 are shown generally by indicator 144. In the example shown by FIG. 1, the modular elements of the second wall 114 include a second seat 154 and a second desk 164 that may be selectively stowed in a vertical configuration (e.g., retracted position) within second wall 114 or folded outward into an operational configuration (e.g., extended position, as shown by FIG. 1). In alternate embodiments, the first wall 112 and second wall 114 may be coupled to different modular elements, such as those shown by FIG. 16 and described below. In other embodiments, the modular elements such as those described above (e.g., first desk 162 and/or first seat 152) may be removably coupled with their respective walls (e.g., first wall 112) such that the modular elements may be removed from the booth and/or exchanged for different modular elements (e.g., shelves, storage containers, etc.). In one example, the first desk 162 and first seat 152 may be removed from the first wall 112 of the modular booth 100 and replaced with different modular elements (such as those shown by FIG. 16 and described below) as desired by the user of the modular booth 100.

Ceiling 110 may include additional features depicted generally at 146. These features may include a set of louvers 170 (which may be referred to herein as slats). Louvers 170 may be configured to enable a portion of ambient light to enter the workspace via the ceiling 110 and/or may increase a flow of air to the modular booth 100. In some examples, the louvers 170 may increase an amount of acoustical damping of the modular booth 100. In some examples, each of the louvers 170 may have a same pitch and/or size as each other louver 170. In other examples, a relative pitch, size, and/or spacing of one or more of the louvers 170 may be different from other louvers 170. In yet other examples, a pitch and/or spacing of one or more of the louvers 170 may be adjustable via a mechanical or electrical actuator (e.g., a lever, an electric motor, etc.). In this way, the louvers 170 may adjust an amount of light, air, and/or sound entering the modular booth 100 from above ceiling 110. In other examples, louvers 170 may be omitted such that the ceiling 110 forms an opening that does not reduce the amount of light entering the modular booth 100, or ceiling 110 may be a solid panel that does not allow light into the modular booth 100. Additional features that are mounted upon and/or integrated with ceiling 110 will be described in further detail with reference to the subsequent figures, including FIG. 9.

FIG. 2 shows modular booth 100 with the door assemblies positioned to provide an alternate configuration of the workspace. In the configuration shown by FIG. 2, door assemblies 122 and 124 are positioned to provide access to the workspace of modular booth 100, while also extending outward from frame 102 to provide additional privacy and increase the amount of space of the workspace. Door assembly 122 includes door panels 230 and 232, and door assembly 124 includes door panels 234 and 236. In alternate embodiments, door assembly 122 and door assembly 124 may include a different number and/or relative arrangement of door panels.

Within FIG. 2, an axis of rotation of each door panel is depicted by a respective vertical axis that represents a hinged interface. For example, first door assembly 122 may rotate relative to first wall 112 about axis of rotation 183. The bi-fold door panels 230 and 232 of first door assembly 122 may rotate (e.g., vertically) relative to each other about axis of rotation 212. Similarly, second door assembly 124 may rotate relative to second wall 114 about axis of rotation 185. The bi-fold door panels 234 and 236 of second door assembly 124 may rotate relative to each other about axis of rotation 222. In some examples, door hinges may each provide a 180-degree range of motion, a 270-degree range of motion, greater than a 270-degree range of motion, or other suitable range about a respective vertical axis of rotation. As a non-limiting example, hinges located at a hinged interface between the door assemblies and the frame (e.g., at 183 or 185) may have a 270-degree range of motion, and hinges located at a hinged interface between door panels within a door assembly may have a 180-degree range of motion that enables rotation of an interior-facing side of the door panels of each door assembly to be rotated towards each other. In some examples, hinges may take the form of adjustable tension hinges that maintain the position of the door panels once set by the user. For example, the tension hinges may include a locking mechanism (e.g., a lever) that may be set by the user of the modular booth 100 in order to lock the door panels 230 and 232 at an angle relative to each other (e.g., 45 degrees, 90 degrees, 135 degrees, etc.). Other door panels (e.g., door panels 234 and 236 of second door assembly 124) may include a similar locking mechanism.

Door assemblies 126 and 128 may also rotate relative to their respective walls on an opposite side of frame 102 around respective axes of rotation (e.g., similar to door assemblies 122 and 124), and may include bi-fold door panels that rotate relative to each other about their respective vertical axes of rotation (e.g., similar to the axes 212 and 222). In the configuration shown by FIG. 2, door assemblies 126 and 128 are positioned to enclose the second side 107 of the modular booth 100. Door assembly 128 includes door panels 242 and 244, and door assembly 126 includes door panels 238 (not visible within FIG. 2) and 240. The configuration shown by FIG. 2 includes the second seat 154 and second desk 164 in a stowed configuration within second wall 114. First seat 152 and first desk 162 are likewise stowed within first wall 112.

In some examples, the door panels (e.g., door panels 234, 236, 238, etc.) and/or wall panels forming the first wall 112 and second wall 114 (as described below) may be formed entirely of a rigid material such as medium-density fiberboard (MDF). In other examples, a first portion of the door panels may be formed from a first material and a second portion of the door panels may be formed from a second material. In one example, the first portion may be formed from a non-transparent material, and the second portion may be formed from a material partially or fully transparent to light (e.g., frosted glass or clear glass) such that light from locations exterior to the modular booth 100 may pass through the second portion and into the workspace of the modular booth 100. The second portion may be an upper portion of the modular booth 100 (e.g., a portion positioned away from the ground on which the modular booth 100 sits). In the configuration described above, the first portion (e.g., portion formed of non-transparent material) may increase a privacy of the workspace and the second portion may increase an amount of light passing into the workspace. Additionally, in examples in which the second portion is formed of a partially transparent material such as frosted glass, the second portion may further increase the privacy of the workspace.

FIG. 3 depicts modular booth 100 of FIG. 1 with door assemblies positioned to provide yet another configuration of the booth. In this example, door assemblies 122 and 124 are positioned to expand the workspace of the modular booth 100 at the first side 105, and door assemblies 126 and 128 are similarly positioned to expand the workspace of the modular booth 100 at the second side 107. In this configuration, the door assemblies provide a semi-private workspace that provides additional workspace (e.g., interior space) within the booth. As one example, the first door assembly 122 is shown in a partially extended position such that the first door panel 232 is rotated away from the exterior surface 175 of the first wall 112 by an angle 371. In some examples, the angle 371 may be a number of degrees greater than 0 and less than 270. As described above, a locking mechanism coupled to the first door assembly 122 may be set (e.g., locked) by the user of the modular booth 100 in order to lock the first door panel 232 at the angle 371. In other examples, the first door panel 232 may be locked at a different angle (e.g., a desired angle between 0 degrees and 270 degrees relative to the exterior surface 175).

FIG. 4 depicts modular booth 100 of FIG. 1 with door assemblies positioned to provide yet another configuration of the modular booth 100. In this example, each of the door assemblies (e.g., door assemblies 122, 124, 126, and 128) are in a fully extended position, thereby fully enclosing the workspace. In this configuration, the door assemblies increase a privacy of the workspace. For example, the first door assembly 122 is fully extended such that the width 171 of the first panel 232 of the first door assembly 122 (e.g., the panel coupled to the exterior surface 175 of the first wall 112 via the first hinge group) is positioned parallel to the horizontal axis 187 and between the first wall 112 and the second wall 114 (e.g., in a direction from the first wall 112 to the second wall 114). The third door assembly 126 is similarly fully extended in the direction from the first wall 112 to the second wall 114 (e.g., across the second side 107 of the modular booth 100), and the second door assembly 124 and fourth door assembly 128 are each similarly fully extended in a direction from the second wall 114 to the first wall 112 (e.g., across the first side 105 and second side 107, respectively, of the modular booth 100).

In some examples, one or more of the door assemblies of the modular booth 100 (e.g., the first door assembly 122, second door assembly 124, third door assembly 126, and fourth door assembly 128) may be configured to be rolled onto walls of the modular booth 100 (e.g., first wall 112 and/or second wall 114) via corresponding rollers for storage and may be unrolled from the rollers to be utilized by a user of the modular booth 100. For example, one or more of the door assemblies may be formed of a flexible material (e.g., fabric) and/or a flexible shape (e.g., vertical slats) such that a curvature of the one or more door assemblies may be adjusted by the user of the modular booth 100 in order to adjust a shape of the workspace formed by the modular booth 100. In this way, the one or more door assemblies of the modular booth 100 may be retracted into (or extended from) the corresponding coupled rollers in order to adjust the size and/or shape of the workspace, to couple multiple modular booths to each other (as described below with reference to FIGS. 17-22), etc.

FIG. 5A shows modular booth 100 of FIG. 1 in a partially disassembled state. Specifically, FIG. 5A shows the first wall 112 decoupled from the ceiling 110. First wall 112 is shown with the first door assembly 122 and third door assembly 126 removed in order to illustrate structural members of the first wall 112. For example, first wall 112 includes first structural member 510 and second structural member 512 that are joined by caster plate 514 and by wall panel 516. In some examples, wall panels (e.g., wall panel 516) and the various door panels may be formed from MDF or other suitable materials, optionally with a polymer-based outer surface coating (e.g., HDPE, UHMW, or other suitable polymer or non-polymer material) to provide a branded or decorative appearance. Door panels and/or wall panels may utilize a torsion box-like construction method in at least some examples. Although first wall 112 is described herein as a representative example, second wall 114 includes components similar to those included by first wall 112 (e.g., a wall panel, structural members, caster plate, etc.).

First structural member 510 and second structural member 512 are shown as tubular members. Each of the structural members are shaped to couple with corner gussets, such as first corner gusset 520 and second corner gusset 522. Specifically, first structural member 510 couples with a first end of first corner gusset 520, and second structural member 512 couples with a first end of second corner gusset 522. Ceiling 110 includes first side bar 530 and second side bar 532. First side bar 530 and second side bar 532 are shaped tubular members shaped to couple with the corner gussets. Specifically, first side bar 530 couples with the first corner gusset 520 and second side bar 532 couples with the second corner gusset 522. The first side bar 530 and second side bar 532 may be formed from metal, plastic, or other suitable material. A first plurality of fasteners 534 may couple first structural member 510 to first side bar 530 via first corner gusset 520. Similarly, a second plurality of fasteners 535 may couple second structural member 512 to second side bar 532 via corner gusset 522. Structural members of second wall 114 (e.g., third structural member 511 and fourth structural member 513) may be secured to the side bars of the ceiling 110 (e.g., first side bar 530 and second side bar 532, respectively) in a similar way as described above with reference to the structural members of first wall 112 and as described below with reference to FIG. 5B.

The first side bar 530 of the ceiling 110 is coupled to the second side bar 532 via a first cross bar 550 and a second cross bar 551. The first cross bar 550 and second cross bar 551 each extend in a direction perpendicular to the first side bar 530 and second side bar 532 (e.g., in a direction from the first side 105 of the modular booth 100 to the second side 107 during conditions in which modular booth 100 is assembled, as shown by FIG. 1 for example) between the first side bar 530 and second side bar 532. In some examples, the first cross bar 550 and second cross bar 551 may be coupled to the first side bar 530 and second side bar 532 via a plurality of fasteners. In other examples, the first cross bar 550, second cross bar 551, first side bar 530, and second side bar 532 may be formed together as one piece (e.g., molded together) or fused together (e.g., welded).

As described above, the frame 102 of modular booth 100 includes the first wall 112, second wall 114, and ceiling 110. During conditions in which the first wall 112 and second wall 114 are each coupled to the ceiling 110 (e.g., during conditions in which the modular booth 100 is assembled), the first wall 112 and second wall 114 do not pivot relative to the ceiling 110. In alternate embodiments, the first wall 112 and the second wall 114 may instead be coupled to the ceiling via a plurality of lockable hinges that enable the first wall 112 and second wall 114 to pivot (e.g., fold) relative to the ceiling 110. In this way, the modular booth 100 may be folded in order to reduce a size of the modular booth 100 (e.g., for transporting, shipping, and/or storing the booth) without decoupling the ceiling 110 from the first wall 112 or second wall 114.

FIG. 5B shows a second view of the modular booth 100 in a partially disassembled state similar to that shown by FIG. 5A. FIG. 5B does not show some components of the first wall 112, second wall 114, and ceiling 110 (e.g., first wall panel 518, slats 170, etc.) for illustrative purposes. As described above, first structural member 510 may couple with a first end of first corner gusset 520 and second structural member 512 may couple with a first end of second corner gusset 522 (with an example insertion direction 591 of the second corner gusset 522 into the second side bar 532 shown in the enlarged view of inset 590). Similarly, third structural member 511 may be coupled to the first end of a third corner gusset 562 via a third plurality of fasteners 560, and fourth structural member 513 of the second wall 114 may be coupled to a first end of a fourth corner gusset 564 via a fourth plurality of fasteners 561. A second end of the third corner gusset 562 may be coupled to the third structural member 511 and a second end of the fourth corner gusset 564 may be coupled to the fourth structural member 513.

FIG. 6 depicts modular booth 100 of FIGS. 1-4 and FIGS. 5A-5B in a disassembled state (e.g., flat packed) for shipment and/or storage. In the example shown by FIG. 6, the first door assembly 122 and third door assembly 126 are in the fully retracted position relative to the exterior surface 175 of the first wall 112 (e.g., as described above with reference to FIG. 1), and the second door assembly 124 and fourth door assembly 128 are in the fully retracted position relative to the exterior surface 177 of the second wall 114.

In one example, ceiling 110 is decoupled from both of the first wall 112 and the second wall 114 via removal of fasteners (e.g., the first plurality of fasteners 534, second plurality of fasteners 535, third plurality of fasteners 560, and fourth plurality of fasteners 561) from the corner gussets (e.g., first corner gusset 520, second corner gusset 522, third corner gusset 562, and fourth corner gusset 564, respectively). The ceiling 110 is positioned parallel to both of the first wall 112 and the second wall 114 and between the first wall 112 and the second wall 114 such that a length 573 (shown by FIG. 5A) of the first side bar 530 is parallel to a height 575 of the first wall 112 (e.g., a length of the first wall 112 in a direction from the ground on which the first wall 112 sits via casters 132 and 136 to a top surface 577 of the first wall 112 during conditions in which the modular booth 100 is assembled).

In another example, instead of decoupling the first wall 112 and second wall 114 via removal of the fasteners from the corner gussets as described above, the first wall 112 and second wall 114 may instead be folded (e.g., pivoted) against the ceiling 110 via one or more locking hinge assemblies coupling the first wall 112 and the second wall 114 to the ceiling 110. For example, the first wall 112 may be coupled to the ceiling 110 via a first locking hinge assembly and the second wall 114 may be coupled to the ceiling 110 via a second locking hinge assembly. The first locking hinge assembly and the second locking hinge assembly may each be configured to lock a position of the first wall 112 and the second wall 114 (respectively) relative to the ceiling 110 during conditions in which the modular booth 100 is assembled.

In order to pivot the first wall 112 and the second wall 114 relative to the ceiling 110 to switch the modular booth 100 from the assembled state to a disassembled state (e.g., a state similar to that shown by FIG. 6 in which the first wall 112, second wall 114, and ceiling 110 are each parallel to each other), a user of the modular booth 100 may move the first locking hinge assembly and the second locking hinge assembly from the locked position (e.g., the position in which the first wall 112 and second wall 114 do not pivot relative to the ceiling 110) to an unlocked position. In the unlocked position, the first wall 112 and second wall 114 may pivot around the first locking hinge assembly and second locking hinge assembly (respectively) to a configuration in which the first wall 112 and second wall 114 are positioned parallel to the ceiling 110 for compact storage and/or shipping of the modular booth 100. In other examples, the first wall 112 and the second wall 114 may be coupled to the ceiling 110 via a combination of corner gussets, fasteners, and locking hinge assemblies similar to the examples described above.

In some examples, the first wall 112, second wall 114, and ceiling 110 may be coupled together for shipping and/or storage via one or more binding materials (e.g., plastic wrap, metal bands, etc., as shown by first wrap 600 and second wrap 602) positioned to surround an exterior perimeter of the modular booth 100 in the disassembled state (e.g., extending along the perimeter in directions perpendicular to the length 573 and height 575) and to prevent the first wall 112, second wall 114, and ceiling 110 from moving relative to each other (e.g., sliding, rotating, etc. relative to each other). In other examples, the modular booth 100 may include a locking latch system configured to retain a position of the first wall 112, second wall 114, and ceiling 110 relative to each other (e.g., lock the first wall 112, second wall 114, and ceiling 110 together) during conditions in which the modular booth 100 is disassembled (e.g., as shown by FIG. 6). As a non-limiting example, the booth in the disassembled state may fit within a volume measuring approximately 20 inches by 36 inches by 88 inches. As another non-limiting example, two modular booths in the disassembled state may be shipped per 48 inch by 48 inch pallet.

FIGS. 7A-7E show various views of an example desk (e.g., second desk 164) of the modular booth 100, and FIGS. 8A-8E show various views of an example seat (e.g., second seat 154) of the modular booth 100. The desks and seats of the modular booth 100 may be moved from extended positions to stowed positions as described below with reference to FIGS. 7A-8E in order to reduce an amount of space occupied by the modular booth 100. In particular, stowing the desks, seats, and/or other modular elements of the modular booth 100 reduces a size of the modular booth 100 during conditions in which the first wall 112 and second wall 114 are decoupled from the ceiling 110 (or folded against the ceiling as described above) for storage and/or transportation of the modular booth 100 (as shown by FIG. 6 and described above). In this way, a configuration (e.g., relative positioning) of the seats and desks coupled to the first wall 112 and/or second wall 114 may be retained during conditions in which the modular booth 100 is disassembled and/or moved. Although the modular booth 100 is shown to include the first seat 152 coupled to the first wall 112 adjacent to the first desk 162 and the second seat 154 coupled to the second wall 114 adjacent to the second desk 164, in other examples the modular booth 100 may not include the first desk 162 and/or the second desk 164. In one example, the modular booth 100 may include the first seat 152 and may not include the first desk 162. In such an example, a width of the first seat 152 may be increased relative to the examples described herein (e.g., relative to the examples shown by FIGS. 8A-8E) such that the width of the first seat 152 extends along the first wall 112 and into the space normally occupied by the first desk 162. The first seat 152 extended with the increased width as described above may be referred to as a full bench seat or a bench. Although the first seat 152 is described herein as an example, a width of the second seat 154 may be similarly extended in examples in which the second desk 164 is omitted from the modular booth 100.

Figure 7A:
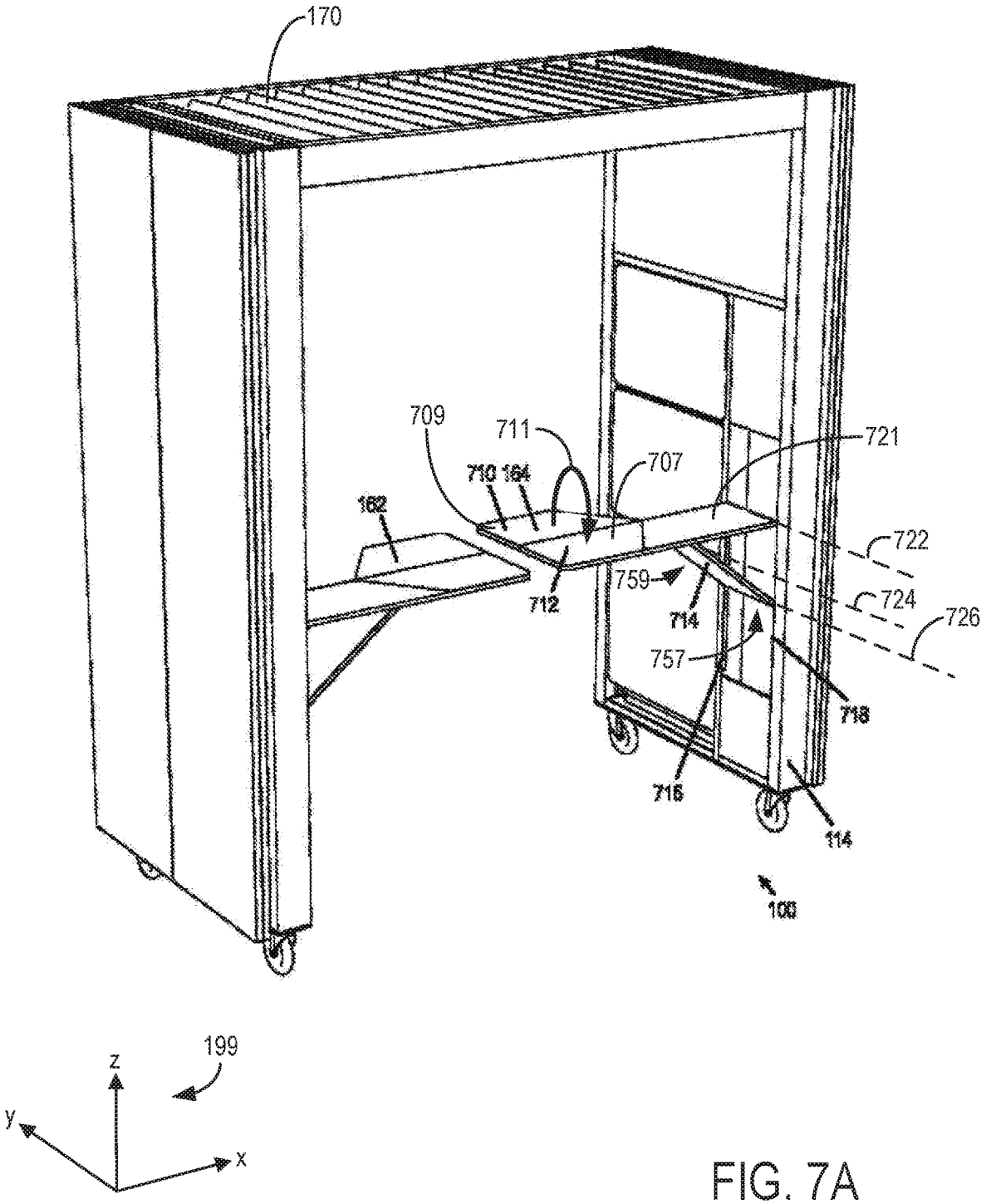
FIGS. 7A-7E each show an example desk of the modular booth, with FIGS. 7A-7B showing example positions of the desk relative to the modular booth, FIG. 7C showing a clamping bracket coupled to the desk, and FIGS. 7D-7E showing different views of the desk removed from the modular booth.

FIG. 7A shows the modular booth 100 with first desk 162 (coupled to first wall 112) and second desk 164 (coupled to second wall 114) folded outward for use. In this example, first desk 162 and second desk 164 are positioned at a different elevation (e.g., distance) relative to the ground surface as compared to the configuration of the first desk 162 and second desk 164 shown by FIG. 1. First seat 152 and second seat 154 are shown stowed within their respective walls (e.g., in a retracted position relative to first wall 112 and second wall 114, respectively). In one example, the configuration of the desks and seats described above and shown by FIG. 7A may be utilized by users in a standing position rather than a seated position.

As shown by FIG. 7A, second desk 164 includes a first portion 710, a second portion 712, and a third portion 721. The first portion 710 and second portion 712 are coupled (e.g., pivotally joined) to each other by an example hinge assembly 720 (shown in an exploded view by FIG. 7E), and the second portion 712 and third portion 721 are fixedly coupled to each other (e.g., not pivotable relative to each other). In other examples, the first portion 710 and the second portion 712 may be coupled together via a different type of hinge assembly than the hinge assembly 720 shown by FIG. 7E (e.g., a hinge assembly including one or more continuous hinges, a hinge assembly including one or more strap hinges, etc.). In one example, the second portion 712 and third portion 721 may be glued together or otherwise formed together as a single piece. The second portion 712 has a reduced thickness relative to a thickness of the third portion 721 and forms a recessed surface of the second desk 164 shaped to receive the first portion 710 during conditions in which the first portion 710 is rotated onto the second portion 712 (as described below).

The first portion 710 may be rotated relative to the second portion 712 in order to adjust a width of the second desk 164. For example, during conditions in which the second desk 164 is in the extended position shown by FIG. 7A and a first surface 709 of the first portion 710 is not in face-sharing contact with a first surface 707 of the second portion 712, the first portion 710 may be rotated in a first direction 711 in order to place the first surface 709 of the first portion 710 into face-sharing contact with the first surface 707 of the second portion 712 and decrease the width of the second desk 164 (e.g., reduce a working surface of the second desk 164). In this configuration (e.g., with the first surface 709 of the first portion 710 rotated onto the first surface 707 of the second portion 712), the reduced width of the second desk 164 may be utilized by a user of the modular booth 100, or the second desk 164 may be folded (e.g., retracted) into the second wall 114 for storage (e.g., by rotating the second desk 164 in a direction opposite to the direction 730 shown by FIG. 7B). As another example, during conditions in which the second desk 164 is in the extended position and the first surface 709 of the first portion 710 is in face-sharing contact with the first surface 707 of the second portion 712, the first portion 710 may be rotated in a second direction opposite to the first direction 711 in order to increase the width of the second desk 164 (e.g., increase the working surface of the second desk 164).

Figure 7B:
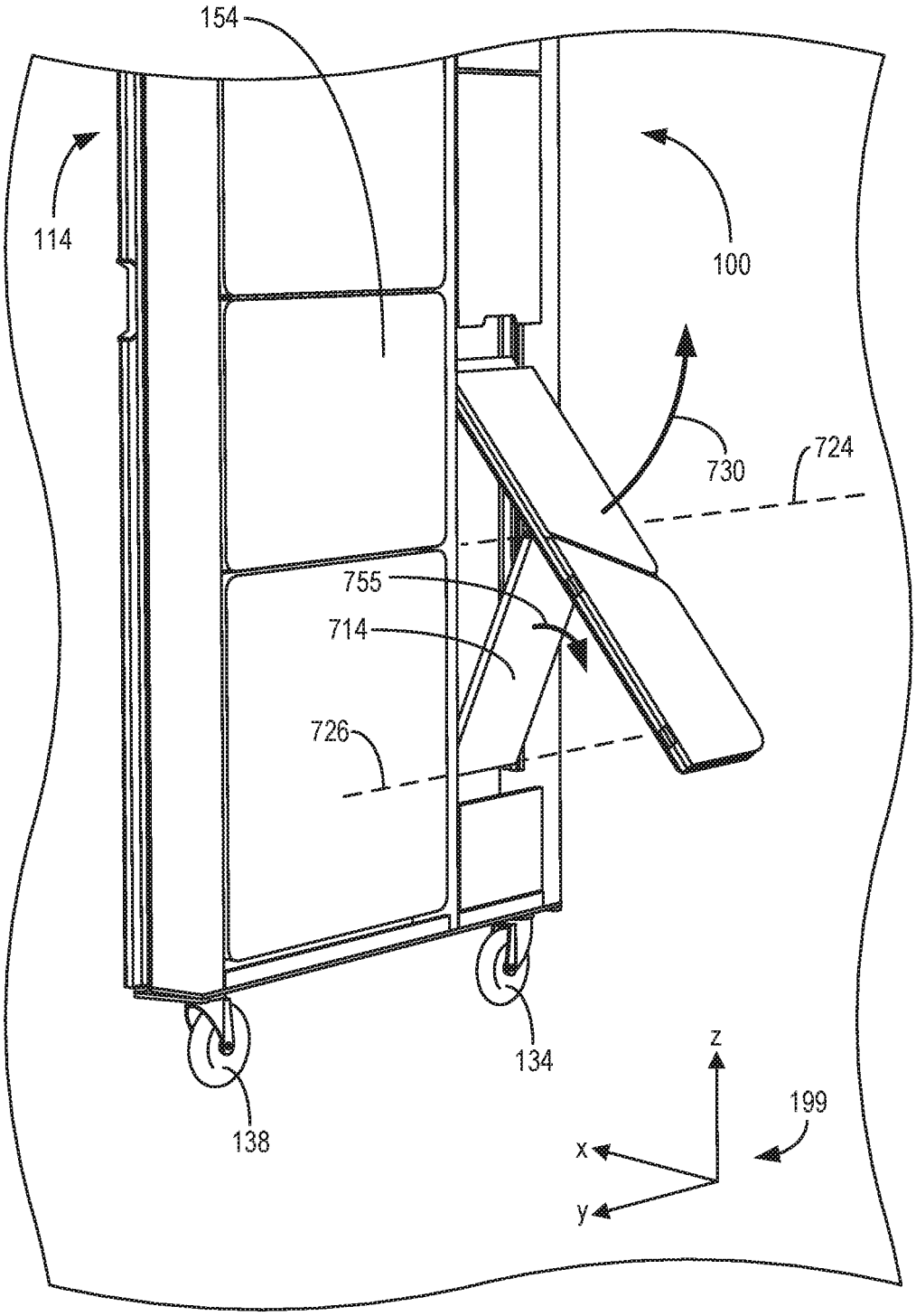

Second portion 712 may be rotated about a horizontal axis indicated at 722. Second desk 164 additionally includes a support arm 714. A first end 759 of the support arm 714 is coupled to an underside of third portion 721 via a hinge assembly. A second end 757 of the support arm 714 is coupled to first track 716 and second track 718, with the first track 716 and second track 718 each being coupled to or integrated with second wall 114. As an example, support arm 714 may include pins or sliders that travel within and/or rotate relative to races or channels of first track 716 and second track 718. Support arm 714 may be rotated around a first horizontal axis 724 and around a second horizontal axis 726 to enable second desk 164 to be reconfigured between the stowed position (e.g., retracted position) shown by FIG. 2 and the unfolded position (e.g., extended position) shown by FIG. 7A. For example, during conditions in which the second desk 164 is rotated away from the stowed position and away from the second wall 114 (e.g., in the direction 730 shown by FIG. 7B), the first end 759 of the support arm 714 may pivot outward (e.g., away from the second wall 114) in a direction 755 as shown by FIG. 7B around the second horizontal axis 726 and the second end 757 may retain its position within the first track 716 and second track 718. As the first end 759 pivots outward, an angle of the support arm 714 relative to the first portion 710, second portion 712, and third portion 721 increases.

The third portion 721 is pivotally coupled with the first track 716 and the second track 718. As an example, third portion 721 may include pins 765 (e.g., sliders) positioned at opposite sides of the third portion 721 configured to travel within and/or rotate relative to races or channels of first track 716 and second track 718. During conditions in which the second desk 164 is rotated away from the stowed position and away from the second wall 114 as described above, the third portion 721 may slide along the first track 716 and the second track 718 in a direction toward the ground on which the modular booth 100 sits. Additionally, during conditions in which the second desk 164 is in the extended position, the support arm 714 and third portion 721 may translate (e.g., be moved) together upwards or downwards along first track 716 and second track 718 in order to enable adjustment of the elevation of second desk 164 (e.g., the distance of the second desk 164 from the ground surface on which modular booth 100 sits). In one example, during conditions in which the first portion 710, second portion 712, and third portion 721 of the second desk 164 are deployed to a horizontal position (e.g., an extended position in which the first portion 710, second portion 712, and third portion 721 are approximately parallel to each other as shown by FIG. 7A), a catch pin may be engaged to lock the desk into position. To stow or otherwise move the second desk 164, the user may depress a lever located under the desk or other suitable location to release the catch pin. A second spring-loaded lever may enable a user to control the elevation of the desk in its deployed state. The second desk 164 may include gas shocks coupled to a rear side of the second desk 164 or other suitable location that may aid the user to move the desk upwards or downwards with a decreased amount of effort (e.g., force).

In some examples, the second desk 164 may be additionally coupled to a third track and a fourth track (e.g., similar to the first track 716 and second track 718). The second desk 164 may include a first plurality sliding components (e.g., pins, sliders, etc.) that may slide along the first track 716 and second track 718 to enable the second desk 164 to pivot outward from the second wall 114 (e.g., similar to the example shown by FIG. 7B). The second desk 164 may additionally include a second plurality of sliding components configured to slide along the third track and fourth track to enable a user to adjust a vertical position (e.g., an elevation) of the second desk 164. In one example, the third track and/or fourth track may additionally include a cam biased against the second plurality of sliding components by a biasing member (e.g., a spring). The cam may press against the second plurality of sliding components (e.g., via a biasing force from the biasing member) in order to retain a position of the second plurality of sliding components relative to the third track and fourth track. A user of the modular booth 100 may press and/or pull against the cam in order to reduce a force applied to the second plurality of sliding components by the cam and to enable the vertical position of the second desk 164 to be adjusted.

First desk 162 and first wall 112 may include similar components and features as those previously described with reference to second desk 164 and second wall 114. In alternate embodiments, the modular booth 100 may include only one of the first desk 162 or second desk 164, or may not include either of the first desk 162 or second desk 164 (e.g., in embodiments that include different modular elements in the locations of the first desk 162 and second desk 164).

FIG. 7B shows a partial view of the modular booth 100 with the second desk 164 in a position between the fully retracted position (e.g., the position shown by FIG. 2) and the fully extended position (e.g., the position shown by FIG. 1). The example position shown by FIG. 7B illustrates relative pivot directions of the components of the second desk 164 as the second desk 164 is moved from the fully retracted position to the fully extended position.

Figure 7C:
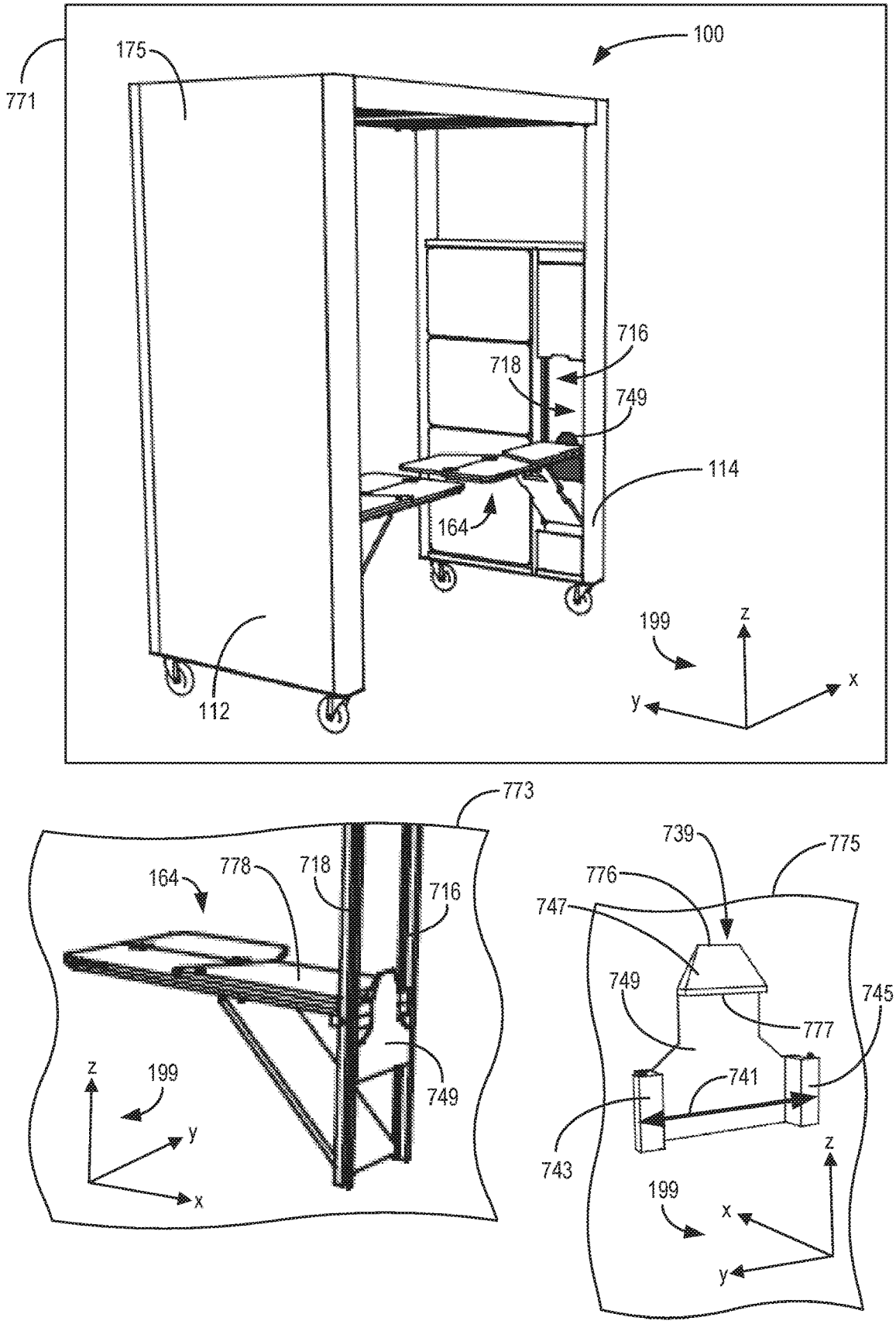

FIG. 7C shows various views of a clamping bracket 749 coupled to the first track 716 and second track 718. In some examples, the clamping bracket 749 may be utilized to lock the second desk 164 into the extended position as described below (e.g., the position shown by first inset 771). The clamping bracket 749 includes a first arm 743 shaped to couple with the first track 716 and a second arm 745 shaped to couple with the second track 718 (as shown by second inset 773 and third inset 775), with the first arm 743 and second arm 745 positioned opposite to each other along a length 741 of the clamping bracket 749. The door assemblies (e.g., first door assembly 122, second door assembly 124, etc.) are not shown by FIG. 7C for illustrative purposes.

The clamping bracket 749 includes a spring arm 747 positioned at a top end 739 of the clamping bracket 749 (e.g., an end of the clamping bracket 749 positioned in a direction perpendicular to the length 741). The spring arm 747 may be formed of a flexible material and may be biased in a direction away from the second wall 114 and toward the first wall 112 (e.g., in a direction of the workspace of the modular booth 100). As the second desk 164 is moved (e.g., pivoted) from the stowed position toward the extended position, the third portion 721 of the second desk 164 may press against the spring arm 747 and slide along the spring arm 747 to push the spring arm 747 in a direction away from the first wall 112 (e.g., a direction opposite to the direction in which the spring arm 747 is biased). In some examples such as that shown by FIG. 7C, the spring arm 747 may be tapered such that a thickness of the spring arm 747 at a first edge 776 positioned at the top end 739 is less than a thickness of the spring arm 747 at a second edge 777 (with the second edge 777 positioned opposite to the first edge 776). At the moment the second desk 164 pivots fully into the extended position, the second edge 777 of the spring arm 747 may hook onto an outer surface 778 of the third portion 721 in order to lock the second desk 164 into the fully extended position (e.g., to prevent the second desk 164 from pivoting toward the stowed position). During conditions in which a user of the second desk 164 desires to move the second desk 164 back to the stowed position, the user may press against the spring arm 747 in the direction opposite to the biased direction of the spring arm 747 described above in order to unhook the second edge 777 from the outer surface 778 of the third portion 721 and enable the second desk 164 to pivot toward the stowed position (e.g., toward the second wall 114). Although clamping bracket 749 is described above with reference to the second desk 164, first desk 162 may include a similar clamping bracket and may be adjusted in a similar way.

Figure 7D:
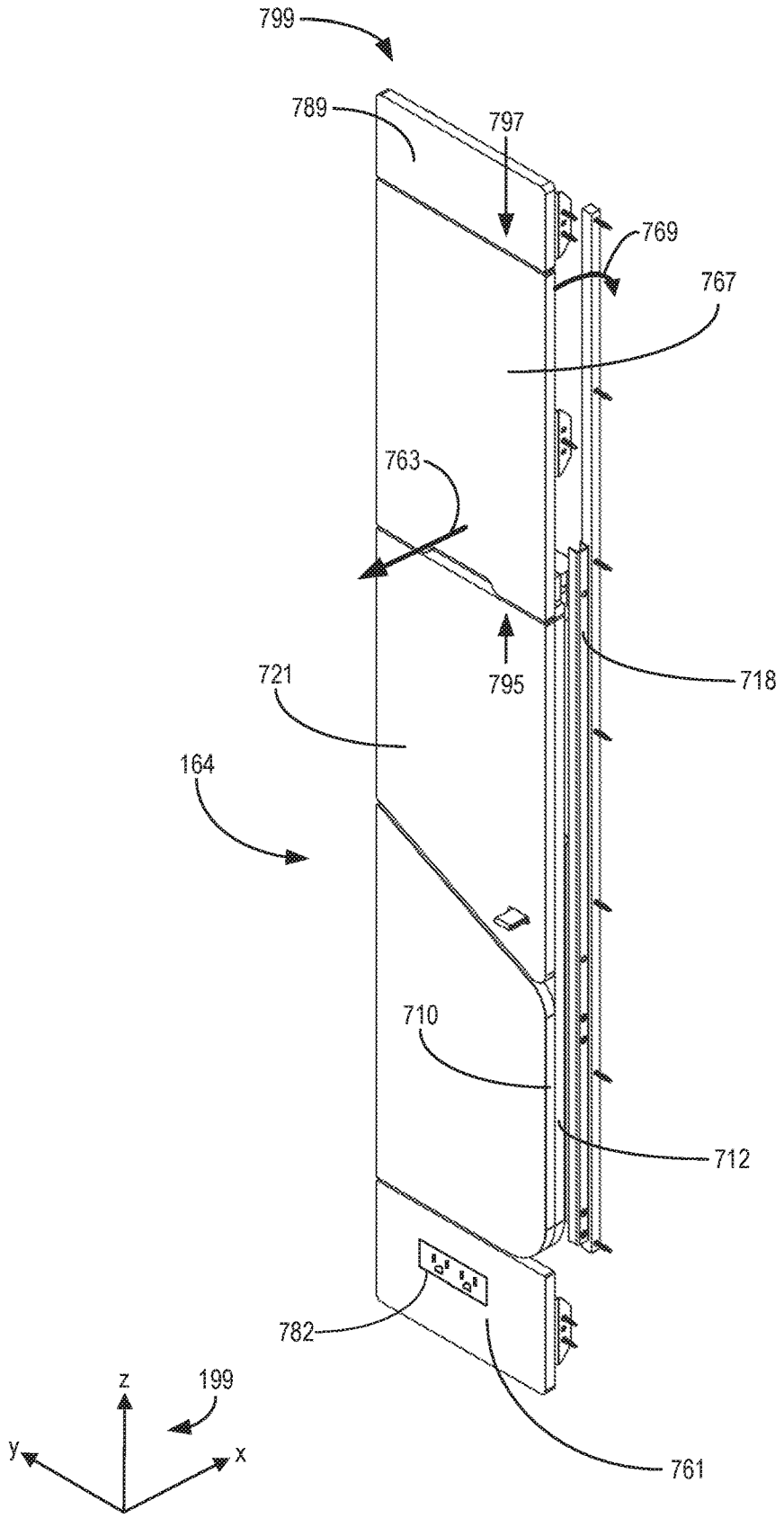
Figure 7E:
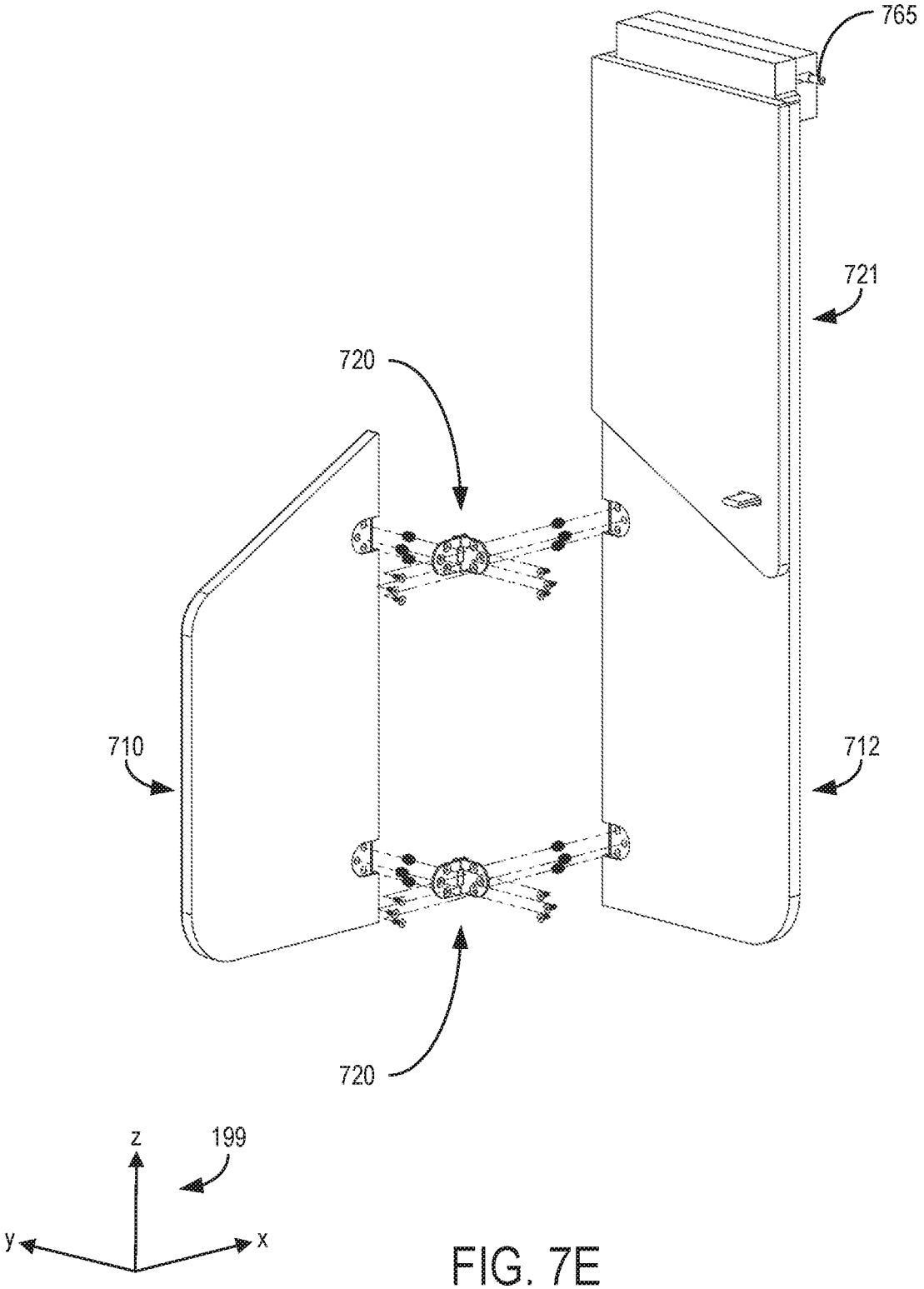

FIG. 7D shows a view of the second desk 164 removed from the second wall 114 and in a folded position. The second desk 164 is positioned in the stowed position as described above with reference to FIGS. 7A-7B. Other components (e.g., second wall 114, ceiling 110, etc.) of the modular booth 100 are not shown by FIG. 7D for illustrative purposes. In this view, the second desk 164 is shown as part of an assembly 799 (e.g., a modular element) configured to couple to the second wall 114. The assembly 799 includes a light panel 767 and a power panel 761, with the light panel 767 positioned vertically above the second desk 164 within the assembly 799 (e.g., relative to the ground on which the modular booth 100 sits) and the power panel 761 positioned vertically below the second desk 164. The power panel 761 may be configured to include a plurality of power outlets 782, and the power outlets 782 may receive electrical power from an electrical power bus similar to that described below with reference to FIG. 10. In one example, the light panel 767 may be pivotally coupled with the assembly 799 such that a user of the modular booth 100 may apply a pulling force against a groove positioned at a first end 795 of the light panel 767 in a direction 763 (e.g., away from the second wall 114) in order to pivot a second end 797 of the light panel 767 in a direction 769 (e.g., toward from the second wall 114).

Pivoting the second end 797 of the light panel 767 in the direction 769 may actuate an actuator of a lighting device (e.g., LED light assembly) positioned between a top panel 789 and the second wall 114 in order to adjust the lighting device from an OFF mode (e.g., a mode in which the lighting device is not powered and does not produce light) to an ON mode (e.g., a mode in which the lighting device is powered by an electrical power bus such as that described below with reference to FIG. 10, with the lighting device producing visible light). Pivoting the light panel 767 in the opposite direction (e.g., opposite to direction 769) may adjust the lighting device from the ON mode to the OFF mode. The top panel 789 is positioned vertically above the light panel 767.

During conditions in which the lighting device is in the ON mode, light produced by the lighting device may pass through an opening (e.g., gap) formed between the second end 797 of the light panel 767 and the top panel 789 positioned vertically above the light panel 767 within the assembly 799 in order to illuminate the workspace of the modular booth 100. In one example, the light passing through the opening from the lighting device of the light panel 767 may be directed in a direction toward a working surface of the second desk 164 (e.g., first surface 709 of the first portion 710 and/or first surface 707 of the second portion 712) during conditions in which the second desk 164 is fully extended from the second wall 114 (e.g., the position shown by FIG. 7A).

Figure 8A:
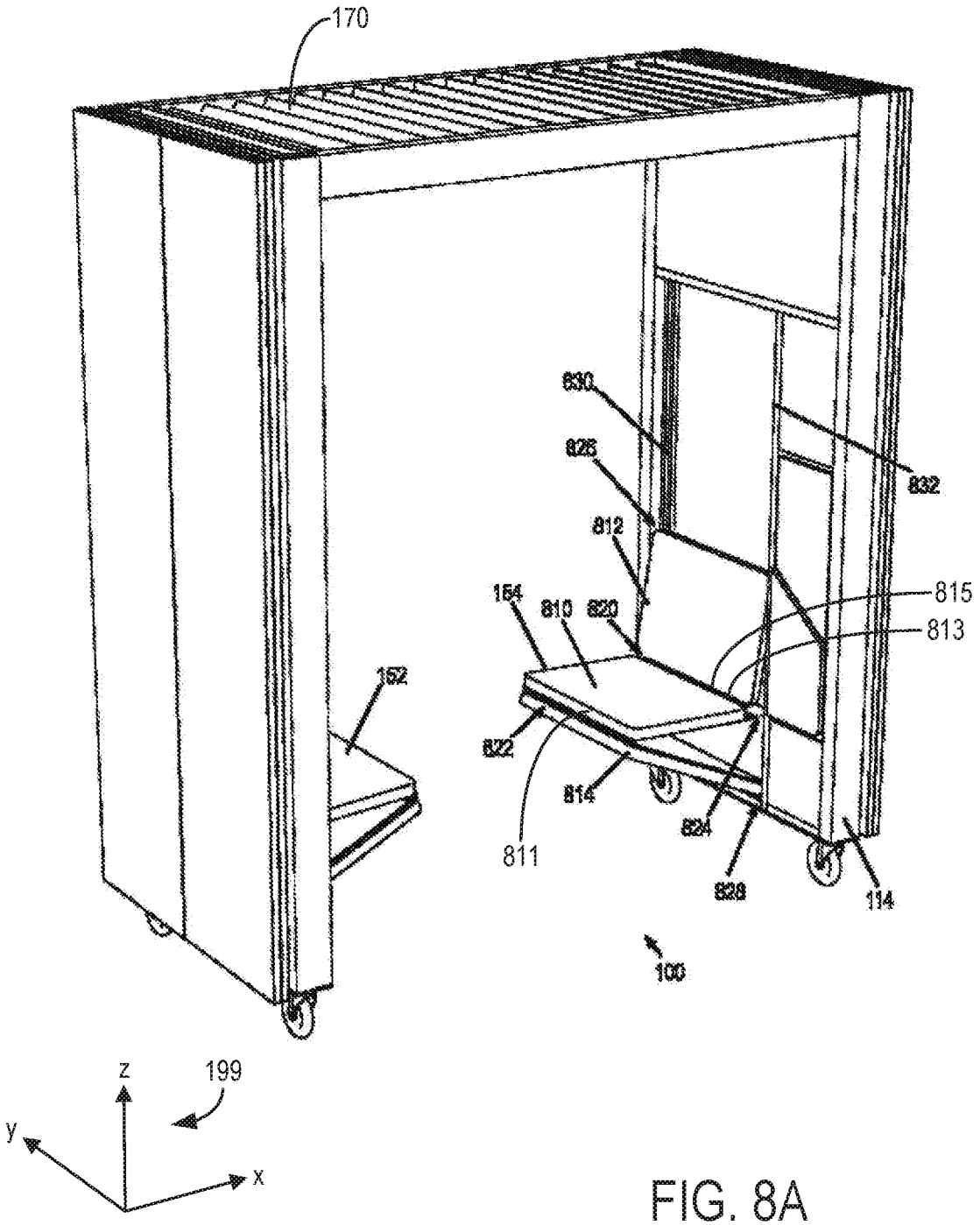
FIGS. 8A-8E each show an example seat of the modular booth, with FIGS. 8A-8B showing example positions of the seat relative to the modular booth, and with FIGS. 8C-8E showing different views of the seat removed from the modular booth.

FIG. 8A depicts the modular booth 100 with first seat 152 and second seat 154 folded outward (e.g., extended) for use by one or more users. Second seat 154 includes a seat portion 810, a backrest portion 812, and a support arm 814. A front edge 811 of seat portion 810 joins with support arm 814 via a first hinge assembly 822 such that the seat portion 810 may pivot relative to the support arm 814. A rear edge 813 of the seat portion 810 joins with a lower edge 815 of backrest portion 812 via a second hinge assembly 820 such that the seat portion 810 may pivot relative to the backrest portion 812. Second seat 154 is coupled (e.g., joined) to second wall 114 via tracks 830 and 832 at locations 824, 826, and 828 to enable each of the various components of second seat 154 (e.g., seat portion 810, backrest portion 812, and support arm 814) to rotate and/or translate between the stowed position (e.g., retracted position) shown by FIG. 7A and the unfolded position (e.g., extended position) shown by FIG. 8A. As an example, second seat 154 may include pins and/or sliders that travel within and/or rotate relative to a race or channel of tracks 830 and 832 at each of locations 824, 826, and 828. The second seat 154 may additionally include gas shocks (e.g., gas struts, gas pistons, etc.) coupled to a rear side 852 of the second seat 154 (opposite to a front side 850 shown by FIGS. 8C-8D) or other suitable location that aid the user to move the seat upwards or downwards.

Figure 8B:
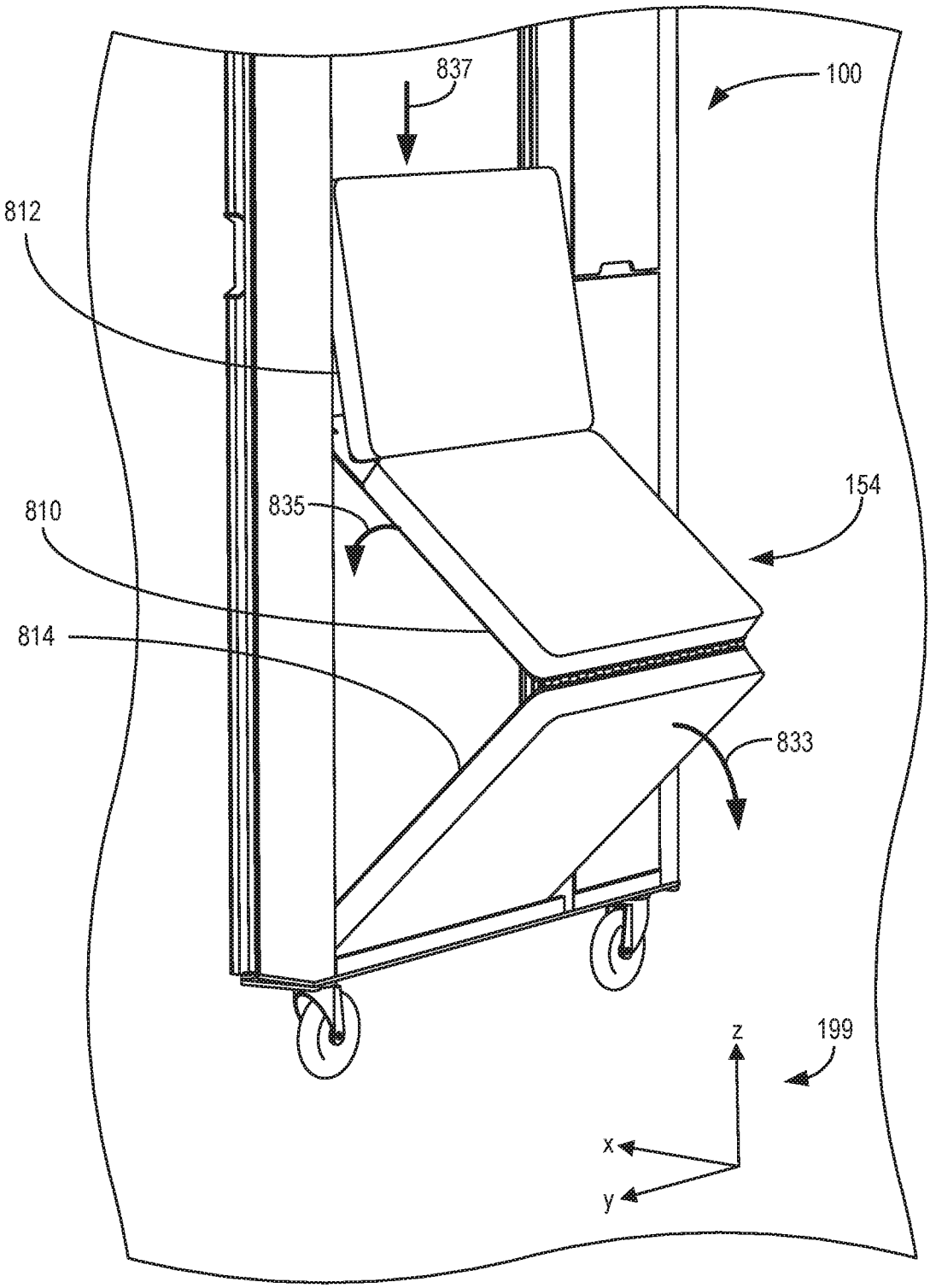
Figure 8C:
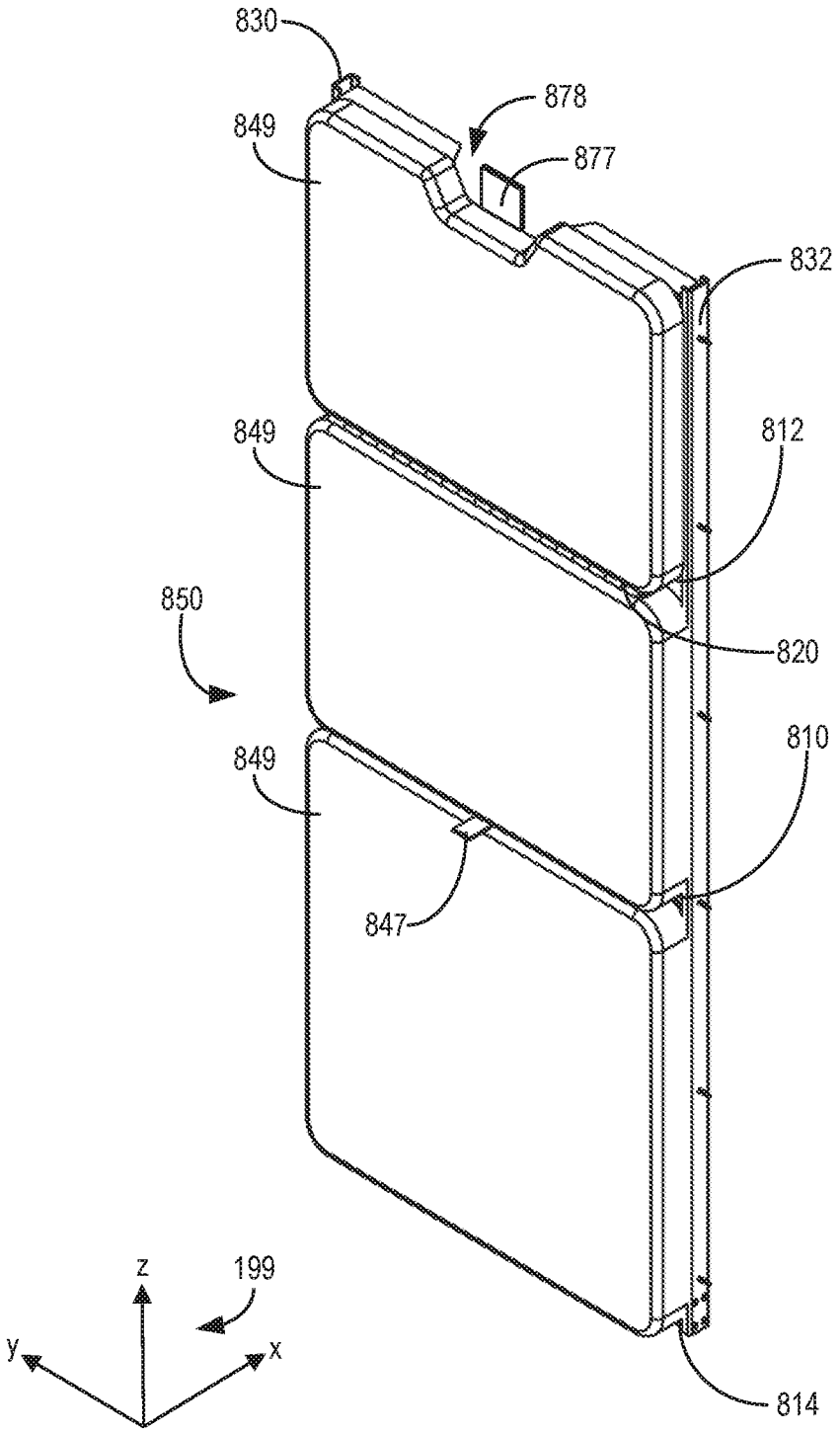

FIG. 8B shows the second seat 154 in a position between a stowed position (e.g., a retracted position in which the second seat 154 is stowed within the second wall 114, as shown by FIG. 2) and an extended position (e.g., a position in which the second seat 154 is folded outward from the second wall 114 and may be utilized as a seating device by a user of the modular booth 100).

In one example, a user of the modular booth 100 may move the second seat 154 from the stowed position to the extended position by applying a pulling force to a tab 847 (shown by FIG. 8C) positioned between the support arm 814 and the seat portion 810. The tab 847 may be coupled to the support arm 814 via one or more fasteners such that pulling the tab 847 during conditions in which the second seat 154 is in the stowed position pivots the support arm 814 in a first direction 833. Because the support arm 814 and the seat portion 810 are pivotally coupled to each other by the first hinge assembly 822, pivoting the support arm 814 in the first direction 833 results in the seat portion 810 being pivoted in a second direction 835. Additionally, because the seat portion 810 is pivotally coupled to the backrest portion 812 via the second hinge assembly 820, pivoting the seat portion 810 in the second direction 835 results in the backrest portion 812 being moved in a third direction 837.

For example, as the tab 847 is pulled by the user, pins and/or sliders coupled to the seat portion 810 and the backrest portion 812 enable the seat portion 810 and the backrest portion 812 to slide vertically downward relative to the second wall 114 (e.g., with the pins and/or sliders sliding within the tracks 830 and 832). In this way, the second seat 154 may be moved from the stowed position and into the extended position (e.g., the position shown by FIG. 8A). In order to move the second seat 154 from the extended position toward the stowed position, the user of the booth may apply a pulling force to a tab 877 positioned at a top end 878 of the backrest portion 812 to move the second seat 154 into a position between the extended position and the stowed position (e.g., the position shown by FIG. 8B). The user may then apply a pushing force to the support arm 814 at the tab 847 to pivot and slide the support arm 814, seat portion 810, and backrest portion 812 back towards the second wall 114 and into the stowed position. In some examples the tab 847 and tab 877 may each be formed of a flexible material (e.g., fabric, rubber, etc.).

Figure 8D:
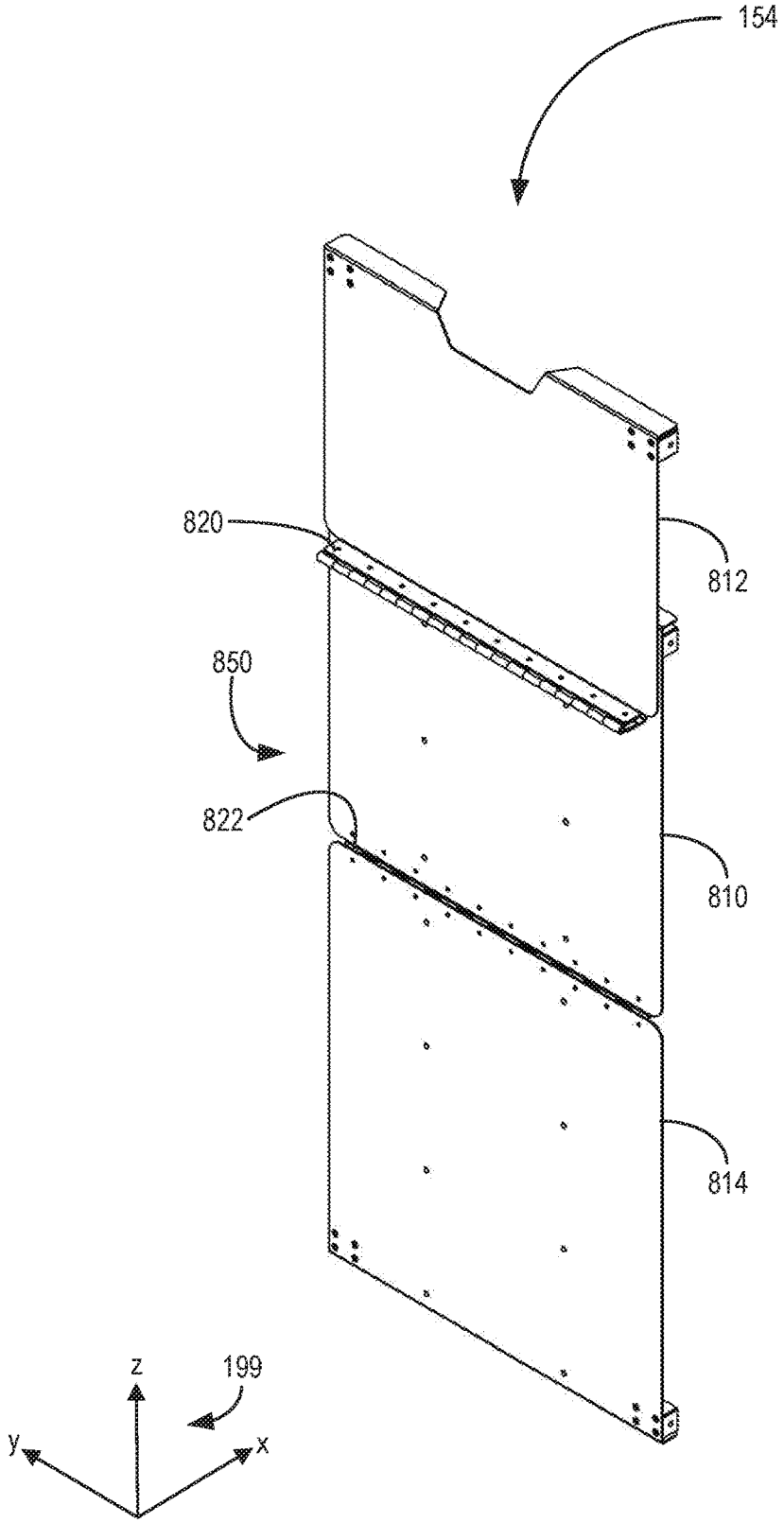
Figure 8E:
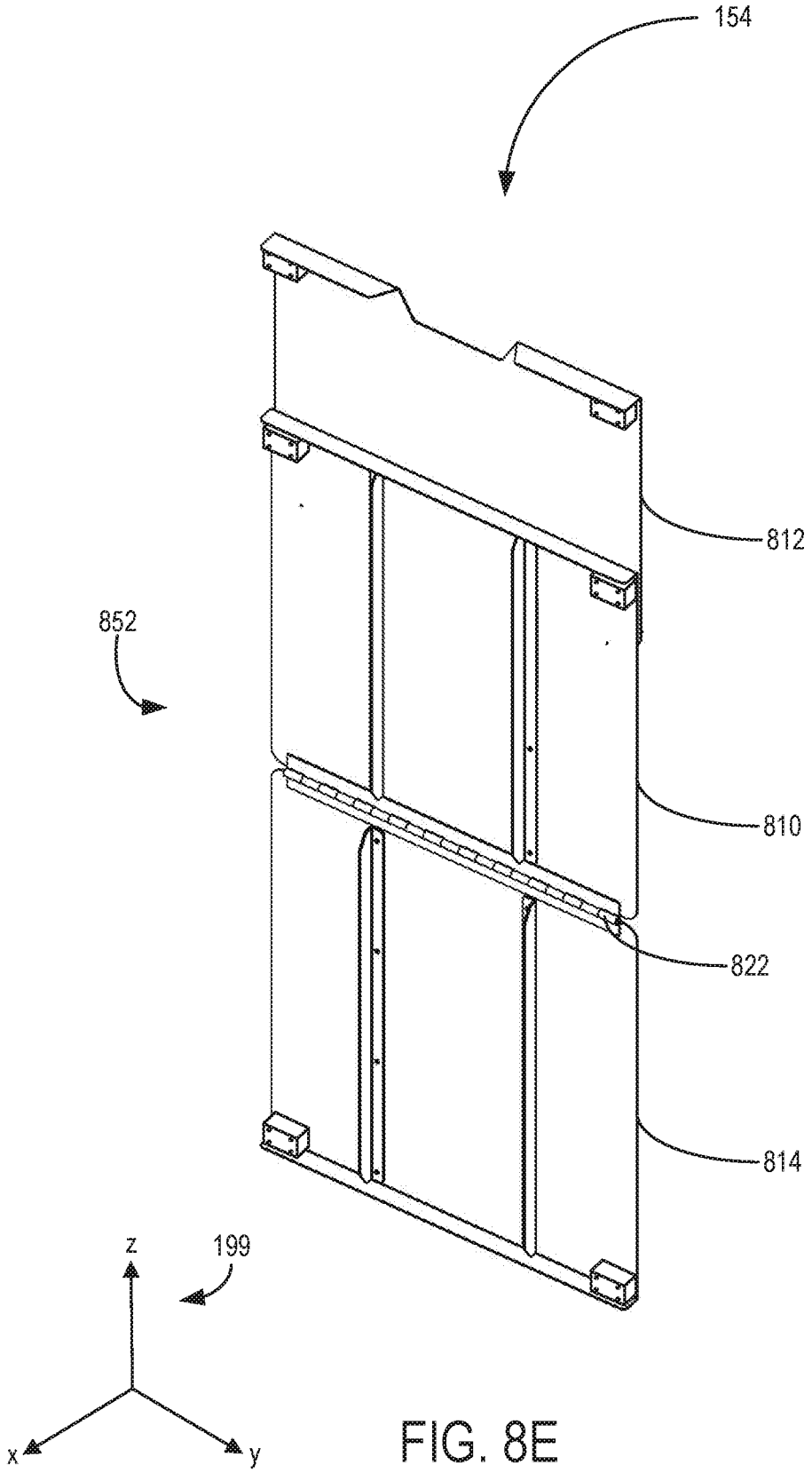
Figure 9:
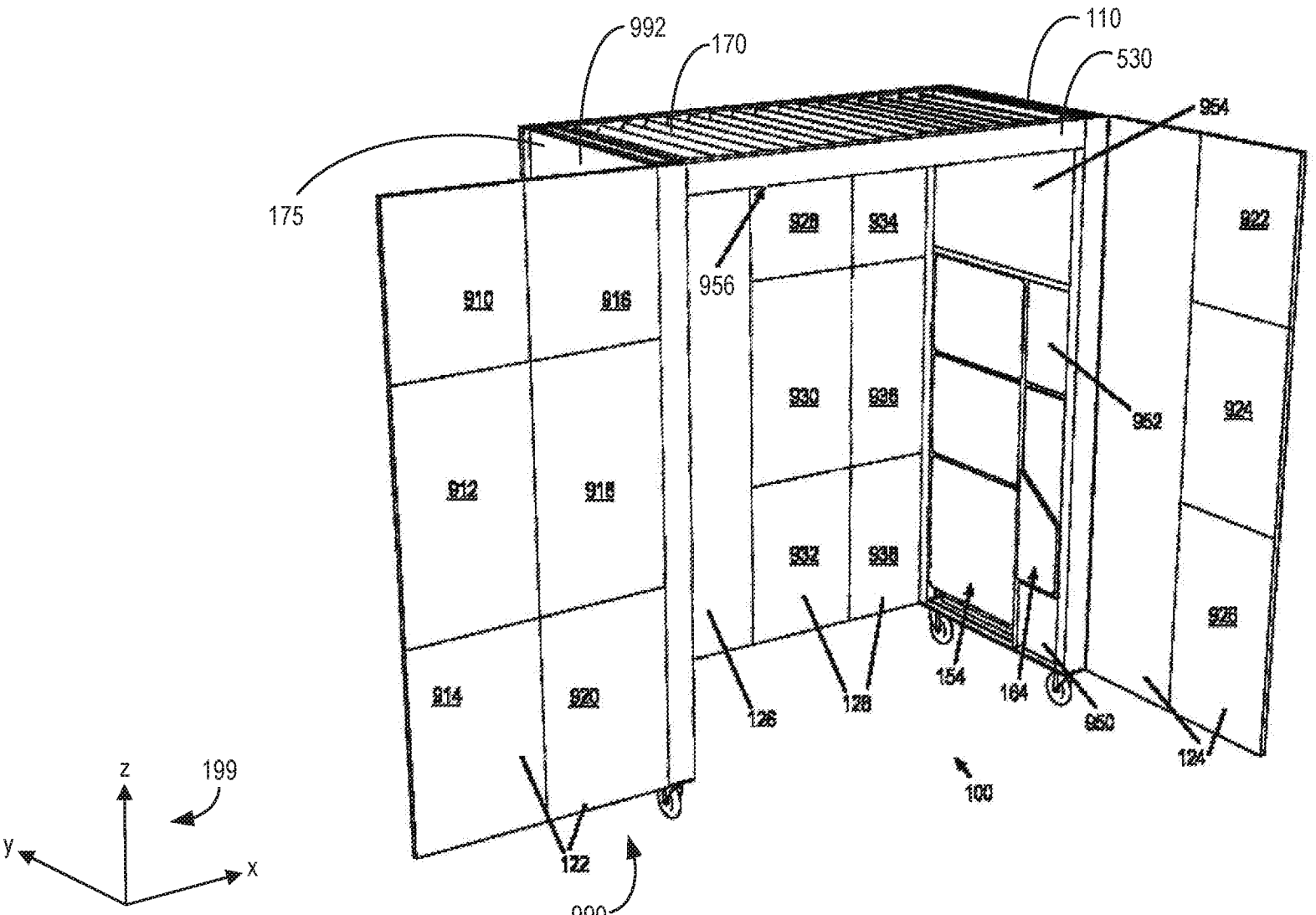
FIG. 9 shows a view of the modular booth illustrating example locations at which auxiliary panels may be coupled to the door assemblies.

Second seat 154 may include a plurality of cushions 849 (shown by FIG. 8C) coupled to one or both of the seat portion 810, backrest portion 812, and/or support arm 814. In one example, the cushions 849 may be removable from the second seat 154 for washing and/or replacement. FIG. 8D shows a front view of the second seat 154 removed from the second wall 114 and with the cushions 849 removed, and FIG. 8E shows a back view of the second seat 154 removed from the second wall 114 and with the cushions 849 removed. Although second seat 154 and second wall 114 are described above with reference to FIGS. 8A-8E, first seat 152 and first wall 112 may include similar components and features as those previously described with reference to second seat 154 and second wall 114.

FIG. 9 shows an example configuration of the modular booth 100 in which the modular booth 100 includes a plurality of auxiliary panels coupled to the door assemblies (e.g., first door assembly 122, second door assembly 124, third door assembly 126, and fourth door assembly 128). For example, first door assembly 122 may include auxiliary panels at locations 910, 912, 914, 916, 918, and 920, second door assembly 124 may include auxiliary panels at locations 922, 924, and 926, fourth door assembly 128 may include auxiliary panels at locations 928, 930, 932, 934, 936, and, and third door assembly 126 may include auxiliary panels in a similar way (e.g., similar to first door assembly 122, second door assembly 124, and/or fourth door assembly 128). Non-limiting examples of auxiliary panels include dry erase boards, acoustical (e.g., sound) damping panels, decorative panels, coat hooks, and/or electronic display devices (e.g., graphical display screens). In one example, the auxiliary panels may be mounted (e.g., coupled) to an inner facing side 990 of the door panels (e.g., door panels 230 and 232 of first door assembly 122), for example, via rare earth magnets embedded within the door panels or other suitable fastener that enables removal and reconfiguration of the panels by users. The auxiliary panels may include one or more magnetic surfaces that may be coupled to the door panels via interaction with a magnetic field produced by the rare earth magnets. In other examples, the auxiliary panels may be coupled to the door panels via fasteners such as clips, hooks, adhesive materials, etc. In some examples, the auxiliary panels may be coupled to an outer facing side of the door panels opposite to the inner facing side 990 (e.g., a side nearest a user of the modular booth 100 during conditions in which the user is positioned within the workspace of the modular booth 100 enclosed by the first wall 112, second wall 114, and ceiling 110). In yet other examples, one or more auxiliary panels may be coupled to the outer facing side of the door panels and one or more auxiliary panels may be coupled to the inner facing side 990 of the door panels.

Modular booth 100 may also include electronic components positioned at various locations within the modular booth 100 (e.g., such as locations 950, 952, 954, and 956). In one example, the electronic components may include one or more of a video conferencing system, graphical display device, touch-screen interface, microphone, speaker, camera, electrical charging station, retractable power cord, communications port, lighting, computer consoles, refrigerators, occupancy sensor and/or occupancy indicator light, electric fans, thermostats, etc. For example, lighting (e.g., LED lights, florescent tubing, etc.) may be mounted (e.g., coupled) on an underside of ceiling 110 at location 956. A graphical display device (e.g., electronic computer monitor) may be positioned at location 954 and may be powered by a retractable power cord positioned at location 950. In another example, one or more electronic speakers may be coupled to exterior surfaces of the modular booth 100. For example, one or more electronic speakers may be coupled to the exterior surface 175 of the first wall 112 (e.g., at location 992) and/or to the exterior surface 177 of the second wall 114. In some examples, the electronic speakers may be configured to produce white noise (e.g., a random acoustical signal having equal intensity at different frequencies) in order to conceal (e.g., obfuscate) noises produced by users positioned within the workspace of the modular booth 100 (e.g., voices, conversations, etc.) as perceived by persons positioned outside of the workspace of the modular booth 100. In other examples, the electronic speakers may be positioned at a different location of the modular booth 100 (e.g., on exterior surfaces of one or more of the door assemblies) and/or may be configured to produce different types of acoustical signals (e.g., music, recorded messages, noise cancellation waveforms, etc.).

As another example of electronic components that may be coupled with the modular booth 100, the modular booth 100 may include an occupancy sensor configured to detect (e.g., sense) an occupant (e.g., user) within the workspace of the modular booth 100. The occupancy sensor may transmit a signal (e.g., electrical signal) to an indicator light to adjust the indicator light between an "occupied" state and a "non-occupied" state. In one example, the indicator light may be an LED device configured to emit a first color of light (e.g., red) in the occupied state (e.g., during conditions in which the occupancy sensor detects an occupant within the workspace), and the indicator light may emit a second color of light (e.g., green) in the non-occupied state (e.g., during conditions in which the occupancy sensor does not detect an occupant within the workspace). In another example, the indicator light may emit light in one of the occupied or non-occupied states and may not emit light in the other of the states. In some examples, the indicator light may be positioned along an exterior surface of the modular booth 100 such that the indicator light is visible to persons positioned outside the workspace of the modular booth 100. The various electronic components described above may be features integrated with or mounted upon (e.g., coupled to) first wall 112, second wall 114, and/or ceiling 110 as previously described with indicators 142, 144, and 146.

Figure 10:
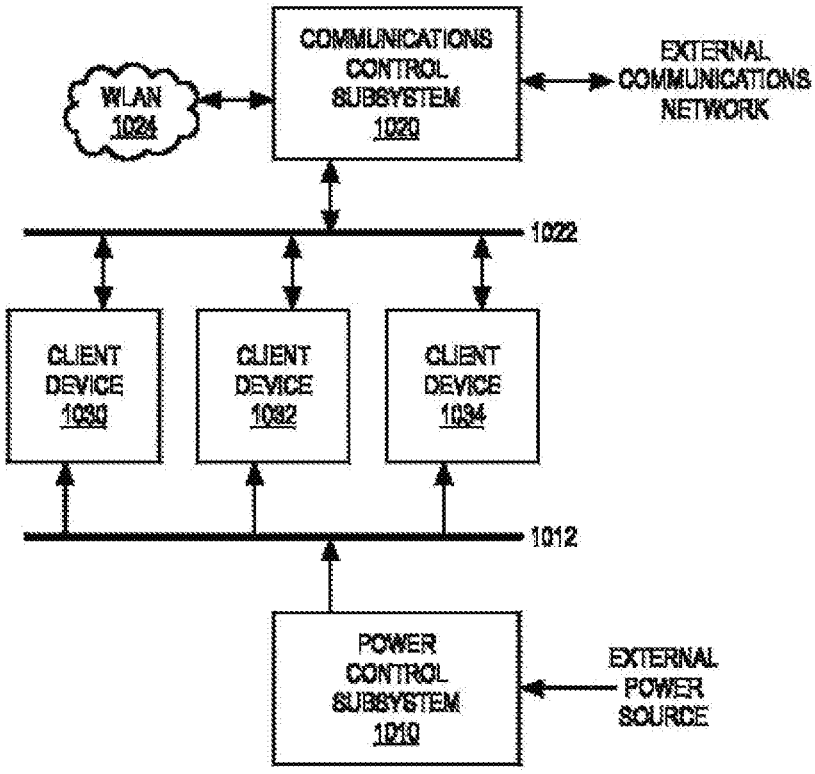
FIG. 10 schematically illustrates a control system that may be integrated with the modular booth and located on-board the modular booth.

FIG. 10 depicts an example electronic system that may be integrated with and located on-board a modular booth (e.g., modular booth 100 described above with reference to FIGS. 1-9). In this example, electrical power supplied to the booth may be received, processed, and distributed by a power control system 1010. In one example, the electrical power may be supplied to the modular booth 100 via a power source external to the modular booth 100 (e.g., a 112 volt wall socket). In other examples, the electrical power may be supplied to the modular booth 100 via a power source positioned on-board the modular booth 100 (e.g., a battery). The electrical power may be consumed by client devices, such as example client devices 1030, 1032, 1034, etc. The client devices may refer to any electrical load integrated with or located on-board the booth, such as the example electronic components at locations 950, 952, 954, 956 described above with reference to FIG. 9. Additionally, the client devices may refer to personal electronic devices that are carried into or nearby the booth by users. In some examples, electrical power may be distributed to client devices via an electrical power bus 1012. Electrical power bus 1012 may include hardwiring located throughout the walls and/or ceiling of the booth and electrical outlets or ports for distributing the electrical power. In some examples, power control system 1010 may be omitted (e.g., in embodiments which do not include electronic components such as those described above at locations 950, 952, 954, 956, and/or client devices 1030, 1032, 1034, etc.).

In some examples, the booth may interface with an external communications network. For example, the booth may include a communications control system 1020 that receives, processes, and distributes electronic communications between or among the various client devices, the external communications network, and/or a wireless local area network (WLAN) 1024. In some examples, communications control system 1020 may provide a wireless local area network by which the client devices may obtain wireless connectivity to the external communications network and/or establish a local network among local client devices. As an example, communications control system 1020 may include a wireless router and/or modem. In some examples, electronic communications may be distributed between or among client devices via a communications bus 1022. Communications bus 1022 may include hardwiring located throughout the walls (e.g., first wall 112 and/or second wall 114) and/or ceiling (e.g., ceiling 110) of the booth and communication outlets or ports for establishing a hardwired connection to a client device. In other examples, communications control system 1020 may be omitted.

Figure 11:
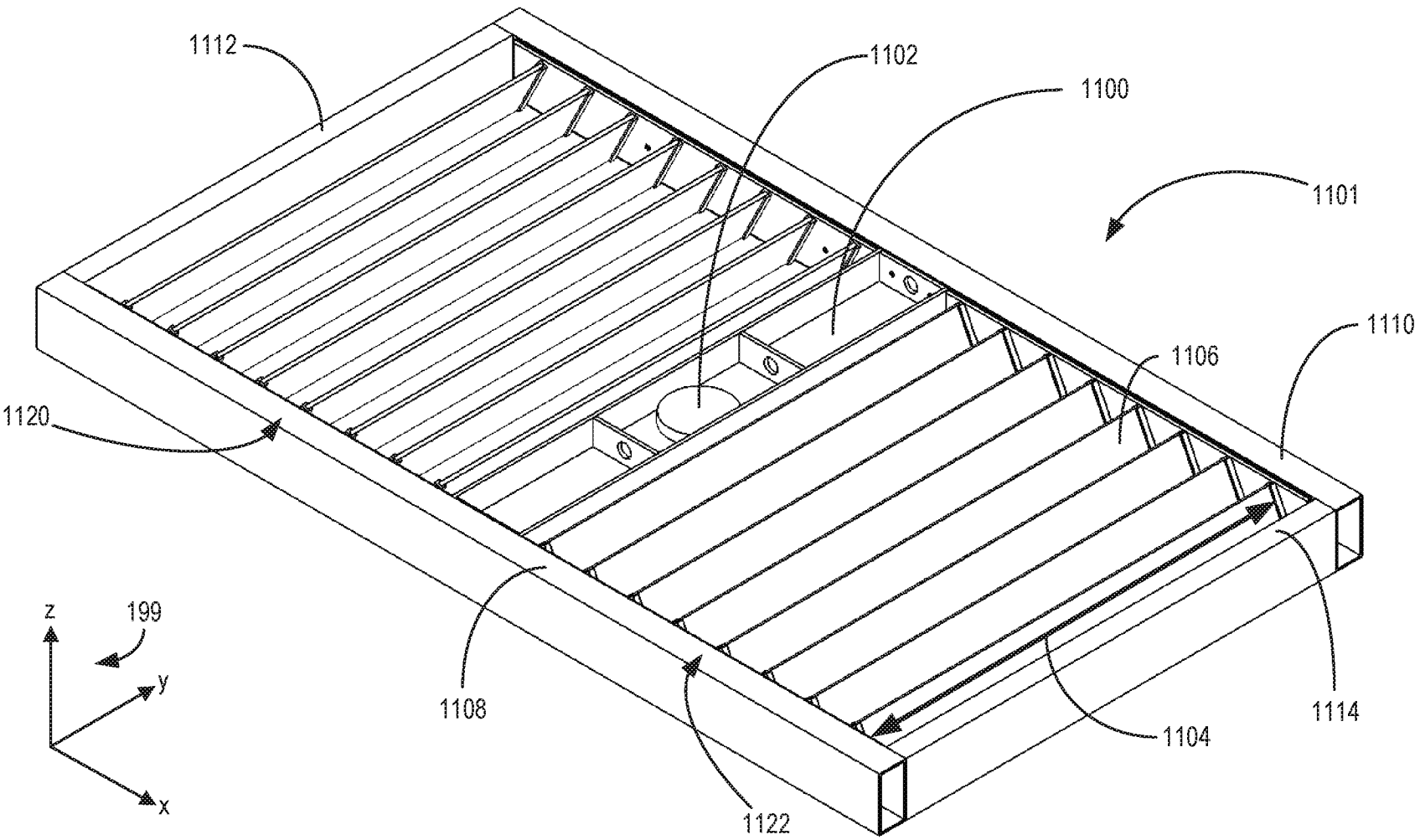
FIG. 11 shows a perspective view of a ceiling of the modular booth.
Figure 12:
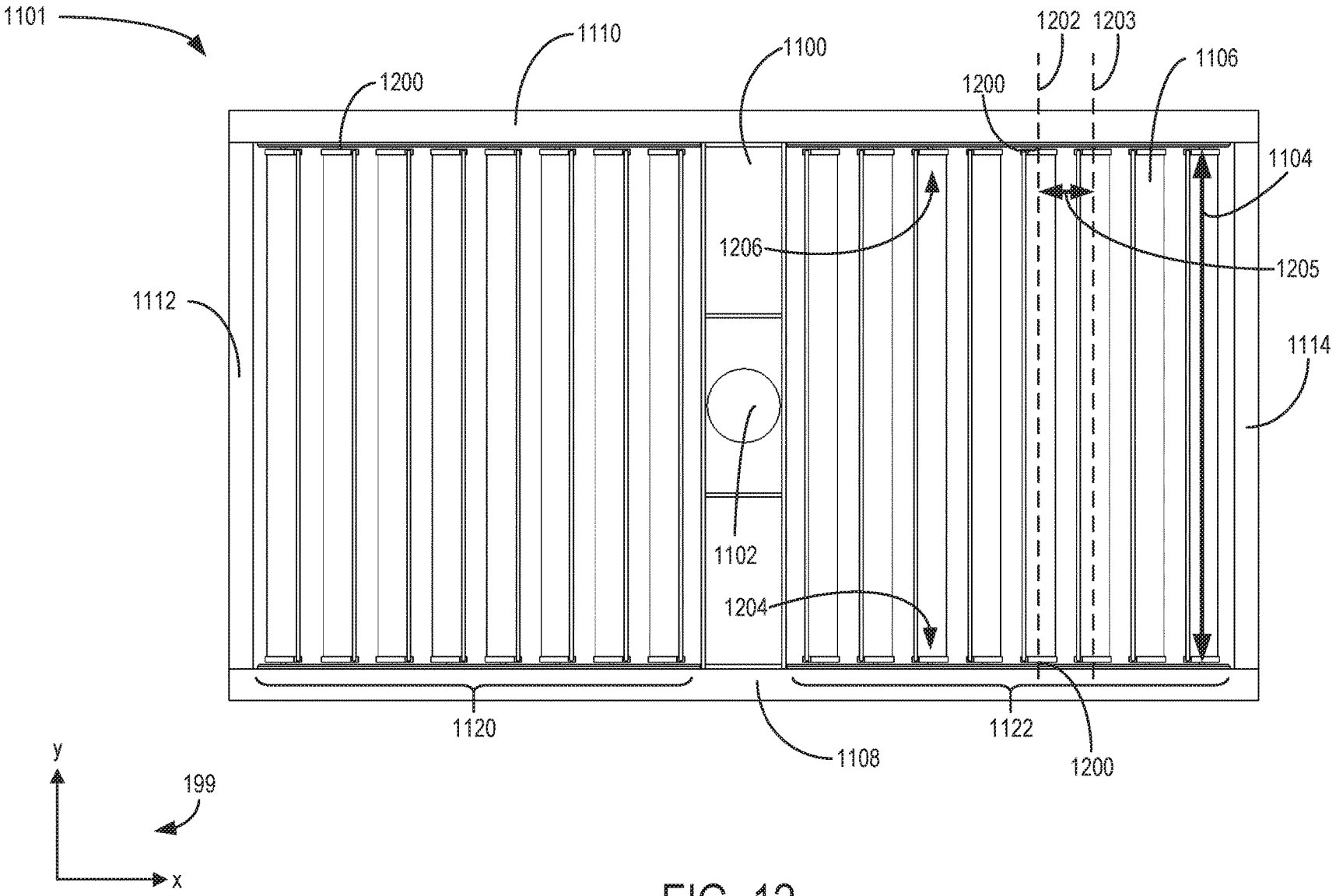
FIG. 12 shows a top view of the ceiling of the modular booth.
Figure 13:
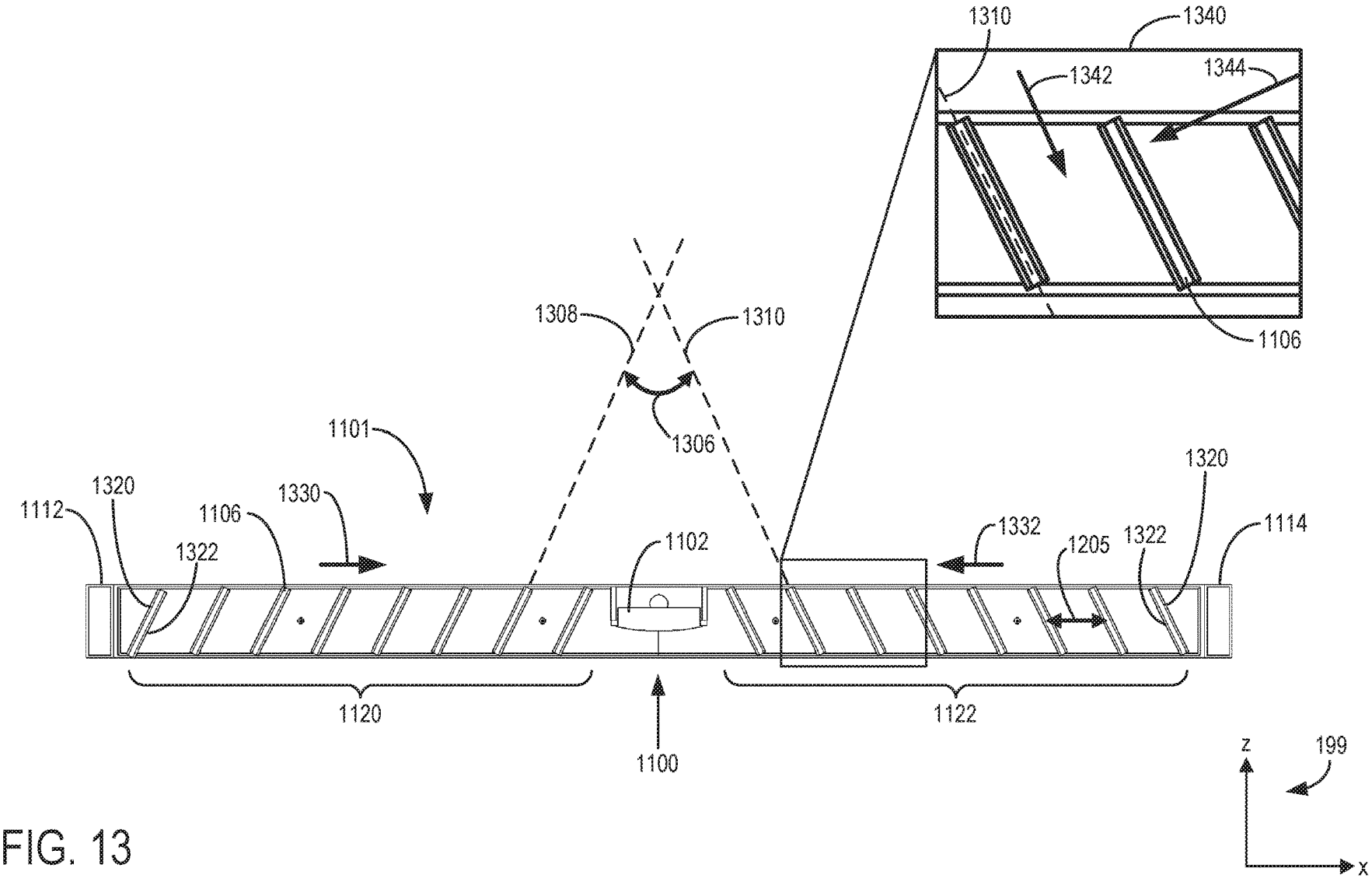
FIG. 13 shows a side cross-sectional view of the ceiling of the modular booth.

FIGS. 11-13 show views of an alternate embodiment of a ceiling 1101 that may be incorporated in booth 100 in place of ceiling 110. Ceiling 1101 is shaped to couple with the first wall 112 and second wall 114, similar to the example of the ceiling 110 shown by FIGS. 1-9 and described above. The ceiling 1101 include slats 1106, first side bar 1108, second side bar 1110, first cross bar 1112, and second cross bar 1114, similar to the slats 170, first side bar 530, second side bar 532, first cross bar 550, and second cross bar 551 described above with reference to ceiling 110.

Ceiling 1101 additionally includes a center section 1100 extending between the first side bar 1108 and second side bar 1110. Center section 1100 is centered on the ceiling 1101 in a direction from the first cross bar 1112 to the second cross bar 1114 and does not include slats 1106. A first plurality of the slats 1106 positioned between the center section 1100 and the first cross bar 1112 may be referred to herein as a first slat group 1120, and a second plurality of the slats 1106 positioned between the center section 1100 and the second cross bar 1114 may be referred to herein as a second slat group 1122. The first slat group 1120 and the second slat group 1122 are separated from each other by the center section 1100 of the ceiling 1101. Each of the slats 1106 has a length 1104, and the length 1104 extends in a direction from the first side bar 1108 to the second side bar 1110 during conditions in which the slats 1106 are coupled with the ceiling 1101 (e.g., in a direction parallel to first axis 1202). Each of the slats 1106 may be coupled to the ceiling 1101 via one or more fasteners 1200. In the example of the ceiling 1101, each slat 1106 includes separate fasteners 1200 (e.g., pins) centered at a first end 1204 and second end 1206 of each slat 1106. The fasteners 1200 are positioned such that a central axis extending along the length 1104 of an individual slat 1106 passes through the corresponding fasteners at both the first end 1204 and second end 1206. Example central axes of two of the slats 1106 are shown by FIG. 12 (e.g., first axis 1202 and second axis 1203). In one example, one or more of the slats 1106 may be pivotable around their corresponding central axis (e.g., first axis 1202, second axis 1203, etc.). In other examples, the slats 1106 may not be pivotable relative to each other.

Each of the slats 1106 may be spaced (e.g., distanced) from each adjacent slat 1106 by a distance 1205. The distance 1205 is a length between central axes of adjacent slats in a direction perpendicular to the central axes of the slats. For example, the distance 1205 as shown by FIG. 12 is a length between the first axis 1202 and the second axis 1203 in a direction perpendicular to both the first axis 1202 and second axis 1203. In alternate embodiments (e.g., embodiments that include a different number of slats 1106), the distance 1205 may be a different amount of length.

The center section 1100 of the ceiling 1101 includes a lighting device 1102 positioned midway between the first side bar 1108 and the second side bar 1110 (e.g., at a midpoint of the center section 1100 in a direction from the first side bar 1108 to the second side bar 1110). As described above with reference to FIG. 9 regarding the lighting mounted to the underside of ceiling 110 at location 956, the lighting device 1102 shown by FIGS. 11-13 may include LED lights, fluorescent tubing, etc. positioned in order to provide lighting to the workspace of modular booth 100 (e.g., to illuminate the workspace vertically below the ceiling 1101). In one example, the lighting device 1102 may be powered (e.g., may receive electrical energy) from an electrical bus such as the electrical power bus 1012 described above with reference to FIG. 10. An intensity, color, and/or direction of light emitted by the lighting device 1102 may be adjustable by a user of the modular booth 100. In one example, the light emitted by the lighting device 1102 may be adjustable via one or more actuators coupled to the lighting device 1102 (e.g., switches, buttons, etc.). In another example, the light emitted by the lighting device 1102 may be adjustable via user input into a computer console of the modular booth 100, with the intensity, color, and/or direction of the light adjusted via a control signal (e.g., electrical signal) transmitted to the lighting device 1102 from the computer console in response to the user input.

FIG. 13 shows a side cross-sectional view of the ceiling 1101, with the ceiling 1101 removed from the modular booth 100. Each slat 1106 includes a first surface 1320 and a second surface 1322 as shown by FIG. 13. The first surface 1320 and second surface 1322 each extend in a direction from the first side 105 to the second side 107 of the modular booth 100 during conditions in which the slats 1106 are coupled to the ceiling 1101 and the ceiling 1101 is coupled between the first wall 112 and the second wall 114 (e.g., via first corner gusset 520, second corner gusset 520, third corner gusset 562, and fourth corner gusset 564 as described above with reference to ceiling 110). In one example, the first surface 1320 and second surface 1322 may each be flat (e.g., planar and without curvature) surfaces positioned to be parallel to each other. In other examples, one or both of the first surface 1320 and second surface 1322 of one or more of the slats 1106 may be curved (e.g., not planar). For example, slats 1106 in the first slat group 1120 may be curved in a first direction 1330 toward the center section 1100 relative to their coupled position with the ceiling 1101, and slats 1106 in the second slat group 1122 may be curved in a second direction 1332 (opposite to the first direction 1330) toward the center section 1100 relative to their coupled position with the ceiling 1101.

In the examples of the ceiling 1101 shown by FIGS. 11-13, the slats 1106 of the first slat group 1120 are angled differently than the slats 1106 of the second slat group 1122. For example, a first angled axis 1308 extends in a direction parallel to the first surface 1320 and second surface 1322 of slats 1106 of the first slat group 1120 and is positioned perpendicular to central axes of the slats 1106 of the first slat group 1120 (e.g., central axes similar to first axis 1202 and second axis 1203 shown by FIG. 12). A second angled axis 1310 extends in a direction parallel to the first surface 1320 and second surface 1322 of slats 1106 of the second slat group 1122 and is positioned perpendicular to central axes of the slats 1106 of the second slat group 1122 (e.g., central axes similar to first axis 1202 and second axis 1203 shown by FIG. 12). The first angled axis 1308 and second angled axis 1310 are angled relative to each other by angle 1306.

Inset 1340 shows an enlarged view of a portion of the ceiling 1101 and illustrates example directions at which light from above the ceiling 1101 may pass through the ceiling 1101 and into the workspace vertically below the ceiling 1101 during conditions in which the ceiling 1101 is coupled to the modular booth 100. Because the slats 1106 of the first slat group 1120 are angled differently than the slats 1106 of the second slat group 1122 as described above, an amount of light from a light source positioned vertically above the ceiling 110 (e.g., relative to the ground surface on which the modular booth 100 sits) that passes through the first slat group 1120 may be different relative to an amount of light from the light source that passes through the second slat group 1122.

For example, during conditions in which the light source (e.g., sunlight, fluorescent lights, etc.) is positioned closer to the second cross bar 1114 of the ceiling 1101 than the first cross bar 1112, light rays from the light source may be oriented in a first direction 1344 relative to the slats 1106 of the second slat group 1122. As a result, a decreased amount of light may pass through the second slat group 1122 relative to an amount of light passing through the first slat group 1120. In another example, during conditions in which the light source is positioned approximately a same amount of distance from both the first cross bar 1112 and second cross bar 1114, light rays from the light source may be oriented in a second direction 1342 relative to the slats 1106 of the second slat group 1122. As a result, approximately a same amount of light may pass through the second slat group 1122 relative to an amount of light passing through the first slat group 1120. A user of the modular booth 100 may move (e.g., rotate) the modular booth 100 and/or may adjust a pivot angle of the slats 1106 of the first slat group 1120 and/or second slat group 1122 in order to adjust an amount of light from the light source passing into the workspace of the modular booth 100 via the slats 1106 of the ceiling 1101 as described above. The position (e.g., angle) of the slats 1106 of the first slat group 1120 and/or second slat group 1122 may be configured to reduce an amount of light incident on one or more graphical display devices positioned within the modular booth 100 as shown by FIG. 15 and described in further detail below.

FIG. 14 shows the modular booth 100 coupled with a sound-damping skirt 1402 and a sound-damping top 1400. The sound-damping skirt 1402 may include a plurality of sections coupled to different surfaces of the modular booth 100 in order to surround a bottom perimeter of the modular booth 100. For example, the sound-damping skirt 1402 is shown by FIG. 14 to include a first section 1404 coupled to the first door assembly 122, a second section 1406 coupled to the second door assembly 124, and a third section 1408 coupled to the second wall 114. The sound-damping skirt 1402 reduces an amount of opening between the door assemblies (e.g., first door assembly 122, second door assembly 124, etc.) and the ground on which the modular booth 100 sits. The sound-damping skirt 1402 additionally reduces an amount of opening between the walls (e.g., first wall 112 and second wall 114) and the ground on which the modular booth 100 sits. The sound-damping skirt 1402 may be formed of one or more materials with acoustical damping properties (e.g., rubber, foam padding, etc.) and may reduce an amount of noise (e.g., acoustical disturbances) passing into the workspace of the modular booth 100 from sources external to the modular booth 100 (e.g., footsteps and/or voices from persons positioned outside of the modular booth 100, etc.). In some examples, the material of the sound-damping skirt 1402 may be flexible to enable the sound-damping skirt 1402 to temporarily bend during conditions in which the modular booth 100 is moved and/or the door assemblies are pivoted relative to the walls of the modular booth 100.

The sound-damping top 1400 may be coupled to the ceiling of the modular booth 100 (e.g., ceiling 110 or ceiling 1101) in order to reduce an amount of noise passing into the workspace of the modular booth 100. For example, the sound-damping top 1400 may be formed of one or more materials with acoustical damping properties (e.g., foam sheets, corrugated paper, etc.) and may be removably coupled to the ceiling of the modular booth 100 in order to reduce an amount of opening of the ceiling (e.g., to reduce an amount of noise passing through the slats 1106 of ceiling 1101). In some examples (such as that shown by FIG. 14), the sound-damping top 1400 may include a plurality of ventilation channels 1420 configured to increase a flow of air into the workspace of the modular booth 100. Additionally, in some examples, the ventilation channels 1420 may include one or more electric fans positioned therein to further increase the flow of air into the workspace of the modular booth 100.

In some examples the modular booth 100 may include one or more supportive struts coupled between the first wall 112 and the second wall 114 proximate to the bottom and/or top perimeters of the modular booth 100 in order to increase a rigidity of the modular booth 100. Alternately and/or additionally, the modular booth 100 may include one or more floor panels configured to form a floor of the modular booth 100 and coupled to the first wall 112 and second wall 114 at a position vertically above the ground on which the modular booth 100 sits. The floor panels may provide a supportive surface on which users of the modular booth 100 may stand, sit, etc. The floor panels may further reduce the amount of noise passing into the workspace of the modular booth 100 from sources external to the modular booth 100 and may increase an ease with which the workspace of the modular booth 100 may be cleaned.

FIG. 15 shows three views of the modular booth 100 with a graphical display device 1506 (e.g., computer monitor, television, etc.) of the modular booth 100 in various positions. As described above with reference to FIG. 9, in some examples the graphical display device 1506 may be coupled to the modular booth 100 (e.g., the second wall 114 of the modular booth 100) at the location 954. In other examples, the graphical display device 1506 may instead be coupled to the first wall 112 at a similar location (e.g., at a similar height as the location 954 relative to the ground on which the modular booth 100 sits). In yet other examples, the modular booth 100 may include multiple graphical display devices with graphical display device 1506 coupled to second wall 114 and a second (e.g., similar) graphical display device coupled to first wall 112 as described above.

The ceiling 1101 of the modular booth 100 may be configured to reduce an amount of light from a light source positioned vertically above the modular booth 100 from passing through the ceiling 1101 in various directions. For example, as shown by first view 1500, the slats 1106 (shown by FIGS. 11-13) of the ceiling 1101 may be angled so that a reduced amount of light rays 1508 produced by the light source above the ceiling 1101 pass through the ceiling 1101 in a direction toward the graphical display device 1506 relative to an amount of light rays 1510 passing through the ceiling 1101 in a direction away from the graphical display device 1506. In this way, the workspace of the modular booth 100 may be illuminated by the light source above the ceiling 1101 and an amount of visual glare (e.g., light reflection) of the graphical display device 1506 may be reduced.

In order to further reduce an amount of glare of the graphical display device 1506 and/or to adjust a viewing angle of the graphical display device 1506, the graphical display device 1506 may be pivoted relative to the walls of the modular booth 100 (e.g., second wall 114) via a pivotable mount 1512. In one example (as shown by second view 1502), the graphical display device 1506 may be pivoted via the pivotable mount 1512 in order to adjust a height and/or rotation of the graphical display device 1506 relative to the walls of the modular booth 100. In another example (as shown by third view 1504), the graphical display device 1506 may be pivoted via the pivotable mount 1512 to a position outside of the modular booth 100 (e.g., a position in which a screen of the graphical display device 1506 is perpendicular to the walls of the modular booth 100). In this configuration, a visibility of the graphical display device 1506 to persons positioned outside of the workspace of the modular booth 100 (e.g., exterior to the modular booth 100) may be increased. In one example, the graphical display device 1506 may be positioned in this configuration in order to display images to be viewed by persons passing by the modular booth 100 (e.g., for marketing, point-of-sale displays, indicating a user occupancy and/or configuration of the modular booth 100, etc.).

FIG. 16 shows a view 1600 of the modular booth 100 with the second seat 154 and the second desk 164 (described above) replaced by a different modular element. In this example, the modular element coupled to the second wall 114 is a mothers' station 1618 including a microwave oven 1606, refrigerator 1608, bottle holder 1610, breast pumps 1607, first storage container 1614, and second storage container 1616. The components of the mothers' station 1618 (e.g., microwave oven 1606, refrigerator 1608, etc.) are coupled to (e.g., supported by) a console 1612. The first storage container 1614 and/or second storage container 1616 may be coupled with the console 1612 (via a plurality of tracks, for example) such that the first storage container 1614 and/or second storage container 1616 are slideable relative to the console 1612. For example, a user of the modular booth 100 may pull the first storage container 1614 in a direction away from the console 1612 in order to increase an accessibility of the first storage container 1614, and the user may push the first storage container 1614 toward the console 1612 in order to stow the first storage container 1614 within the console 1612. Similarly, the bottle holder 1610 and breast pumps 1607 may be supported by (and stored within) a drawer 1611, and the drawer 1611 may be slideable relative to the console 1612 (e.g., via a plurality of tracks as described above with reference to the first storage container 1614). During conditions in which the second seat 154 and second desk 164 are removed from the modular booth 100, the console 1612 may be coupled to second wall 114 at the location that previously housed (e.g., stowed) the second seat 154 and second desk 164 via one or more hooks, latches, and/or other fastening devices. Inset 1602 shows the mothers' station 1618 removed from the modular booth 100.

During conditions in which the mothers' station 1618 is coupled to the modular booth 100, one or more devices of the mothers' station 1618 may be powered by an electrical bus similar to the electrical power bus 1012 described above with reference to FIG. 10. For example, microwave oven 1606 and refrigerator 1608 may be powered by the electrical bus, and the electrical bus may receive electrical power from a source external to the modular booth 100 (e.g., a wall power outlet of a building containing the modular booth 100) or a source on-board the modular booth 100 (e.g., a battery).

In other examples, the mothers' station 1618 may instead be coupled to the first wall 112 (e.g., during conditions in which the first desk 162 and first seat 152 are removed from the modular booth 100) and the second wall 114 may include the second seat 154 and second desk 164. In yet other examples, the modular booth 100 may include two mothers' stations similar to the mothers' station 1618 described above, with a first mothers' station coupled to the first wall 112 and a second mothers' station coupled to the second wall 114. Further examples may include different combinations of modular elements and/or different types of modular elements (e.g., gaming stations including foldable gaming tables, point-of-purchase stations including credit card readers, etc.).

Similar to the mothers' station 1618 and console 1612 described above, in some examples a desk and seat (e.g., first desk 162 and first seat 152, or second desk 164 and second seat 154) may be included together within a single modular element (referred to herein as a desk/seat station). The desk/seat station and mothers' station 1618 may each be configured as stand-alone units (e.g., configured to be utilized by one or more users during conditions in which the stations are not coupled to the modular booth 100) and may be coupled with the first wall 112 or second wall 114 of the modular booth 100 in order to be used by one or more users positioned within the workspace of the modular booth 100. In one example, the desk/seat station may include one or more support elements (e.g., hooks, anchors, etc.) configured to couple the desk/seat station to walls external to the modular booth 100 (e.g., walls of a building such as an office, school, etc.) so that the desk/seat station may be utilized as a stand-alone unit (e.g., utilized independently from the modular booth 100). The seat and desk included by the desk/seat station may be stowable within a frame of the desk/seat station such that the desk/seat station is positioned substantially flush with the wall to which the desk/seat station is coupled. In other words, the seat and desk are stowable within the frame such that an amount of protrusion of the desk/seat station from the wall during conditions in which the desk/seat station is coupled to the wall is reduced. Other types of modular elements (e.g., other types of shelving, tables, etc.) may function in a similar way (e.g., may be removable from the modular booth and configured to be used while decoupled from the modular booth, and/or may be exchangeable with different modular elements within the modular booth 100).

In some examples, the modular booth 100 may include one or more support mechanisms (not shown) configured to reduce a movement of the modular booth 100 in response to forces against the modular booth 100 (e.g., pushing, pulling, oscillations, etc.). In one example, the support mechanisms may include hooks, latches, etc. coupled to surfaces of the walls (e.g., first wall 112 and/or second wall 114), ceiling 110, and/or door panels (e.g., door panels 230, 232, 234, 236, 238, 240, 242, and/or 244) of the modular booth 100. The support mechanisms may be shaped or otherwise configured to engage (e.g., couple) the respective surfaces of the modular booth 100 (e.g., the surfaces of the modular booth 100 coupled to the support mechanisms) to one or more surfaces external to the modular booth 100. For example, the support mechanisms may be utilized to couple the first wall 112 to a wall of a building (e.g., a wall of an office, school, etc.) in which the modular booth 100 is located in order to prevent the modular booth 100 from moving (e.g., sliding, rolling, rotating, etc.) relative to the wall of the building.

Figure 17:
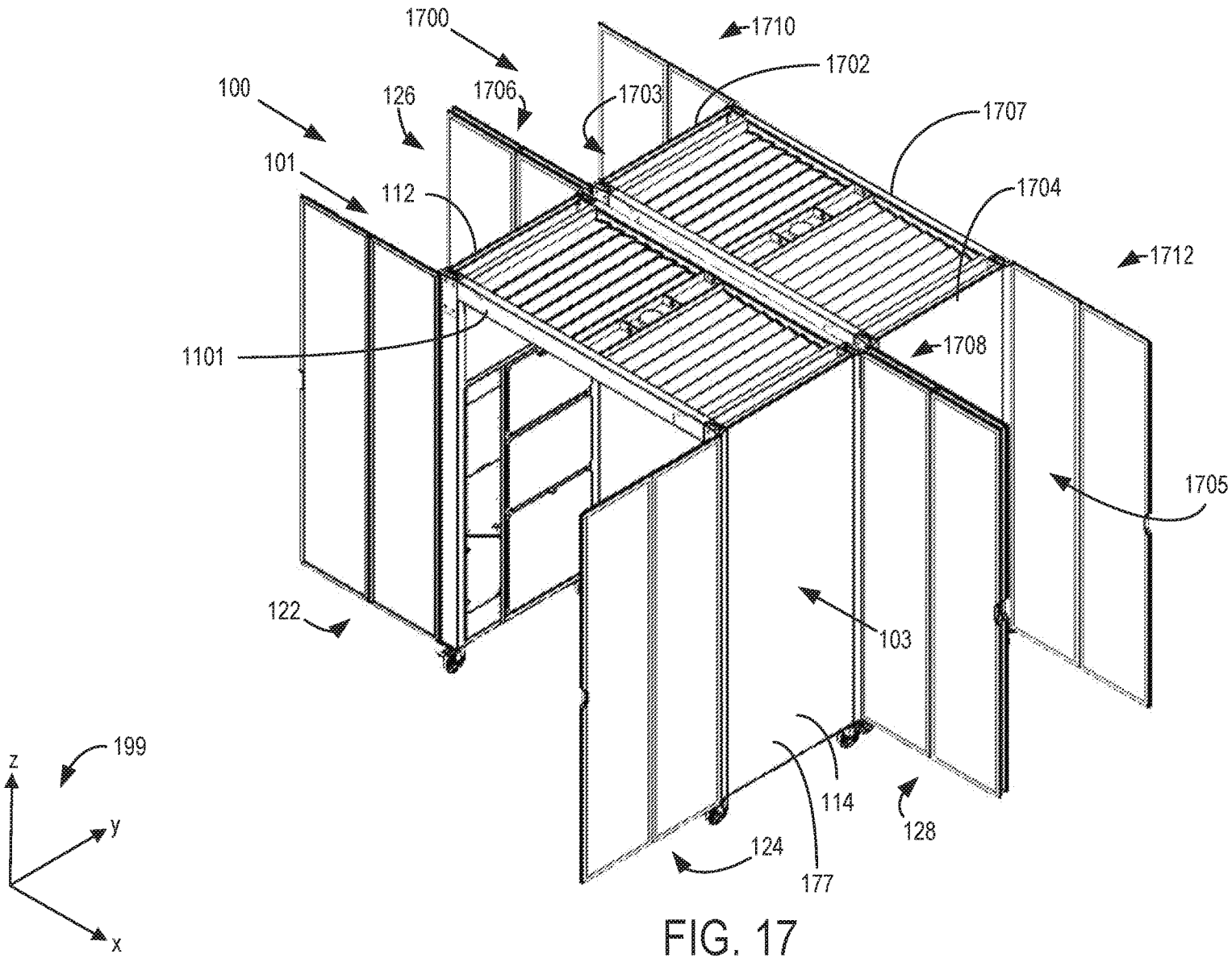
FIGS. 17-19 show three example arrangements of the modular booth coupled to a second modular booth.
Figure 18:
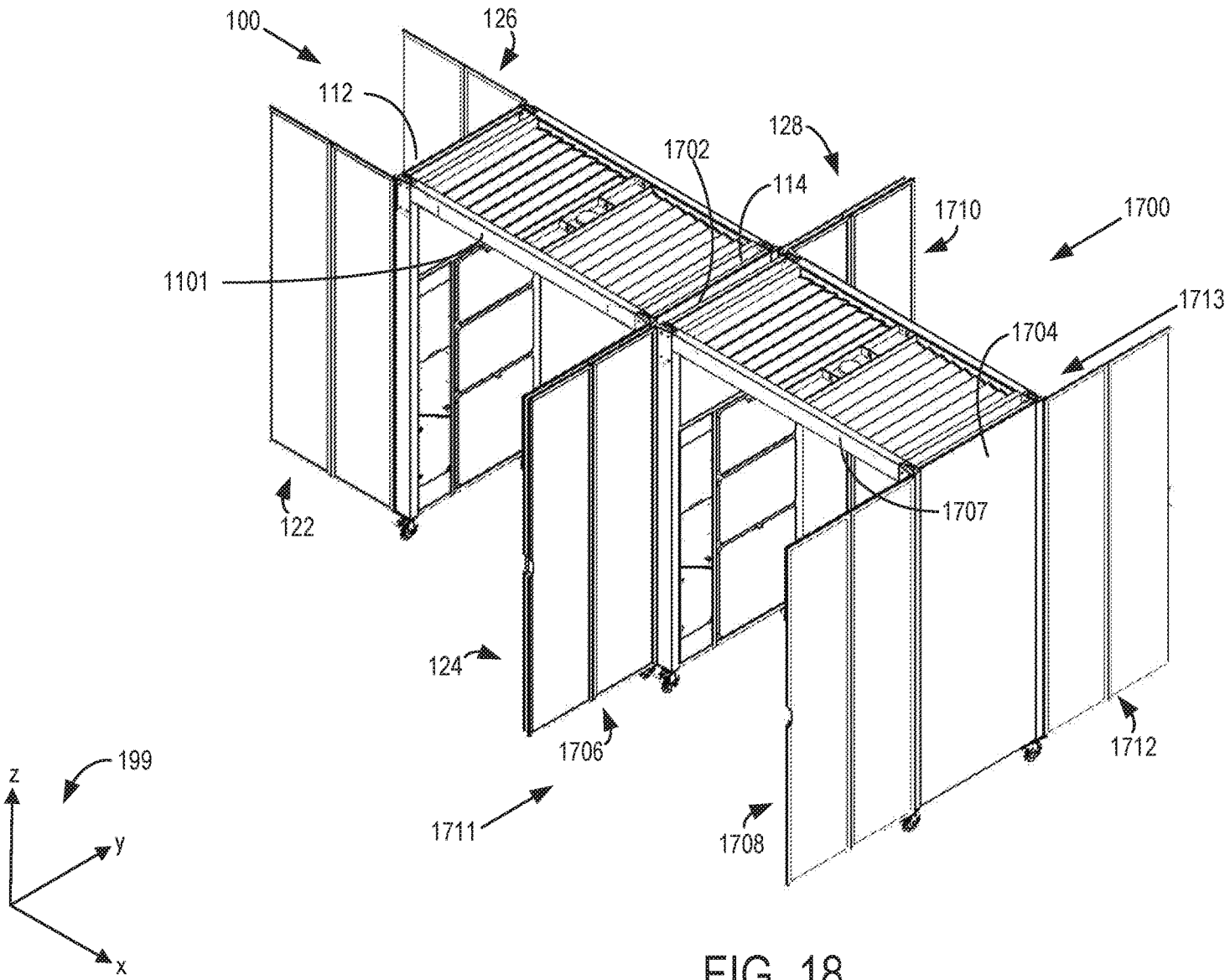
Figure 19:
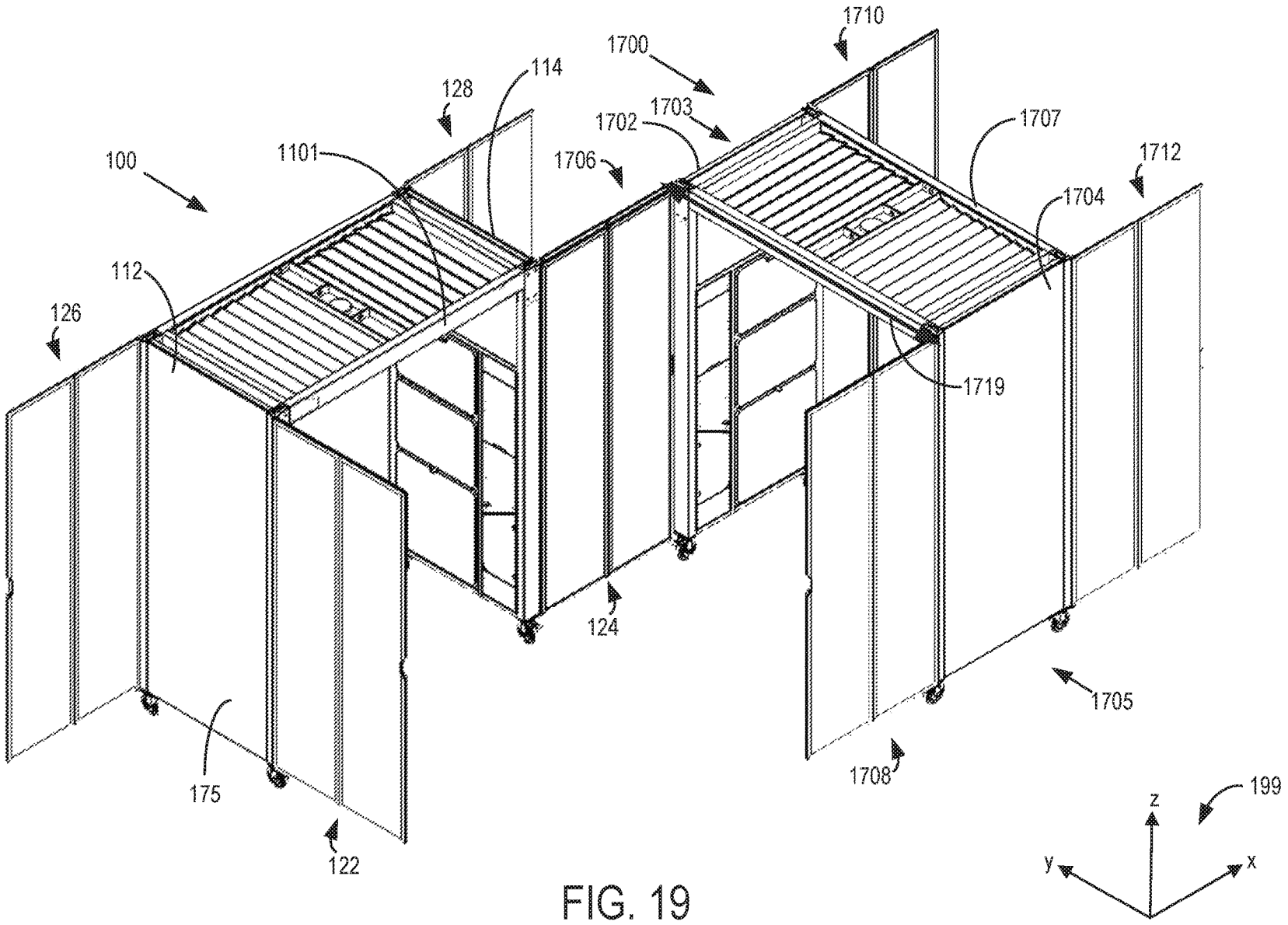

In other examples (as shown by FIGS. 17-19), the support mechanisms may be utilized in order to couple the modular booth 100 to a second modular booth 1700 similar to the modular booth 100. The second modular booth 1700 includes a first wall 1702 at a first end 1703 and an opposing second wall 1704 at a second end 1705 (similar to first wall 112 and second wall 114) joined by a ceiling 1707 (similar to ceiling 1101), and may include a similar configuration of modular elements (e.g., first desk 162, first seat 152, refrigerator 1608, microwave oven 1606, etc.) relative to modular booth 100. In other examples, the second modular booth 1700 may include a different configuration of modular elements relative to the modular booth 100. The second modular booth 1700 also includes a plurality of door assemblies (e.g., first door assembly 1706, second door assembly 1708, third door assembly 1710, and fourth door assembly 1712) similar to the door assemblies of the modular booth 100 (e.g., first door assembly 122, second door assembly 124, third door assembly 126, and fourth door assembly 128).

In one example, the first wall 112 of modular booth 100 may be coupled to a similar first wall or second wall of the second modular booth 1700 via the support mechanisms in order to join the modular booth 100 to the second modular booth 1700 and to prevent the modular booth 100 and second modular booth 1700 from moving relative to each other. In another example, a door panel of the modular booth 100 (e.g., one of the door panels 230, 232, 234, 236, 238, 240, 242, or 244) may be coupled to a door panel (e.g., a similar door panel) of the second modular booth 1700 in order to join the modular booth 100 to the second modular booth 1700. In this configuration, the amount of workspace (e.g., an area and/or volume of the workspace) provided by the modular booth 100 may be increased by joining the workspace of the modular booth 100 with a workspace of the second modular booth 1700.

In one example, such as the example shown by FIG. 17, the first modular booth 100 and second modular booth 1700 may be coupled together via the support mechanisms such that surfaces of the modular booth 100 positioned at the second side 107 of the modular booth 100 are in face-sharing contact (e.g., abutting) with surfaces positioned at a first side 1711 of the second modular booth 1700 (e.g., similar to first side 105 of modular booth 100) opposite to a second side 1713 (e.g., similar to second side 107). In this configuration, first wall 112, second wall 114, and/or ceiling 110 of the modular booth 100 may couple to the first wall 1702, second wall 1704, and/or ceiling 1707 (respectively) of the second modular booth 1700 via the support mechanisms. Additionally and/or alternately, third door assembly 126 and/or fourth door assembly 128 of the modular booth 100 may be coupled to first door assembly 1706 and/or second door assembly 1708 (respectively) of the second modular booth 1700.

In another example as shown by FIG. 18, the first modular booth 100 and second modular booth 1700 may be coupled together via the support mechanisms such that surfaces of the modular booth 100 positioned at the second end 103 of the modular booth 100 are in face-sharing contact with surfaces positioned at the first end 1703 of the second modular booth 1700. In this configuration, second wall 114 and/or ceiling 110 of the modular booth 100 may be coupled to the first wall 1702 and/or ceiling 1707 (respectively) of the second modular booth 1700. Additionally and/or alternately, second door assembly 124 and/or fourth door assembly 128 of the modular booth 100 may be coupled to first door assembly 1706 and/or third door assembly 1710 (respectively) of the second modular booth 1700.

In yet another example as shown by FIG. 19, the first modular booth 100 and second modular booth 1700 may be coupled together via the support mechanisms in a position such that the ceiling 110 of the modular booth 100 extends in a direction perpendicular to the ceiling 1707 of the second modular booth 1700 (e.g., the length 193 of the modular booth 100 from the first end 101 to the second end 103 extends in a direction perpendicular to a length 1719 of the second modular booth 1700 from the first end 1703 to the second end 1705). In this configuration, the second door assembly 124 of the modular booth 100 may be coupled in face-sharing contact with the first door assembly 1706 of the second modular booth 1700.

In some examples, multiple modular booths may be coupled together in yet further configurations by forming one or more door assemblies of one or more of the modular booths of a flexible material and/or shape (as described above with reference to FIG. 4). For example, door assemblies coupled to the first wall 112 of the modular booth may be retractable into rollers coupled to the first wall 112, and door assemblies coupled to the second wall 114 may be retractable into rollers coupled to the second wall 114. By retracting one or more of the door assemblies into their corresponding rollers, the modular booth 100 may couple to additional modular booths (e.g., second modular booth 1700) in an increased number of arrangements and/or may couple to additional modular booths with increased ease.

As described above, FIGS. 17-19 show example arrangements of two modular booths (e.g., modular booth 100 and second modular booth 1700) coupled together. In alternate examples (such as those shown by FIGS. 21-22 and described below), a different number of modular booths (e.g., three, five, ten, twenty, etc.) may be coupled together via respective support mechanisms of each modular booth as described above with reference to modular booth 100 and second modular booth 1700. In some examples, the modular booths (e.g., modular booth 100 and the second modular booth 1700) may be coupled together in arrangements different than those shown by FIGS. 17-19 (e.g., with one or more door assemblies of modular booth 100 being coupled to the first wall 1702 and/or second wall 1704 of the second modular booth 1700).

Figure 20:
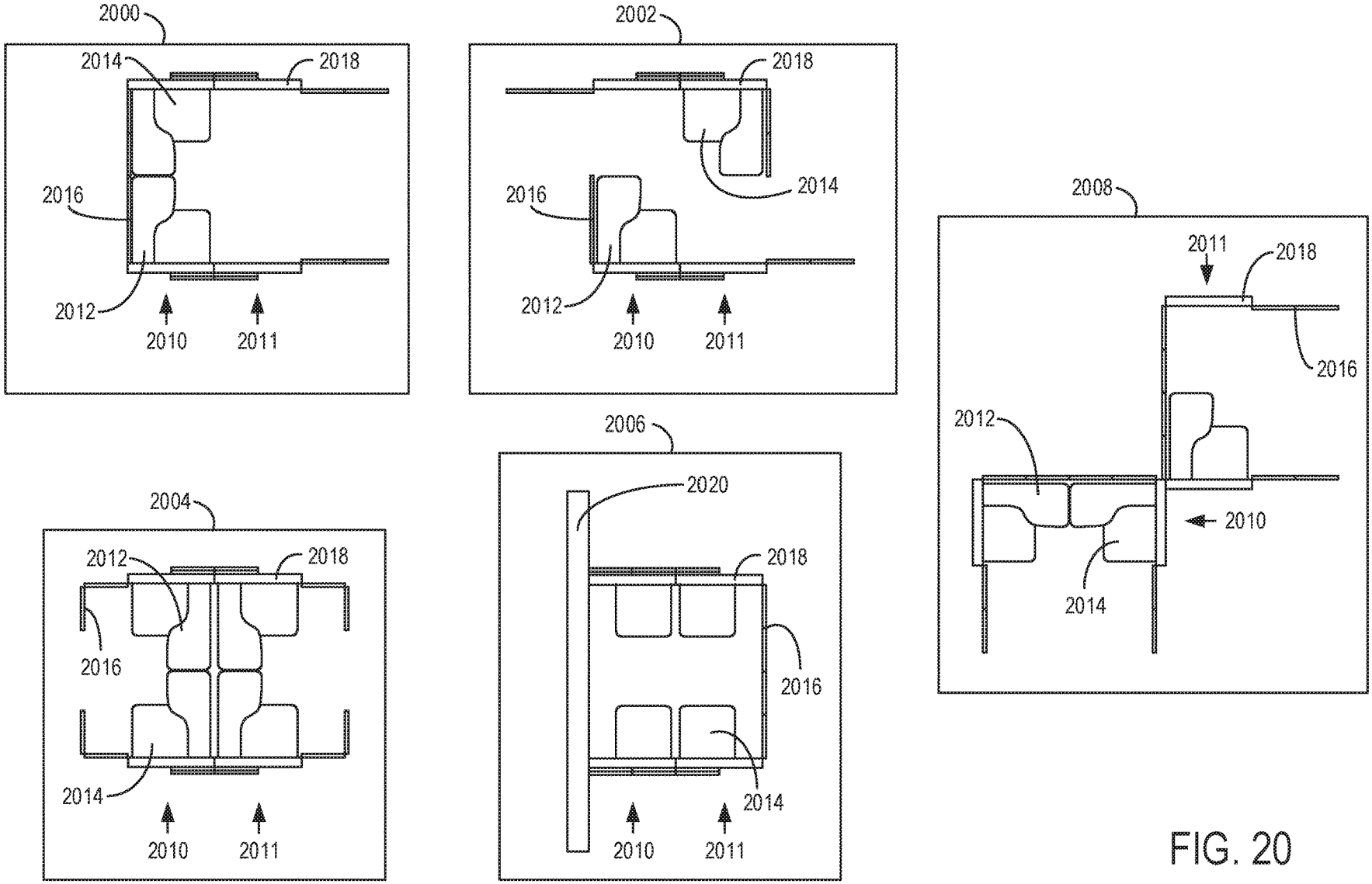
FIGS. 20-22 each schematically show various examples arrangements of multiple modular booths coupled to each other.
Figure 21:
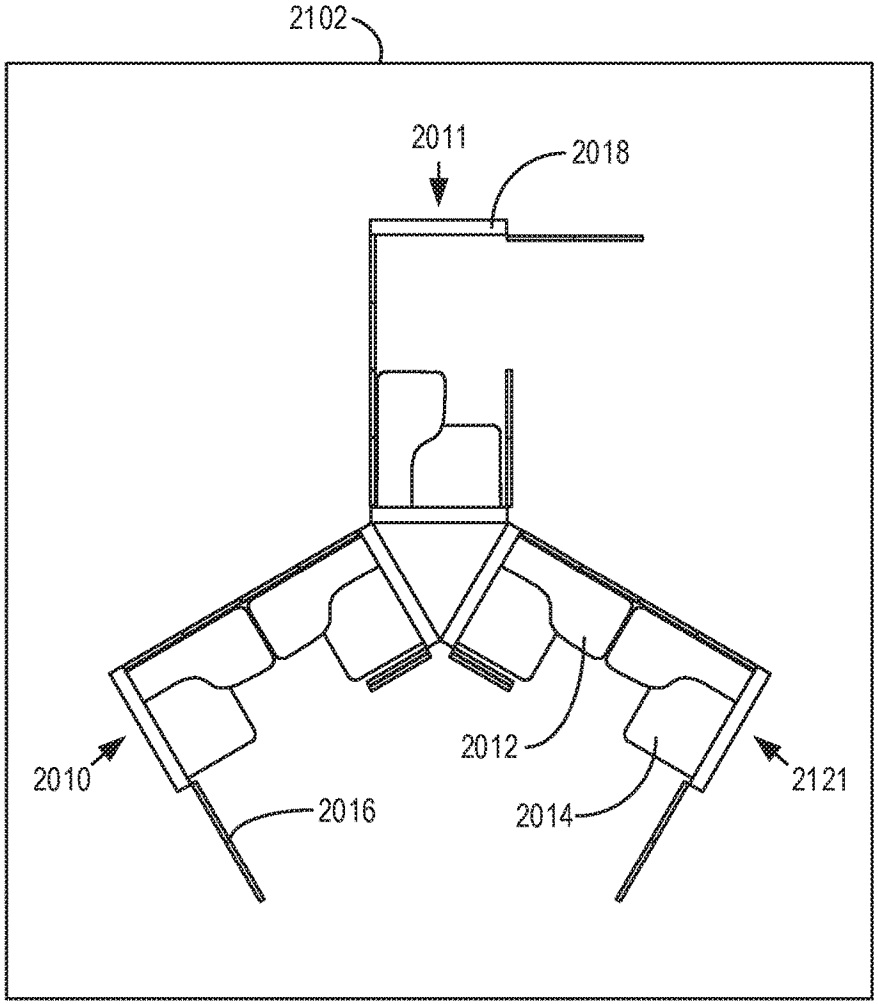
Figure 21:
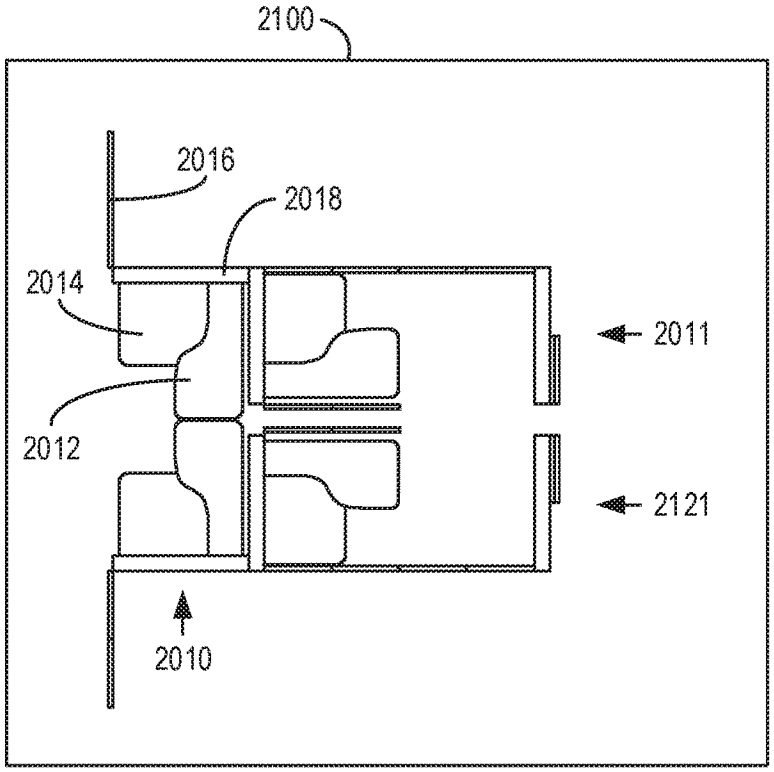
Figure 22:
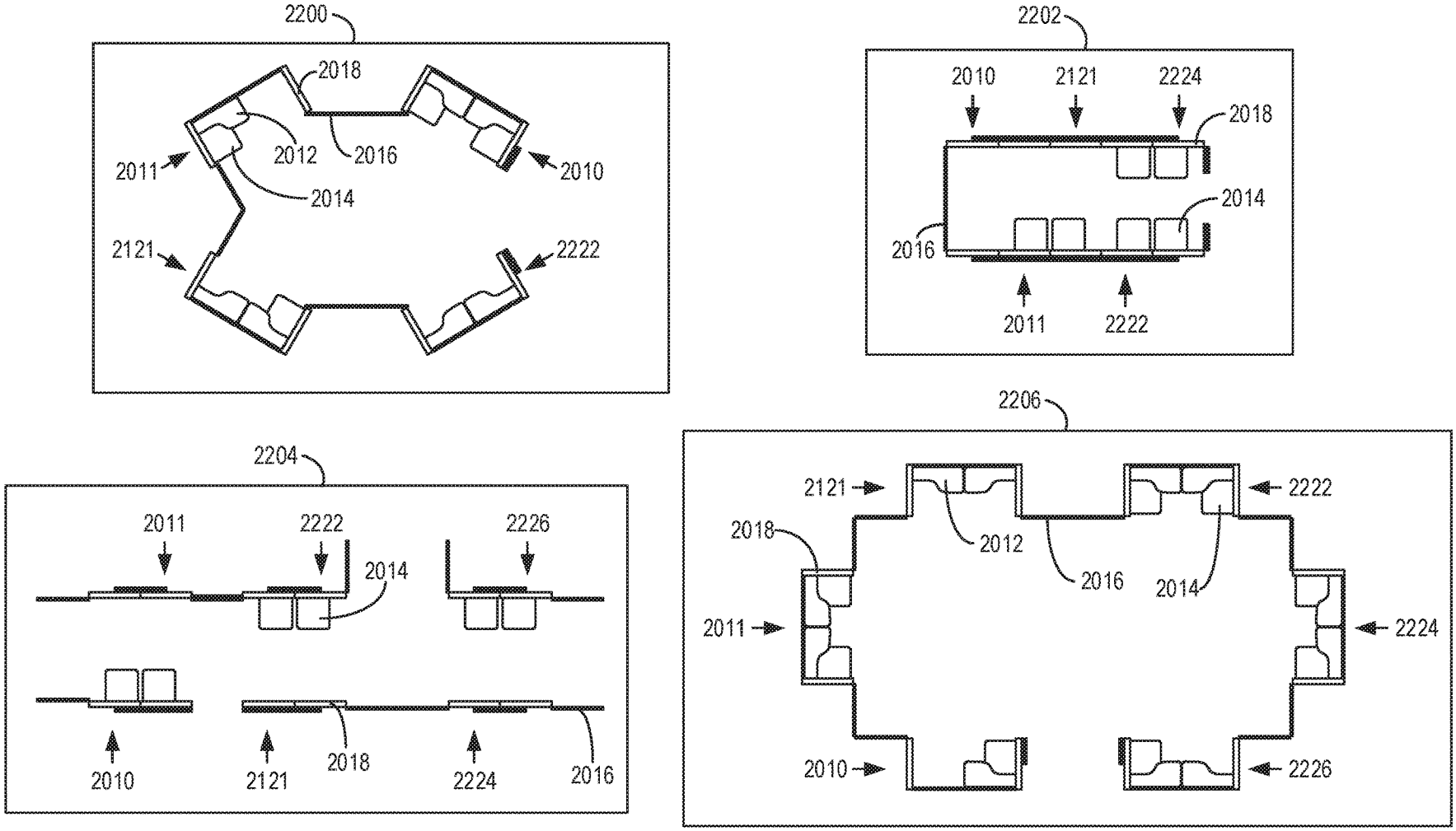

FIGS. 20-22 each show different example arrangements of multiple modular booths coupled to each other. For example, FIG. 20 shows example arrangements of two modular booths coupled to each other, FIG. 21 shows example arrangements of three modular booths coupled to each other, and FIG. 22 shows example arrangements of four or more modular booths coupled to each other. The aerial views shown by FIGS. 20-22 (e.g., views from vertically above the modular booths relative to the ground on which the modular booths sit) are schematic in nature and illustrate a relative position of the modular booths and their components (e.g., door assemblies 2016, walls 2018, desks 2012, and seats 2014). In one example, the modular booths may be similar to the modular booth 100 described above and may include various combinations of the modular elements described above (e.g., mothers' station 1618, desk/seat station, etc.). Representative examples of the components described above (e.g., door assemblies 2016, walls 2018, desks 2012, and seats 2014) may be labeled once in each view and similar examples may not be labeled for illustrative purposes. In some examples, one or more desks 2012 and/or seats 2014 may not be shown. However, in such examples, the one or more desks 2012 and/or seats 2014 may be in a stowed position within the walls 2018 of the modular booths and may be included by the modular booths but not visible in the views shown. Similarly, each modular booth includes a ceiling, but the ceiling of each modular booth is not shown for illustrative purposes. However, the relative position of each ceiling is indicated by a shaded region of each modular booth. The modular booths may be coupled to each other via support mechanisms as described above.

FIG. 20 shows example arrangements of a first modular booth 2010 and a second modular booth 2011 coupled to each other. For example, a first view 2000, a second view 2002, a third view 2004, and a fourth view 2006 each show the first modular booth 2010 and second modular booth 2011 coupled to each other in positions in which the walls 2018 of each modular booth are arranged parallel to each other. A fifth view 2008 shows the first modular booth 2010 and the second modular booth 2011 coupled to each other in a position in which the walls 2018 of the first modular booth 2010 (e.g., similar to first wall 112 and second wall 114 described above) are positioned perpendicular to the walls 2018 of the second modular booth 2011. In each of the views, the door assemblies 2016 of the first modular booth 2010 and second modular booth 2011 are shown in various extended, semi-extended, and retracted positions, thereby altering an amount of space enclosed by each modular booth (e.g., a size of the workspace of each modular booth). Further, in some examples such as the example shown by fourth view 2006, one or more of the modular booths may be coupled to a wall 2020 of a building (e.g., a wall of an office, school, lobby, etc.) via support mechanisms as described above. In this way, a position of the modular booths may be retained relative to the wall 2020 of the building, and the wall 2020 of the building may provide additional privacy.

FIG. 21 shows example arrangements of the first modular booth 2010, the second modular booth 2011, and a third modular booth 2121 coupled to each other. A first view 2100 shows the first modular booth 2010 positioned such that walls 2018 of the first modular booth 2010 are perpendicular to walls 2018 of the second modular booth 2011 and third modular booth 2121. A second view 2102 shows the first modular booth 2010, second modular booth 2011, and third modular booth 2121 in a triangular arrangement, with one wall 2018 of each modular booth coupled to one wall of each other modular booth.

FIG. 22 shows example arrangements of four or more modular booths coupled to each other. For example, a first view 2200 shows the first modular booth 2010, second modular booth 2011, third modular booth 2121, and a fourth modular booth 2222 coupled to each other via the door assemblies 2016. A second view 2202 shows the first modular booth 2010, second modular booth 2011, third modular booth 2121, fourth modular booth 2222, and a fifth modular booth 2224 coupled to each other via the walls 2018 in a first in-line arrangement. A third view 2204 shows the first modular booth 2010, second modular booth 2011, third modular booth 2121, fourth modular booth 2222, fifth modular booth 2224, and a sixth modular booth 2226 coupled to each other via the walls 2018 and the door assemblies 2016 in a second in-line arrangement. A fourth view 2206 shows the first modular booth 2010, second modular booth 2011, third modular booth 2121, fourth modular booth 2222, fifth modular booth 2224, and sixth modular booth 2226 coupled to each other via the door assemblies 2016 in an enclosed ellipse arrangement.

FIGS. 1-9 and FIGS. 11-22 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The technical effect of forming the modular booth by coupling the first wall to the second wall via the ceiling is to provide a collapsible and mobile on-demand workspace with storage for a plurality of modular elements. By removably coupling the modular elements (e.g., desks, seats, etc.) to the first wall and/or second wall, the modular elements may be easily coupled to the modular booth for use by one or more users, or decoupled from the modular booth for storage and/or exchanged with different modular elements according to a preference of the one or more users. By configuring the modular elements to be foldable into a stowed position within the first wall and/or second wall, a size of the modular booth may be decreased and an amount of customization of the modular booth is increased. In this way, a configuration and relative positioning of the modular elements and other components of the modular booth may be retained during conditions in which the modular booth is moved and/or disassembled into a more compact form. Additionally, two or more modular booths may be coupled together in order to increase a number and/or variety of modular elements available to users within the combined workspace of the modular booths.

As one embodiment, a modular booth includes a frame formed by two opposing walls and a ceiling, a first pair of doors coupled to a first side of the frame and a second pair of doors coupled to a second side of the frame, one or more modular elements coupled to the frame, the one or more modular elements movable between a stowed position and a fully extended position, and a set of casters coupled to a ground surface of the frame. In some examples, the ceiling may comprise a set of louvers.

In an example, the first pair of doors includes a first door coupled to a first wall of the two opposing walls and a second door coupled to a second wall of the two opposing walls. The first door may be coupled to the first wall via a first set of door hinges that provides a greater than 180-degree range of motion around a first axis of rotation, and the second door may be coupled to the second wall via a second set of door hinges that provides a greater than 180-degree range of motion around a second axis of rotation. The second pair of doors may be configured in a similar manner, e.g., with a third door coupled to the first wall and a fourth door coupled to the second wall, and each of the third and fourth door is coupled via a respective set of door hinges that allow greater than 180-degree range of motion about a respective axis of rotation.

In an example, the first door is movable to a fully-extended position where the first door is positioned parallel to a horizontal axis and extends between the first wall and the second wall. The horizontal axis may be perpendicular to both of the first axis of rotation and the second axis of rotation, and the horizontal axis may intersect both of the first axis of rotation and the second axis of rotation. Additionally or alternatively, the first door is movable to a stowed position where the first door is positioned perpendicular to the horizontal axis and extends along an exterior surface of the first wall. Additionally or alternatively, the first door is movable to a semi-extended position where the first door is angled away from an exterior surface of the first wall around the first axis of rotation by an amount greater than 0 degrees and less than 270 degrees. The second door may be configured in a similar manner (e.g., movable between a stowed position, semi-extended position, and fully-extended position). Likewise, the third door and fourth door may be configured in a similar manner.

In an example, the first door and second door are each bi-fold doors that comprise two vertically-hinged door panels. The two vertically-hinged door panels are movable about an axis of rotation that extends along the hinges coupling the door panels, such that the door panels may be articulated vertically toward or away from each other. The third and fourth door may be configured in a similar manner.

In an example, the one or more modular elements includes a desk coupled to one of the two opposing walls. In some examples, the desk is pivotably coupled to the one of the two opposing walls via a set of tracks coupled to the one of the two opposing walls. Additionally or alternatively, the one or more modular elements includes a seat coupled to one of the two opposing walls. In some examples, the seat is pivotably coupled to the one of the two opposing walls via a set of tracks coupled to the one of the two opposing walls. When both are included in the booth, the desk and the seat may be coupled to the same wall or to different walls. Additionally or alternatively, the one or more modular elements includes a display device coupled to one of the two opposing walls. In some examples, the display device is coupled to the one of the two opposing walls via a pivotable mount, the pivotable mount configured to move the display device between a first, stowed position where a screen of the display device faces the other of the two opposing walls and a second, extended position where the display device is positioned outside of the frame.

In an example, each wall of the two opposing walls includes a wall panel, a first structural member, and a second structural member. The ceiling includes a first side bar and a second side bar, and each first structural member is shaped to couple with a respective first corner gusset, each second structural member is shaped to couple with a respective second corner gusset, each first corner gusset is coupleable to the first side bar, and each second corner gusset is coupleable to the second side bar.

Another embodiment provides a modular booth including a frame defining a workspace and formed by a first wall, a second wall opposing the first wall, and a ceiling coupled to the first wall and second wall, a desk and a seat each storable in the frame, the desk and the seat each coupled to the first wall and each movable between a stowed position and fully extended position, and a display device coupled to the second wall.

In an example, the display device is coupled to the second wall by a mount including a first arm directly coupled to a second arm, wherein the first arm is directly coupled to the second wall and pivotable relative to the second wall, and the second arm is directly coupled to the display device and pivotable relative to the first arm.

In an example, the modular booth further includes a first pair of tracks and a second pair of tracks each coupled to the first wall, the desk is coupled with the first pair of tracks and is slideable along the first pair of tracks, and the seat is coupled with the second pair of tracks and is slideable along the second pair of tracks. Additionally or alternatively, the desk includes a work surface and a support arm, a first end of the work surface and a first end of the support arm are each coupled with the first pair of tracks and are slideable along the first pair of tracks in a vertical direction relative to a ground on which the modular booth sits, and a second end of the support arm is coupled to the work surface and is pivotable relative to the work surface and the first pair of tracks. Additionally or alternatively, the seat includes a backrest portion and a seat portion, a first end of the seat portion and a first end of the backrest portion are each coupled with the second pair of tracks and are slideable along the second pair of tracks in a vertical direction relative to a ground on which the modular booth sits, and a second end of the backrest portion is coupled to the seat portion and is pivotable relative to the seat portion and the second pair of tracks.

In an example, the modular booth further includes a first pair of doors coupled to a first side of the frame and a second pair of doors coupled to a second side of the frame, the first and second pair of doors configured to enclose the workspace when in a fully-extended position and open the workspace when in a semi-extended or retracted position.

Another embodiment provides a modular booth including a frame formed by a first wall, a second wall opposing the first wall, and a ceiling without any additional cross-members. The frame defines an opening that extends from a front side of the frame to a back side of the frame and from the first wall to the second wall. It is to be understood that the ceiling may include side bars, louvers, etc. that may extend along one or more axes of the ceiling. Likewise, the first wall and second wall may include structural support arms or members that may extend along one or more respective axes of the first wall and second wall. The frame may not include any additional cross-members, such as cross-beams or other supports that may obstruct the opening formed by the frame. The modular booth further includes a set of casters coupled to a ground surface of the frame, a caster locking mechanism configured to selectively restrict movement of one or more casters of the set of casters, a plurality of modular elements coupled to the frame, including a first seat and a first desk, and a first pair of bi-fold doors coupled to a first side of the frame and a second pair of bi-fold doors coupled to a second side of the frame. When the first pair of bi-fold doors, the second pair of bi-fold doors, and plurality of modular elements are in respective stowed positions, the opening formed by the frame is unobstructed. For example, when the doors are open and the modular elements are stowed, no booth components may extend beyond the first wall or the second wall and into the opening formed by the frame.

In an example, the first seat and first desk are coupled to the first wall, and the booth further includes a console coupleable to the second wall, the console including a microwave and refrigerator.

In an example, the first seat includes a seat portion, a backrest portion, and a support arm, the support arm pivotally coupled to the seat portion via a first hinge assembly, the seat portion pivotally coupled to the backrest portion via a second hinge assembly. The first seat may be movable between a stowed position and an extended position, wherein in the stowed position, an outer surface of each of the seat portion, the backrest portion, and the support arm are arranged in parallel with an interior surface of the first wall, and wherein in the extended position, the outer surface of the seat portion is perpendicular to the interior surface of the first wall. It is to be understood that the interior surface of the first wall (and an interior surface of the second wall) are opposite a respective outer surface. When the frame is assembled, the inner surface(s) face the opening formed by the frame (e.g., the interior surfaces of the first wall and second wall face into the workspace). In some examples, each of the seat portions, the backrest portion, and the support arm include a respective cushion.

In an example, the plurality of modular elements further includes a second seat and a second desk arranged symmetrically to the first seat and first desk. For example, the second seat may be coupled to the second wall at a location that is directly opposite the first seat, and the second desk may be coupled to the second wall at a location that is directly opposite the first desk. When the first seat and second seat are positioned in the same position (e.g., stowed or fully extended), the first seat and second seat are symmetric, e.g., the frame may have an axis of symmetry that extends vertically from the ceiling to a ground on which the booth sits and that extends between the first seat and second seat. Likewise, when the first desk and second desk are positioned in the same position (e.g., stowed or fully extended), the first desk and second desk are symmetric, e.g., the frame may have an axis of symmetry that extends vertically from the ceiling to a ground on which the booth sits and that extends between the first desk and second desk.

In another representation, a modular booth includes a frame configured to define a workspace and formed by a first wall, a second wall opposing the first wall, and a ceiling configured to couple to the first wall and the second wall. The modular booth is adjustable between a working configuration and a storage configuration via coupling or uncoupling of the ceiling. The modular booth may be any of the modular booth configurations described herein and may include the doors, modular elements, casters, etc., described herein. In some examples, additionally or alternatively, the modular booth includes a first pair of doors coupled to a first side of the frame and a second pair of doors coupled to a second side of the frame, the first and second pair of doors configured to enclose the workspace when in a fully-extended position and open the workspace when in a semi-extended or retracted (e.g., stowed) position. In some examples, additionally or alternatively, the modular booth includes one or more modular elements coupled to the frame and movable between a stowed position and fully extended position. In some examples, additionally or alternatively, the booth being in the working configuration includes the ceiling being coupled to the first wall and the second wall, for example via one or more corner gussets and/or fasteners. The booth being in the storage configuration may include the ceiling not being coupled to the first wall or second wall in a manner to form the frame, e.g., not coupled via corner gussets or fasteners. When in the storage configuration, the walls and/or ceiling may be in contact but may not be fixedly coupled together.

In another representation, a modular booth includes a frame configured to define a workspace and formed by a first wall, a second wall opposing the first wall, and a ceiling configured to couple to the first wall and the second wall. The modular booth includes a sound dampening structure coupleable to a bottom of the frame. The modular booth may be any of the modular booth configurations described herein and may include the doors, modular elements, casters, etc., described herein. In some examples, additionally or alternatively, the modular booth includes a first pair of doors coupled to a first side of the frame and a second pair of doors coupled to a second side of the frame, the first and second pair of doors configured to enclose the workspace when in a fully-extended position and open the workspace when in a semi-extended or retracted (e.g., stowed) position. In some examples, additionally or alternatively, the modular booth includes one or more modular elements coupled to the frame and movable between a stowed position and fully extended position. In some examples, additionally or alternatively, the sound dampening structure comprises a sound dampening skirt including a plurality of sections each coupled to a different surface of the frame and/or the doors in order to surround a bottom perimeter of the frame/booth. In some examples, additionally or alternatively, the booth may further include a sound-damping top coupled to the ceiling to reduce an amount of noise passing into the workspace of the modular booth.

In another representation, a modular booth includes a frame configured to define a workspace and formed by a first wall, a second wall opposing the first wall, and a ceiling configured to couple to the first wall and the second wall. The modular booth includes a removable console coupled to the first wall, the console including one or more of a microwave oven, refrigerator, bottle holder, and storage container. The modular booth may be any of the modular booth configurations described herein and may include the doors, modular elements, casters, etc., described herein. In some examples, additionally or alternatively, the modular booth includes a first pair of doors coupled to a first side of the frame and a second pair of doors coupled to a second side of the frame, the first and second pair of doors configured to enclose the workspace when in a fully-extended position and open the workspace when in a semi-extended or retracted (e.g., stowed) position. In some examples, additionally or alternatively, the modular booth includes one or more modular elements coupled to the frame and movable between a stowed position and fully extended position.

In another representation, a booth system includes a first modular booth coupleable to a second modular booth. The first modular booth and the second modular booth may each be any of the modular booth configurations described herein and may include the doors, modular elements, casters, etc., described herein. The first modular booth includes a first frame configured to define a first workspace and formed by a first wall, a second wall opposing the first wall, and a first ceiling configured to couple to the first wall and the second wall. The second modular booth includes a second frame configured to define a second workspace and formed by a third wall, a fourth wall opposing the third wall, and a second ceiling configured to couple to the third wall and the fourth wall. In some examples, additionally or alternatively, the first modular booth includes a first pair of doors coupled to a first side of the first frame and a second pair of doors coupled to a second side of the first frame, the first and second pair of doors configured to enclose the first workspace when in a fully-extended position and open the first workspace when in a semi-extended or retracted (stowed) position. In some examples, additionally or alternatively, the first modular booth includes one or more first modular elements coupled to the first frame and movable between a stowed position and fully extended position. In some examples, additionally or alternatively, the second modular booth includes a third pair of doors coupled to a first side of the second frame and a fourth pair of doors coupled to a second side of the second frame, the third and fourth pair of doors configured to enclose the second workspace when in a fully-extended position and open the second workspace when in a semi-extended or retracted (e.g., stowed) position. In some examples, additionally or alternatively, the second modular booth includes one or more second modular elements coupled to the second frame and movable between a stowed position and fully extended position. In some examples, additionally or alternatively, the first and second modular booths are coupleable in a series arrangement where a first central longitudinal axis of the first ceiling is aligned (e.g., collinear) with a second central longitudinal axis of the second ceiling and/or the second wall is coupled to the third wall. In this way, the two booths may be coupled to form row-style arrangements of booths. In some examples, additionally or alternatively, the first and second modular booths are coupleable in a parallel arrangement with the first central longitudinal axis is parallel to but spaced apart from the second central longitudinal axis (e.g., the first and second central longitudinal axes are not collinear). In this way, the two booths may be coupled to form a column-style arrangement of booths.

Note that the example control and estimation routines included herein can be used with various modular booth configurations. The control methods and routines disclosed herein may be stored as executable instructions in non-transitory memory and may be carried out by the control system including the controller in combination with the various sensors, actuators, and other booth hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the booth control system, where the described actions are carried out by executing the instructions in a system including the various booth hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to booths including a different number and/or position of desks, seats, etc., booths including different electronic components (e.g., video and/or communication equipment such as display screens), etc. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A modular booth, comprising:

a frame formed by a first wall, a second wall opposing the first wall, and a ceiling extending between the first and second opposing walls, the frame defining an opening that extends from a front side of the frame to a back side of the frame and from the first wall to the second wall;

a set of casters coupled to a ground surface of the frame;

a caster locking mechanism configured to selectively restrict movement of one or more casters of the set of casters;

a plurality of modular elements coupled to the frame, including a first seat and a first desk; and a first pair of bi-fold doors coupled to a first side of the frame and a second pair of bi-fold doors coupled to a second side of the frame, wherein when the first pair of bi-fold doors, the second pair of bi-fold doors, and the plurality of modular elements are in respective stowed positions, the opening is unobstructed, and wherein with the first seat and the first desk each in a first configuration, the first desk and cushions of the first seat form a parallel co-planar flat surface defining between a first and a second structural member positioned in parallel with each other, with no portions of the first desk and no portions of the first seat extending past the first and second structural members.

2. The modular booth of claim 1, wherein the first seat and the first desk are coupled to the first wall, and further comprising a console coupleable to the second wall, the console including a microwave and refrigerator.

3. The modular booth of claim 1, wherein the first seat comprises a seat portion, a backrest portion, and a support arm, the support arm pivotally coupled to the seat portion via a first hinge assembly, the seat portion pivotally coupled to the backrest portion via a second hinge assembly, wherein the first seat is movable between a stowed position and an extended position, wherein in the stowed position, outer surfaces of each of the seat portion, the backrest portion, and the support arm are arranged in parallel with an interior surface of the first wall, and wherein in the extended position, the outer surface of the seat portion is perpendicular to the interior surface of the first wall.

4. The modular booth of claim 3, wherein each of the seat portion, the backrest portion, and the support arm includes a respective cushion.

5. The modular booth of claim 1, wherein the plurality of modular elements further includes a second seat and a second desk arranged symmetrically to the first seat and the first desk.

6. The modular booth of claim 1, wherein the first seat includes a plurality of foldable portions each with a cushion and hingedly coupled to each other.

7. The modular booth of claim 1, wherein the first seat includes at least two portions hingedly coupled to one another.

8. The modular booth of claim 1, wherein the first desk includes at least two flat portions, a first flat portion hingedly coupled to a second flat portion, the second flat portion having an end hingedly coupled within the first wall.

9. The modular booth of claim 1, wherein in a first configuration of each of the first seat and the first desk, top edges of the first desk and the first seat are aligned.

10. The modular booth of claim 1, wherein each of the first seat and the first desk include slidable tracks to enable sliding only in the vertical direction and not any other direction.

11. The modular booth of claim 1, wherein, in a second configuration of each of the first desk and the first seat, both the first seat and the first desk extend past the first wall defined by a first and a second structural member.

12. A modular booth, comprising:

a frame formed by a first wall, a second wall opposing the first wall, and a ceiling extending between the first and second opposing walls, the frame defining an opening that extends from a front side of the frame to a back side of the frame and from the first wall to the second wall;

a set of casters coupled to a ground surface of the frame;

a caster locking mechanism configured to selectively restrict movement of one or more casters of the set of casters;

a plurality of modular elements coupled to the frame, including a first seat and a first desk; and a first pair of bi-fold doors coupled to a first side of the frame and a second pair of bi-fold doors coupled to a second side of the frame, wherein when the first pair of bi-fold doors, the second pair of bi-fold doors, and the plurality of modular elements are in respective stowed positions, the opening is unobstructed, and wherein each of the first seat and the first desk includes slidable tracks to enable sliding only in the vertical direction and not any other direction.

13. The modular booth of claim 12, wherein the first seat and the first desk are coupled to the first wall, and further comprising a console coupleable to the second wall, the console including a microwave and refrigerator.

14. The modular booth of claim 12, wherein the first seat comprises a seat portion, a backrest portion, and a support arm, the support arm pivotally coupled to the seat portion via a first hinge assembly, the seat portion pivotally coupled to the backrest portion via a second hinge assembly, wherein the first seat is movable between a stowed position and an extended position, wherein in the stowed position, outer surfaces of each of the seat portion, the backrest portion, and the support arm are arranged in parallel with an interior surface of the first wall, and wherein in the extended position, the outer surface of the seat portion is perpendicular to the interior surface of the first wall.

15. The modular booth of claim 14, wherein each of the seat portion, the backrest portion, and the support arm includes a respective cushion.

16. The modular booth of claim 12, wherein the plurality of modular elements further includes a second seat and a second desk arranged symmetrically to the first seat and the first desk, and wherein the first seat includes a plurality of foldable portions each with a cushion and hingedly coupled to each other.

17. The modular booth of claim 12, wherein the first seat includes at least two portions hingedly coupled to one another, and wherein the first desk includes at least two flat portions, a first flat portion hingedly coupled to a second flat portion, the second flat portion having an end hingedly coupled within the first wall.

18. The modular booth of claim 12, wherein in a first configuration of each of the first seat and the first desk, top edges of the first desk and the first seat are aligned.

19. A modular booth, comprising:

a frame formed by a first wall, a second wall opposing the first wall, and a ceiling without any floor extending between the first and second opposing walls, the frame defining an opening that extends from a front side of the frame to a back side of the frame and from the first wall to the second wall;

a set of casters coupled to a ground surface of the frame;

a caster locking mechanism configured to selectively restrict movement of one or more casters of the set of casters;

a plurality of modular elements coupled to the frame, including a first seat and a first desk; and a first pair of bi-fold doors coupled to a first side of the frame and a second pair of bi-fold doors coupled to a second side of the frame, wherein when the first pair of bi-fold doors, the second pair of bi-fold doors, and the plurality of modular elements are in respective stowed positions, the opening is unobstructed.

* * * * *